US007855622B2

(12) United States Patent
Guan

(10) Patent No.: US 7,855,622 B2
(45) **Date of Patent: *Dec. 21, 2010**

(54) REFLECTION-TYPE BANDPASS FILTER

(75) Inventor: Ning Guan, Sakura (JP)

(73) Assignee: Fujikura Ltd., Tokyo (JP)

( * ) Notice: Subject to any disclaimer, the term of this patent is extended or adjusted under 35 U.S.C. 154(b) by 238 days.

This patent is subject to a terminal disclaimer.

(21) Appl. No.: 11/867,528

(22) Filed: Oct. 4, 2007

(65) Prior Publication Data

US 2008/0238577 A1 Oct. 2, 2008

(30) Foreign Application Priority Data

Oct. 5, 2006 (JP) ..... 2006-274325
Oct. 5, 2006 (JP) ..... 2006-274326

(51) Int. Cl.
*H01P 1/203* (2006.01)

(52) U.S. Cl. ..... 333/204

(58) Field of Classification Search ..... 333/202, 333/204, 166–168, 175, 176, 185, 238
See application file for complete search history.

(56) References Cited

U.S. PATENT DOCUMENTS 2,411,555 A 11/1946 Rogers
3,617,877 A 11/1971 Hobson
4,371,853 A 2/1983 Makimoto et al.
4,992,760 A * 2/1991 Takeda et al. ..... 333/219.2
5,418,507 A * 5/1995 Keane et al. ..... 333/202

(Continued)

FOREIGN PATENT DOCUMENTS

CH 663 690 A5 12/1987

(Continued)

OTHER PUBLICATIONS

Le Roy M et al: "Novel Circuit Models of Arbitrary-Shape Line: Application to Parallel Coupled Microstrip Filters with Suppression of Multi-Harmonic Responses" 2005 European Microwave Conference CNIT LA Defense, Paris, France Oct. 4-6, 2005, Piscataway, NJ, USA, IEEE, Oct. 4, 2005, pp. 921-924, XP0109003914 ISBN: 2-9600551-2-8 *p. 921, paragraph II—p. 922, paragraph III * figures 1,2 * adstract*.

(Continued)

*Primary Examiner*—Benny Lee
*Assistant Examiner*—Gerald Stevens
(74) *Attorney, Agent, or Firm*—Sughrue Mion, PLLC

(57) ABSTRACT

A reflection-type bandpass filter for ultra-wideband wireless data communication is provided. The filter comprises two conductors extending in a first direction on the surface of a dielectric substrate at a first distance from each other, the surface of the dielectric substrate between the conductors defining a non-conducting portion, wherein the width of the two conductors or the first distance, or both, varies in a length direction of the two conductors. Furthermore, a reflection-type bandpass filter comprising a dielectric substrate; a first conductor provided on the surface of the dielectric substrate; and a side conductor provided next to the first conductor at a first distance from the first conductor, with a non-conducting portion intervening a portion between the first and side conductors, wherein the first conductor width or the distance between the first and side conductors, or both, varies along the length direction of the first conductor, is provided.

22 Claims, 24 Drawing Sheets

U.S. PATENT DOCUMENTS

| | | | | |
|---|---|---|---|---|
| 5,525,953 | A | 6/1996 | Okada et al. | |
| 5,923,295 | A | 7/1999 | Nakano et al. | |
| 6,323,740 | B1 | 11/2001 | Ishikawa et al. | |
| 6,353,371 | B1 | 3/2002 | Kadota et al. | |
| 6,563,403 | B2 | 5/2003 | Kanba et al. | |
| 6,577,211 | B1 | 6/2003 | Tsujiguchi | |
| 6,603,376 | B1 * | 8/2003 | Handforth et al. | 333/238 |
| 6,686,808 | B1 | 2/2004 | Sugawara et al. | |
| 6,924,714 | B2 * | 8/2005 | Jain | 333/123 |
| 2005/0140472 | A1 | 6/2005 | Ko et al. | |
| 2006/0061438 | A1 | 3/2006 | Toncich | |
| 2006/0255886 | A1 * | 11/2006 | Ninomiya et al. | 333/204 |
| 2007/0159276 | A1 | 7/2007 | Han et al. | |
| 2007/0210880 | A1 | 9/2007 | Bobier et al. | |

FOREIGN PATENT DOCUMENTS

| | | | |
|---|---|---|---|
| CN | 1097082 | A | 1/1995 |
| JP | 56-64501 | A | 6/1981 |
| JP | 9-172318 | A | 6/1997 |
| JP | 9-232820 | A | 9/1997 |
| JP | 10-65402 | A | 3/1998 |
| JP | 10-242746 | A | 9/1998 |
| JP | 2000-4108 | A | 1/2000 |
| JP | 2000-101301 | A | 4/2000 |
| JP | 2002-43810 | A | 2/2002 |
| SU | 1 728 904 | A1 | 4/1992 |

OTHER PUBLICATIONS

Sun S et al: "Guided-Wave Characteristics of Periodically Nonuniform Coupled Microstrip Lines—Even and Odd Modes" IEEE Transactions on Microwave Theory and Techniques, IEEE Service Center, Piscataway, NJ, US, vol. 53, No. 4, Apr. 2005, pp. 1221-1227, XP01130506 ISSN: 0018-9480 *the whole document*.

Young P R et al: "Accurate non-uniform transmission line model and its application to the de-embedding of on-water measurements" IEE Proceedings H. Microwaves, Antennas & Propagation, Institution of Electrical Engineers. Stevenage , GB, vol. 148, No. 3, Jun. 11, 2001, pp. 153-156, XP006016881 ISSN: 0950-107X * p. 155, paragraph 3- p. 156, paragraph 4 * figures 4-6 * abstract*.

Boulejfen N et al: "A robust and efficient method for the frequency domain analysis of non-uniform, lossy multi-line transmission structures" Microwave Symposium Digest, 1998 IEEE MTT-S International Baltimore, MD, USA Jun. 7-12, 1998, pp. 1763-1766, XP010290106 ISBN: 0-7803-4471-5* p. 1764, right-hand column, line 23- p. 1765, left-hand column, line 25* figure 3-6* abstract.

A. V. Oppenheim and R. W. Schafer, "Discrete-time signal processing," pp. 465-478, Prentice Hall, 1998.

G-B. Xiao, K. Yashiro, N. Guan, and S. Ohokawa, "An effective method for designing nonuniformly coupled transmission-line filters," IEEE Trans. Microwave Theory Tech., vol. 49, pp. 1027-1031, Jun. 2001.

Y. Konishi, "Microwave integrated circuits", pp. 19-21, Marcel Dekker, 1991.

Y. Konishi, "Microwave Integrated Circuits", 1991, pp. 9-11, Marcel Dekker.

Mirshekar-Syahkal et al., "Accurate Analysis of Tapered Planar Transmission Lines for Microwave Integrated Circuits", IEEE Transactions on Microwave Theory and Techniques, Feb. 1981, pp. 123-128, vol. 29, No. 2, IEEE.

Wang et al., "Ultra-Wideband Bandpass Filter with Hybrid Microstrip/CPW Structure", IEEE Microwave and Wireless Components Letters, Dec. 2005, pp. 844-846, vol. 15, No. 12, IEEE.

Chen et al., "Design of a UWB low insertion loss bandpass filter with spurious response suppression," Microwave Journal, Feb. 2006, pp. 112-116.

Xiao, et al., "A New Numerical Method for Synthesis of Arbitrarily Terminated Lossless Nonuniform Transmission Lines", IEEE Transactions on Microwave Theory and Techniques, Feb. 2001, pp. 369-376, vol. 49, No. 2, IEEE Service Center, Piscataway, NJ, US, XP011038268.

Xiao, et al., "Impedance Matching for Complex Loads Through Nonuniform Transmission Lines", IEEE Transactions on Microwave Theory and Techniques, Jun. 2002, pp. 1520-1525, vol. 50, No. 6, IEEE Service Center, Piscataway, NJ, US, XP011076613.

Chang, et al., "Wide-Band Equal-Ripple Filters in Nonuniform Transmission Lines", IEEE Transactions on Microwave Theory and Techniques, Apr. 2002, pp. 1114-1119, vol. 50, No. 4, IEEE Service Center, Piscataway, NJ, US, XP011076539.

Moreira, et al., "Direct Synthesis of Microwave Filters Using Inverse Scattering Transmission-Line Matrix Method", IEEE Transactions on Microwave Theory and Techniques, Dec. 2000, pp. 2271-2276, vol. 48, No. 12, IEEE Service Center, Piscataway, NJ, US, XP011038181.

Le Roy et al., "A New Design of Microwave Filters by Using Continuously Varying Transmission Lines", Microwave Symposium Digest 1997, IEEE MTT-S International Denver, CO, USA Jun. 8-13, 1997, Jun. 8, 1997, pp. 639-642, vol. 2, IEEE, New York, NY, US, XP010228412.

Le Roy et al., "The Continuously Varying Transmission-Line Technique-Application to Filter Design", IEEE Transactions on Microwave Theory and Techniques, Sep. 1999, pp. 1680-1687, vol. 47, No. 9, IEEE, XP 11037721.

Pan et al., "Arbitrary Filter Design by Using Nonuniform Transmission Lines", IEEE Microwave and Guided Wave Letters, Feb. 1999, pp. 60-62, vol. 9, No. 2, IEEE, XP 011035415.

Yang et al., "Design of Dual Passband Filter Based on Zakharov-Shabat Inverse Scattering Problem", APMC2005 Proceedings, Dec. 4-7, 2005, pp. 1-3, IEEE, XP 10901861.

Huang, "Quasi-Transversal Synthesis of Microwave Chirped Filters", Electronics Letters, May 21, 1992, pp. 1062-1064, vol. 28, No. 11, IEE Stevenage, GB, XP000305900.

Deng et al., "Multiple-Mode Resonance Bands in Periodically Nonuniform Conductor-Backed Coplanar Waveguides", Microwave Conference, 1999 Asia Pacific Singapore Nov. 30-Dec. 3, 1999, pp. 5-8, vol. 1, IEEE, Piscataway, NJ, USA, XP010374097.

Xiao et al, "An Efficient Algorithm for Solving Zakharov-Shabat Inverse Scattering Problem", IEEE Transactions on Antennas and Propagation, Jun. 2002, pp. 807-811, vol. 50, No. 6, IEEE.

Tan et al., "Analysis and design of conductor-backed asymmetric coplanar waveguide lines using conformal mapping techniques and their application to end-coupled filters," IEICE Trans. Electron., Jul. 1999, pp. 1098-1103, vol. E82-C, No. 7.

Cheng et al., "Inverse Scattering of Nonuniform, Symmetrical Coupled Lines" IEEE Microwave and Guided Wave Letters, IEEE Inc, New-York, US, vol. 8, No. 7, Jul. 1998, pp. 260-262.

Ma et al., "Experimentally investigating slow-wave transmission lines and filters based on conductor-backed CPW periodic cells" Microwave Symposium Digest, 2005 IEEE MTT-S International Long Beach, CA, USA Jun. 12-17, 2005, Piscataway, NJ, USA IEEE, Jun. 12, 2005, pp. 1653-1656.

P. Ghanipour et al., "Suppression of Mode Coupling in Conductor-Backed Asymmetric Coplanar Strips Using Slow-Wave Electrodes", IEEE Microwave and Wireless Components Letters, May 2006, vol. 16, No. 5, 272-274.

* cited by examiner

REFLECTION-TYPE BANDPASS FILTER

CROSS-REFERENCE TO RELATED PATENT APPLICATIONS

This application claims priority from Japanese Patent Application No. 2006-274325, filed on Oct. 5, 2006, and Japanese Patent Application No. 2006-274326, filed on Oct. 5, 2006, the disclosures of which are incorporated herein their entirety by reference.

BACKGROUND OF THE INVENTION

1. Field of the Invention

This invention relates to a reflection-type bandpass filter for use in ultra-wideband (UWB) wireless data communication.

2. Description of the Related Art

This invention relates to a reflection-type bandpass filter for use in ultra-wideband (hereafter "UWB") wireless data communication. By using this UWB reflection-type bandpass filter, U.S. Federal Communications Commission requirements for spectrum masks can be satisfied.

As technology of the prior art related to this invention, for example, the technology disclosed in the following references 1 through 12 is known.

Reference 1: Specification of U.S. Pat. No. 2,411,555

Reference 2: Japanese Unexamined Patent Application No. 56-64501

Reference 3: Japanese Unexamined Patent Application No. 9-172318

Reference 4: Japanese Unexamined Patent Application No. 9-232820

Reference 5: Japanese Unexamined Patent Application No. 10-65402

Reference 6: Japanese Unexamined Patent Application No. 10-242746

Reference 7: Japanese Unexamined Patent Application No. 2000-4108

Reference 8: Japanese Unexamined Patent Application No. 2000-101301

Reference 9: Japanese Unexamined Patent Application No. 2002-43810

Reference 10: A. V. Oppenheim and R. W. Schafer, "Discrete-time signal processing," pp. 465-478, Prentice Hall, 1998.

Reference 11: G-B. Xiao, K. Yashiro, N. Guan, and S. Ohokawa, "An effective method for designing nonuniformly coupled transmission-line filters," IEEE Trans. Microwave Theory Tech., vol. 49, pp. 1027-1031, June 2001.

Reference 12: Y. Konishi, "Microwave integrated circuits", pp. 19-21, Marcel Dekker, 1991

However, the bandpass filters proposed in the prior art may not satisfy the FCC specifications, due to manufacturing tolerances and other reasons.

Among bandpass filters from the prior art, a bandpass filter with a configuration wherein one microstrip line is provided on a substrate requires a ground conductor below a dielectric. Therefore, for example, it is difficult for this bandpass filter to configure a circuit together with an antenna having a flat dipole antenna and to be used.

Furthermore, among bandpass filters from the prior art, bandpass filters which use coplanar strips do not use wide ground strips, and so are not suitable for coupling with transmission lines such as slot lines.

This invention has as an object the provision of a high-performance UWB reflection-type bandpass filter which configures the circuit easily and is easy to use, and which satisfies FCC specifications.

Furthermore, this invention has as an object the provision of a high-performance UWB reflection-type bandpass filter which has excellent coupling characteristics with transmission lines such as slot lines, and which satisfies FCC specifications.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The first aspect of the present invention relates to a reflection-type bandpass filter for ultra-wideband wireless data communication, in which two conductors extending in band form are provided on the surface of a dielectric substrate at a prescribed distance, the surface of the dielectric substrate between the conductors defining a non-conducting portion, and in which the conductor widths or the distance between conductors, or both, are distributed non-uniformly in the length direction of the conductors.

In a reflection-type bandpass filter of the first aspect of the present invention, it is preferable that the conductor widths be constant, and that the distance between conductors be distributed non-uniformly.

In a reflection-type bandpass filter of the first aspect of the present invention, it is preferable that the distance between conductors be constant, and that the conductor widths be distributed non-uniformly.

In a reflection-type bandpass filter of the first aspect of the present invention, it is preferable that there be a difference of 10 dB or higher between the reflectance in the ranges of frequencies f for which $f<3.1$ GHz and $f>10.6$ GHz, and the reflectance in the range of frequencies 3.7 GHz$\leqq f \leqq$10.0 GHz, and that in the range 3.7 GHz$\leqq f \leqq$10.0 GHz the group delay variation be within ±0.2 ns.

In a reflection-type bandpass filter of the first aspect of the present invention, it is preferable that there be a difference of 10 dB or higher between the reflectance in the ranges of frequencies f for which $f<3.1$ GHz and $f>10.6$ GHz, and the reflectance in the range of frequencies 3.8 GHz$\leqq f \leqq$9.9 GHz, and that in the range 3.8 GHz$\leqq f \leqq$9.9 GHz the group delay variation be within ±0.1 ns.

In a reflection-type bandpass filter of the first aspect of the present invention, it is preferable that there be a difference of 10 dB or higher between the reflectance in the ranges of frequencies f for which $f<3.1$ GHz and $f>10.6$ GHz, and the reflectance in the range of frequencies 4.2 GHz$\leqq f \leqq$9.6 GHz, and that in the range 4.2 GHz$\leqq f \leqq$9.6 GHz the group delay variation be within ±0.15 ns.

In a reflection-type bandpass filter of the first aspect of the present invention, it is preferable that there be a difference of 10 dB or higher between the reflectance in the ranges of frequencies f for which $f<3.1$ GHz and $f>10.6$ GHz, and the reflectance in the range of frequencies 4.5 GHz$\leqq f \leqq$9.2 GHz, and that in the range 4.5 GHz$\leqq f \leqq$9.2 GHz the group delay variation be within ±0.05 ns.

In a reflection-type bandpass filter of the first aspect of the present invention, it is preferable that the characteristic impedance Zc of the input terminal transmission line be in the range $10\Omega \leqq Zc \leqq 200\Omega$.

In a reflection-type bandpass filter of the first aspect of the present invention, it is preferable that a resistance having the same impedance as the above characteristic impedance value, or a non-reflecting terminator, be provided on the terminating side.

In a reflection-type bandpass filter of the first aspect of the present invention, it is preferable that each of the conductors comprises metal plates of thickness equal to or greater than the skin depth of the metal plates at f=1 GHz.

In a reflection-type bandpass filter of the first aspect of the present invention, it is preferable that the dielectric substrate be of thickness h in the range 0.1 mm≦h≦10 mm, that the relative permittivity $\in_r$ be in the range $1 \leqq \in_r \leqq 500$, that the width W be in the range 2 mm≦W≦100 mm, and that the length L be in the range 2 mm≦L≦500 mm.

In a reflection-type bandpass filter of the first aspect of the present invention, it is preferable that the length-direction distributions of the conductor widths and of the distance between conductors be determined using a design method based on the inverse problem of deriving a potential from spectral data in the Zakharov-Shabat equation.

In a reflection-type bandpass filter of the first aspect of the present invention, it is preferable that the length-direction distributions of the conductor widths and of the distance between conductors be determined using a window function method.

In a reflection-type bandpass filter of the first aspect of the present invention, it is preferable that the length-direction distributions of the conductor widths and of the distance between conductors be determined using a Kaiser window function method.

The second aspect of the present invention relates to a reflection-type bandpass filter for ultra-wideband wireless data communication, comprising a dielectric substrate, a band-shaped conductor provided on the surface of the dielectric substrate, and a side conductor provided on one side of the band-shaped conductor securing a prescribed distance between conductors with a non-conducting portion intervening; and the band-shaped conductor width or the distance between conductors, or both, are distributed non-uniformly along the band-shaped conductor length direction.

In a reflection-type bandpass filter of the second aspect of the present invention, it is preferable that the band-shaped conductor width be constant, and that the distance between conductors be distributed non-uniformly.

In a reflection-type bandpass filter of the second aspect of the present invention, it is preferable that one or both of the opposing side edges of the two conductors be a straight line, or that both of the opposing side edges of the two conductors be distributed non-uniformly in the band-shaped conductor length direction.

In a reflection-type bandpass filter of the second aspect of the present invention, it is preferable that the distance between conductors be constant, and that the band-shaped conductor width be distributed non-uniformly.

In a reflection-type bandpass filter of the second aspect of the present invention, it is preferable that both of the opposing side edges of the two conductors be straight lines, or that both of the opposing side edges of the two conductors be distributed non-uniformly in the band-shaped conductor length direction.

In a reflection-type bandpass filter of the second aspect of the present invention, it is preferable that there be a difference of 10 dB or higher between the reflectance in the ranges of frequencies f for which f<3.1 GHz and f>10.6 GHz, and the reflectance in the range of frequencies 3.8 GHz≦f≦10.0 GHz, and that in the range 3.8 GHz≦f≦10.0 GHz the group delay variation be within ±0.1 ns.

In a reflection-type bandpass filter of the second aspect of the present invention, it is preferable that there be a difference of 10 dB or higher between the reflectance in the ranges of frequencies f for which f<3.1 GHz and f>10.6 GHz, and the reflectance in the range of frequencies 4.5 GHz≦f≦9.1 GHz, and that in the range 4.5 GHz≦f≦9.1 GHz the group delay variation be within ±0.05 ns.

In a reflection-type bandpass filter of the second aspect of the present invention, it is preferable that there be a difference of 10 dB or higher between the reflectance in the ranges of frequencies f for which f<3.1 GHz and f>10.6 GHz, and the reflectance in the range of frequencies 4.5 GHz≦f≦9.3 GHz, and that in the range 4.5 GHz≦f≦9.3 GHz the group delay variation be within ±0.05 ns.

In a reflection-type bandpass filter of the second aspect of the present invention, it is preferable that the characteristic impedance Zc of the input terminal transmission line be in the range 10Ω≦Zc≦300Ω.

In a reflection-type bandpass filter of the second aspect of the present invention, it is preferable that a resistance having the same impedance as the above characteristic impedance value, or a non-reflecting terminator, be provided on the terminating side.

In a reflection-type bandpass filter of the second aspect of the present invention, it is preferable that the band-shaped conductor and the side conductor comprise metal plates of thickness equal to or greater than the skin depth of the metal plates at f=1 GHz.

In a reflection-type bandpass filter of the second aspect of the present invention, it is preferable that the dielectric substrate be of thickness h in the range 0.1 mm≦h≦5 mm, that the relative permittivity $\in_r$ be in the range $1 \leqq \in_r \leqq 500$, that the width W be in the range 2 mm≦W≦100 mm, and that the length L be in the range 2 mm≦L≦300 mm.

In a reflection-type bandpass filter of the second aspect of the present invention, it is preferable that the length-direction distributions of the band-shaped conductor width and of the distance between conductors be determined using a design method based on the inverse problem of deriving a potential from spectral data in the Zakharov-Shabat equation.

In a reflection-type bandpass filter of the second aspect of the present invention, it is preferable that the length-direction distributions of the band-shaped conductor width and of the distance between conductors be determined using a window function method.

In a reflection-type bandpass filter of the second aspect of the present invention, it is preferable that the length-direction distributions of the band-shaped conductor width and of the distance between conductors be determined using a Kaiser window function method.

In a reflection-type bandpass filter of the first aspect of the present invention, by applying a window function technique to design a reflection-type bandpass filter comprising non-uniform microstrip line, the pass band can be made extremely broad and variation in group delay within the pass band can be made extremely small compared with filters of the prior art, even when manufacturing tolerances are large. As a result, a UWB bandpass filter can be provided which satisfies FCC specifications.

Furthermore, a ground conductor below a dielectric is no longer required. Therefore, for example, it becomes easier for the bandpass filter to configure a circuit together with an antenna having a flat dipole antenna and to be used.

In a reflection-type bandpass filter of the second aspect of the present invention, by applying a window function technique to design a reflection-type bandpass filter comprising a non-uniform symmetric-type two-conductor coplanar strip, the pass band can be made extremely broad and variation in group delay within the pass band can be made extremely small compared with filters of the prior art, even when manufacturing tolerances are large. As a result, a UWB bandpass filter can be provided which satisfies FCC specifications.

Further, ground strips can be made wide, so that easy coupling with transmission lines such as slot lines is achieved. Here, "ground strips" refers to the conductors on both sides, which are connected together on the input end.

DESCRIPTION OF THE PREFERRED EMBODIMENTS

Figure 1:
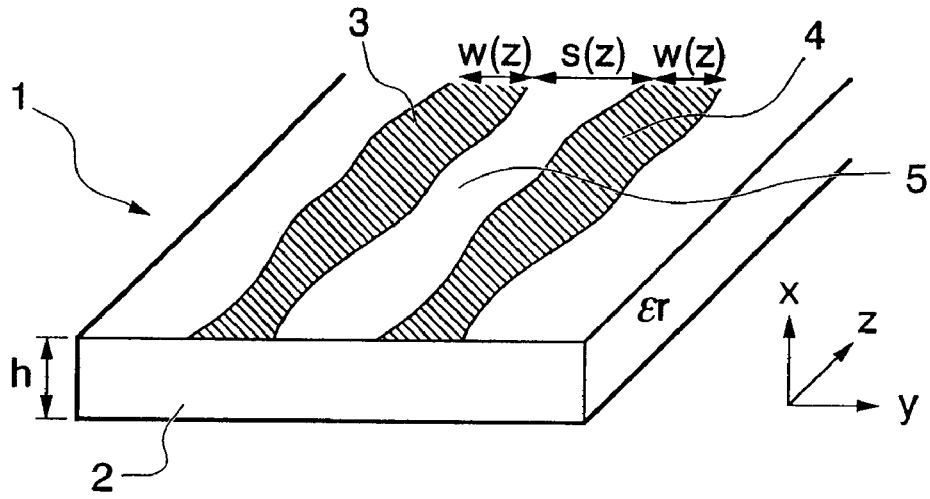
FIG. 1 is a perspective view showing one aspect of a reflection-type bandpass filter of the invention.

Below, an aspect of the invention is explained referring to the drawings.

FIG. 1 is a perspective view showing in summary of the configuration of a reflection-type bandpass filter of Embodiments 1 through 4. In the figure, the symbol 1 is the reflection-type bandpass filter, 2 is a dielectric substrate, 3 and 4 are conductors, and 5 is a non-conducting portion.

In the reflection-type bandpass filter 1, two conductors 3 and 4 extending in band form are provided on the surface of a dielectric substrate 2 at a prescribed distance, the surface of the dielectric substrate 2 between the conductors 3 and 4 defining a non-conducting portion; the non-uniform symmetric-type two-conductor coplanar strip (the coplanar strip in which two conductors are arranged symmetrically and width of the conductors are distributed non-uniformly) is such that the conductor widths w or the distance between conductors s, or both, are distributed non-uniformly in the length direction of the conductors.

As shown in FIG. 1, the z axis is taken along the length direction of the conductors 3 and 4, the y axis is taken in the direction perpendicular to the z axis and parallel to the surface of the substrate 2, and the x axis is taken in the direction perpendicular to the y axis and to the z axis. The length extending in the z axis direction from the end face on the input end is z. In the reflection-type bandpass filter 1, the width of the conductor 3 and the width of the conductor 4 are the same at each place where z is equal (hereafter the "the conductor width w").

A reflection-type bandpass filter of this invention adopts a configuration in which stop band rejection (the difference between the reflectance in the pass band, and the reflectance in the stop band) is increased, by using a window function method (see Reference 10 with respect to the window function method) employed in digital filter design. By this means, instead of expansion of the transition frequency region (the region between the pass band boundary and the stop band boundary), the stop band rejection can be increased. As a result, manufacturing tolerances can be increased. Also, variation in the group delay within the pass band is decreased.

Figure 47:
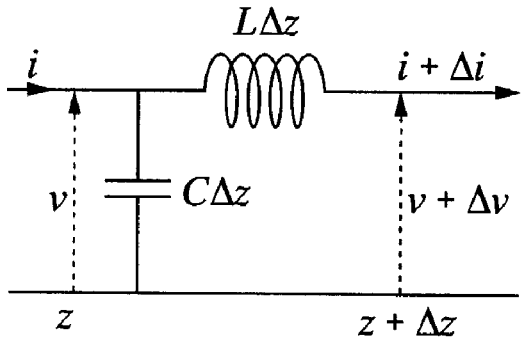

The transmission line of a reflection-type bandpass filter 1 of this invention can be represented by a non-uniformly distributed constant circuit such as in FIG. 47.

From FIG. 47, the following equation (1) obtains for the line voltage v(z,t) and the line current i(z,t).

$$\begin{cases} -\dfrac{\partial v(z,t)}{\partial z} = L(z)\dfrac{\partial i(z,t)}{\partial t}, \\ -\dfrac{\partial i(z,t)}{\partial z} = C(z)\dfrac{\partial v(z,t)}{\partial t}. \end{cases} \quad \text{(equation 1)}$$

Here L(z) and C(z) are the inductance and capacitance respectively per unit length in the transmission line. Here, the function of equation (2) is introduced.

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{(equation 2)}$$

Here $Z(z)=\sqrt{\{L(z)/C(z)\}}$ is the local characteristic impedance, and $\phi_1$, $\phi_2$ are the power wave amplitudes propagating in the +z and −z directions respectively.

Substitution into equation (1) yields equation (3).

(equation 3)

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases}$$

Here $c(z)=1/\sqrt{\{L(z)/C(z)\}}$. If the time factor is set to exp (jωt), and a variable transformation is performed as in equation (4) below, then the Zakharov-Shabat equation of equation (5) is obtained.

$$x(z) = \int_0^z \frac{ds}{c(s)} \quad \text{(equation 4)}$$

$$\begin{cases} \dfrac{\partial \phi_1(x)}{\partial x} + j\omega\phi_1(x) = -q(x)\phi_2(x), \\ \dfrac{\partial \phi_2(x)}{\partial x} - j\omega\phi_2(x) = -q(x)\phi_1(x). \end{cases} \quad \text{(equation 5)}$$

Here q(x) is as given by equation (6) below.

$$q(x) = \frac{1}{2}\frac{d\ln Z(x)}{dx}. \quad \text{(equation 6)}$$

The Zakharov-Shabat inverse problem involves synthesizing the potential q(x) from spectral data which is a solution satisfying the above equations (see Reference 11 with respect to the Zakharov-Shabat equation). If the potential q(x) is found, the local characteristic impedance Z(x) is determined as in equation (7) below.

$$Z(x)=Z(0)\exp\,[2\textstyle\int_0^x q(s)ds]. \quad \text{(equation 7)}$$

Here, normally in a process to determine the potential q(x), the reflectance coefficient r(x) in x space is calculated from the spectra data reflectance coefficient R(ω) using the following equation (8), and q(x) are obtained from r(x).

$$r(x) = \frac{1}{2\pi}\int_{-\infty}^{\infty} R(\omega)e^{-j\omega x}\,d\omega \qquad \text{(equation 8)}$$

In this invention, in place of obtaining r(x) from the R(ω) for ideal spectral data, a window function is applied as in equation (9) to determine r'(x).

$$r'(x)=w(x)r(x). \qquad \text{(equation 9)}$$

Here ω(x) is the window function. If the window function is selected appropriately, the stop band rejection level can be appropriately controlled. Here, a Kaiser window is used as an example. The Kaiser window is defined as in equation (10) below (see Reference 10 with respect to the Kaiser window).

$$w[n] = \begin{cases} \dfrac{I_0\left[\beta(1-[(n-\alpha)/\alpha]^2)^{1/2}\right]}{I_0(\beta)}, & 0 \le n \le M, \\ 0, & \text{otherwise} \end{cases} \qquad \text{(equation 10)}$$

Here α=M/s, and β is determined empirically as in equation (11) below.

$$\beta = \begin{cases} 0.1102(A-8.7), & A > 50, \\ 0.5842(A-21)^{0.4} + 0.07886(A-21), & 21 \le A \le 50, \\ 0, & A < 21 \end{cases} \qquad \text{(equation 11)}$$

Here $A=-20\log_{10}\delta$. where δ is the peak approximation error in the pass band and in the stop band.

In this way q(x) is determined, and from equation (7) the local characteristic impedance Z(x) is determined.

Here, of the coplanar strip in which two conductors are arranged symmetrically and are distributed non-uniformly, when either the conductor width w or the conductor-to-conductor distance between the conductor 3 and the conductor 4 (hereafter the "distance between conductors s" in the following Embodiments 1 through 4), or both, are varied, the characteristic impedance can be changed (see Reference 12 with respect to the characteristic impedance).

Figure 2:
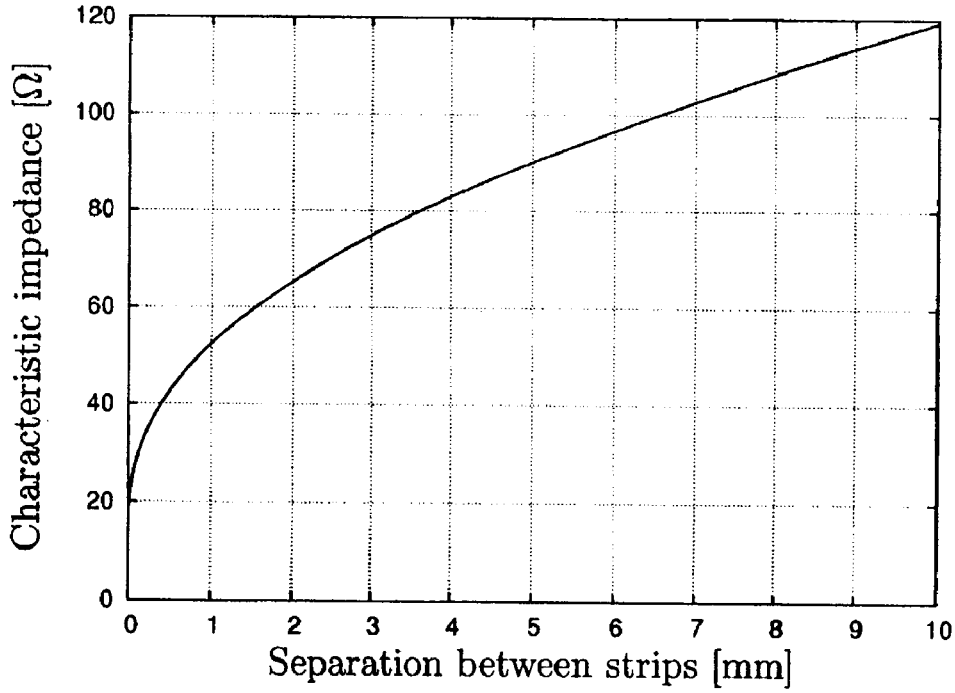
FIG. 2 is a graph showing the conductor-to-conductor distance dependence of the characteristic impedance in the coplanar strip.
Figure 3:
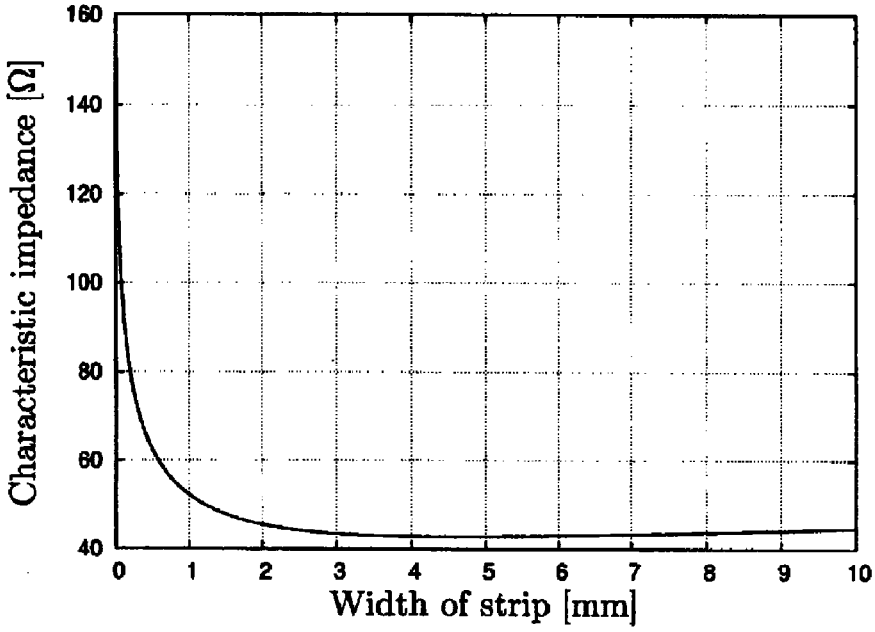
FIG. 3 is a graph showing the conductor width dependence of the characteristic impedance in the coplanar strip.

FIG. 2 shows the dependence of the characteristic impedance on the distance between conductors s, when the conductor width w=1 mm, the thickness h of the dielectric substrate 2 is 2 mm, and the relative permittivity $\in_r$ of the dielectric substrate 2 is 45. FIG. 3 shows the dependence of the characteristic impedance on the conductor width w, when the distance between conductors s=1 mm, h=2 mm, and $\in_r$=45.

In this invention, the conductor width w or distance between conductors s was calculated based on the local characteristic impedance obtained from equation (7), and a bandpass filter 1 was manufactured so as to satisfy the calculated conductor width w or distance between conductors s. By this means, reflection-type bandpass filters 1 having the desired pass band were obtained.

Below, the invention is explained in further detail referring to embodiments. Each of the embodiments described below is merely an illustration of the invention, and the invention is in no way limited to these embodiment descriptions.

Embodiment 1

A Kaiser window was used for which the reflectance is 1 at frequencies f in the range 3.4 GHz≦f≦10.3 GHz, and is 0 elsewhere, and for which A=30. Design was performed using one wavelength of signals at frequency f=1 GHz propagating in the coplanar strip as the waveguide length, and setting the system characteristic impedance to 50Ω. Here, the characteristic impedance must be set so as to match the impedance of the system being used. In general, in a circuit which handles high-frequency signals, a system impedance of 50Ω, 75Ω, 300Ω, or similar is used. It is desirable that the characteristic impedance Zc be in the range 10Ω≦Zc≦300Ω. If the characteristic impedance is smaller than 10Ω, then losses due to the conductor and dielectric become comparatively large. If the characteristic impedance is higher than 300Ω, matching with the system impedance is not possible.

Figure 4:
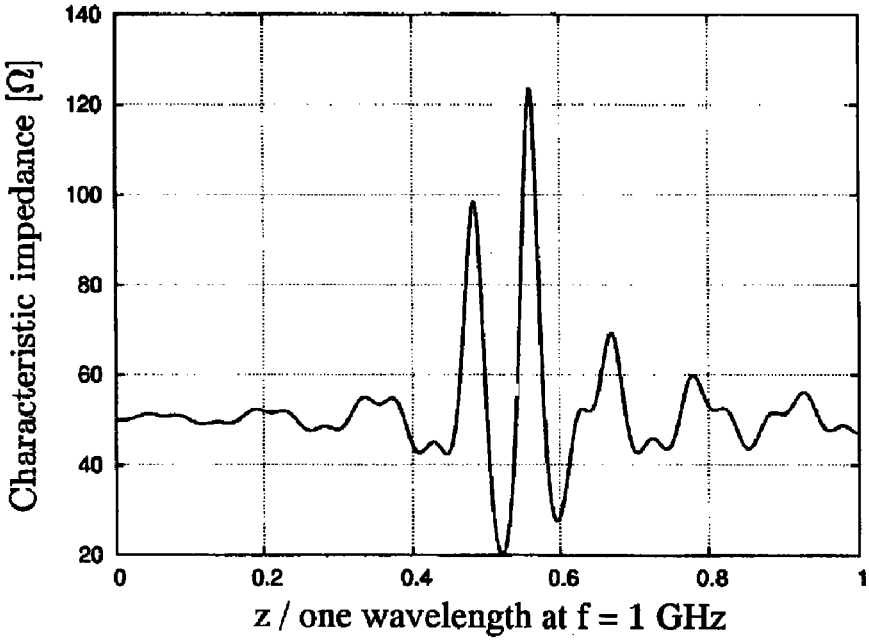
FIG. 4 is a graph showing the characteristic impedance distribution of the reflection-type bandpass filter fabricated in Embodiment 1.

FIG. 4 shows the distribution in the z-axis direction of the local characteristic impedance obtained in the inverse problem. The horizontal axis is z divided by one wavelength at f=1 GHz; similar axes are used in FIG. 9, FIG. 14, and FIG. 19 below.

Figure 5:
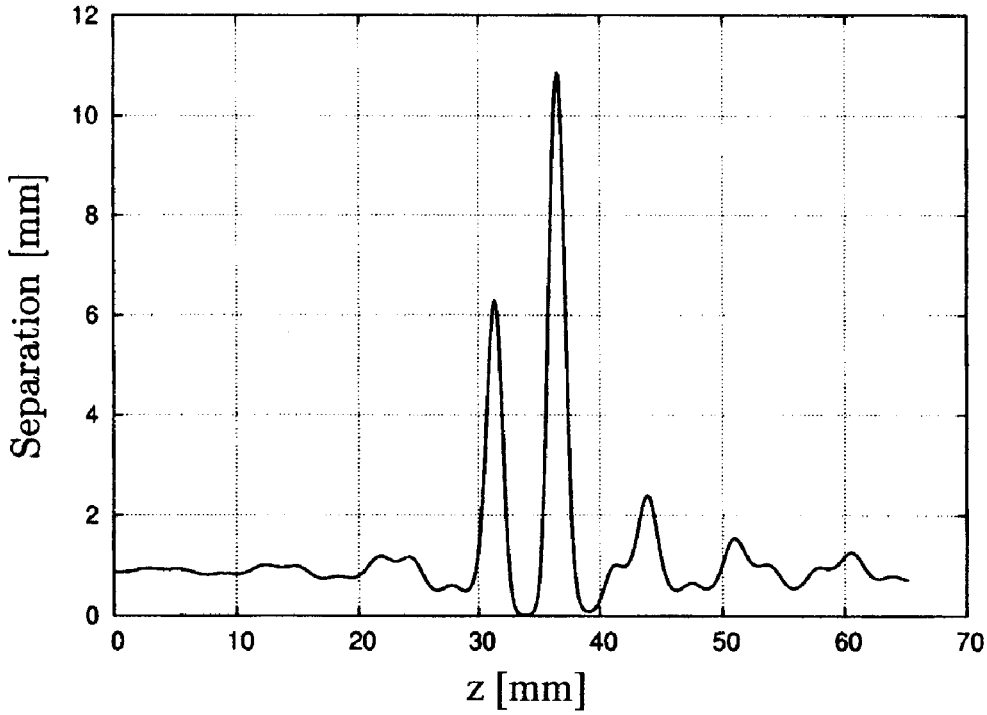
FIG. 5 is a graph showing the distribution of the distance between conductors of the symmetric-type two-conductor coplanar strip in the reflection-type bandpass filter fabricated in Embodiment 1.

FIG. 5 shows the distribution in the z-axis direction of the distance between conductors s, when using a dielectric substrate 2 with a thickness h=2 mm and relative permittivity $\in_r$=44, and when the conductor width w=1 mm. Tables 1 through 3 list the distances between conductors s.

TABLE 1

Distances between conductors (1/3)

| | | | | | | | | | | | | |
|---|---|---|---|---|---|---|---|---|---|---|---|---|
| z(mm) | 0.00 | 0.06 | 0.13 | 0.19 | 0.26 | 0.32 | 0.39 | 0.45 | 0.52 | 0.58 | 0.65 | 0.71 |
| s(mm) | 0.87 | 0.87 | 0.87 | 0.86 | 0.86 | 0.86 | 0.86 | 0.86 | 0.86 | 0.86 | 0.86 | 0.86 |
| #2 | 0.78 | 0.84 | 0.91 | 0.97 | 1.04 | 1.10 | 1.17 | 1.23 | 1.30 | 1.36 | 1.43 | 1.49 |
| — | 0.87 | 0.87 | 0.87 | 0.87 | 0.87 | 0.87 | 0.87 | 0.88 | 0.88 | 0.88 | 0.89 | 0.89 |
| #3 | 1.56 | 1.62 | 1.69 | 1.75 | 1.82 | 1.88 | 1.95 | 2.01 | 2.08 | 2.14 | 2.21 | 2.27 |
| — | 0.89 | 0.90 | 0.90 | 0.90 | 0.91 | 0.91 | 0.91 | 0.92 | 0.92 | 0.92 | 0.93 | 0.93 |
| #4 | 2.33 | 2.40 | 2.46 | 2.53 | 2.59 | 2.66 | 2.72 | 2.79 | 2.85 | 2.92 | 2.98 | 3.05 |
| — | 0.93 | 0.93 | 0.94 | 0.94 | 0.94 | 0.94 | 0.94 | 0.94 | 0.94 | 0.94 | 0.94 | 0.94 |
| #5 | 3.11 | 3.18 | 3.24 | 3.31 | 3.37 | 3.44 | 3.50 | 3.57 | 3.63 | 3.70 | 3.76 | 3.83 |
| — | 0.94 | 0.94 | 0.94 | 0.94 | 0.93 | 0.93 | 0.93 | 0.93 | 0.93 | 0.93 | 0.92 | 0.92 |
| #6 | 3.89 | 3.96 | 4.02 | 4.09 | 4.15 | 4.22 | 4.28 | 4.35 | 4.41 | 4.48 | 4.54 | 4.61 |
| — | 0.92 | 0.92 | 0.92 | 0.92 | 0.92 | 0.92 | 0.92 | 0.92 | 0.92 | 0.92 | 0.92 | 0.92 |
| #7 | 4.67 | 4.74 | 4.80 | 4.87 | 4.93 | 5.00 | 5.06 | 5.13 | 5.19 | 5.26 | 5.32 | 5.39 |
| — | 0.92 | 0.92 | 0.93 | 0.93 | 0.93 | 0.93 | 0.93 | 0.93 | 0.93 | 0.93 | 0.93 | 0.93 |
| #8 | 5.45 | 5.52 | 5.58 | 5.65 | 5.71 | 5.78 | 5.84 | 5.90 | 5.97 | 6.03 | 6.10 | 6.16 |
| — | 0.93 | 0.93 | 0.92 | 0.92 | 0.92 | 0.92 | 0.91 | 0.91 | 0.91 | 0.90 | 0.90 | 0.89 |

TABLE 1-continued

| Distances between conductors (1/3) | | | | | | | | | | | | |
|---|---|---|---|---|---|---|---|---|---|---|---|---|
| #9 | 6.23 | 6.29 | 6.36 | 6.42 | 6.49 | 6.55 | 6.62 | 6.68 | 6.75 | 6.81 | 6.88 | 6.94 |
| — | 0.89 | 0.88 | 0.88 | 0.87 | 0.87 | 0.86 | 0.86 | 0.85 | 0.85 | 0.84 | 0.84 | 0.83 |
| #10 | 7.01 | 7.07 | 7.14 | 7.20 | 7.27 | 7.33 | 7.40 | 7.46 | 7.53 | 7.59 | 7.65 | 7.72 |
| — | 0.83 | 0.83 | 0.82 | 0.82 | 0.82 | 0.82 | 0.82 | 0.81 | 0.81 | 0.81 | 0.81 | 0.81 |
| #11 | 7.78 | 7.85 | 7.91 | 7.98 | 8.04 | 8.11 | 8.17 | 8.24 | 8.30 | 8.37 | 8.43 | 8.50 |
| — | 0.82 | 0.82 | 0.82 | 0.82 | 0.82 | 0.82 | 0.83 | 0.83 | 0.83 | 0.83 | 0.83 | 0.83 |
| #12 | 8.56 | 8.63 | 8.69 | 8.76 | 8.82 | 8.89 | 8.95 | 9.02 | 9.08 | 9.14 | 9.21 | 9.27 |
| — | 0.84 | 0.84 | 0.84 | 0.84 | 0.84 | 0.84 | 0.84 | 0.84 | 0.84 | 0.84 | 0.84 | 0.84 |
| #13 | 9.34 | 9.40 | 9.47 | 9.53 | 9.60 | 9.66 | 9.73 | 9.79 | 9.86 | 9.92 | 9.99 | 10.05 |
| — | 0.84 | 0.84 | 0.83 | 0.83 | 0.83 | 0.83 | 0.83 | 0.83 | 0.83 | 0.83 | 0.83 | 0.83 |
| #14 | 10.12 | 10.18 | 10.25 | 10.31 | 10.38 | 10.44 | 10.51 | 10.57 | 10.64 | 10.70 | 10.76 | 10.83 |
| — | 0.83 | 0.83 | 0.83 | 0.83 | 0.84 | 0.84 | 0.84 | 0.85 | 0.85 | 0.86 | 0.87 | 0.87 |
| #15 | 10.89 | 10.96 | 11.02 | 11.09 | 11.15 | 11.22 | 11.28 | 11.35 | 11.41 | 11.48 | 11.54 | 11.61 |
| — | 0.88 | 0.89 | 0.89 | 0.90 | 0.91 | 0.92 | 0.93 | 0.93 | 0.94 | 0.95 | 0.96 | 0.97 |
| #16 | 11.67 | 11.74 | 11.80 | 11.87 | 11.93 | 12.00 | 12.06 | 12.13 | 12.19 | 12.26 | 12.32 | 12.39 |
| — | 0.97 | 0.98 | 0.98 | 0.99 | 0.99 | 1.00 | 1.00 | 1.00 | 1.00 | 1.01 | 1.01 | 1.01 |
| #17 | 12.45 | 12.52 | 12.58 | 12.65 | 12.71 | 12.78 | 12.84 | 12.91 | 12.97 | 13.04 | 13.10 | 13.17 |
| — | 1.00 | 1.00 | 1.00 | 1.00 | 1.00 | 0.99 | 0.99 | 0.99 | 0.98 | 0.98 | 0.98 | 0.97 |
| #18 | 13.23 | 13.30 | 13.36 | 13.43 | 13.49 | 13.56 | 13.62 | 13.69 | 13.75 | 13.82 | 13.88 | 13.95 |
| — | 0.97 | 0.97 | 0.97 | 0.96 | 0.96 | 0.96 | 0.96 | 0.96 | 0.96 | 0.96 | 0.97 | 0.97 |
| #19 | 14.01 | 14.08 | 14.14 | 14.21 | 14.27 | 14.34 | 14.40 | 14.47 | 14.53 | 14.60 | 14.66 | 14.73 |
| — | 0.97 | 0.97 | 0.97 | 0.98 | 0.98 | 0.98 | 0.98 | 0.98 | 0.99 | 0.99 | 0.99 | 0.99 |
| #20 | 14.79 | 14.86 | 14.92 | 14.99 | 15.05 | 15.12 | 15.18 | 15.25 | 15.31 | 15.38 | 15.44 | 15.51 |
| — | 0.99 | 0.99 | 0.98 | 0.98 | 0.98 | 0.97 | 0.96 | 0.96 | 0.95 | 0.94 | 0.93 | 0.92 |
| #21 | 15.57 | 15.64 | 15.70 | 15.77 | 15.83 | 15.90 | 15.96 | 16.03 | 16.09 | 16.16 | 16.22 | 16.28 |
| — | 0.91 | 0.90 | 0.89 | 0.88 | 0.87 | 0.86 | 0.85 | 0.83 | 0.82 | 0.81 | 0.80 | 0.79 |
| #22 | 16.35 | 16.41 | 16.48 | 16.54 | 16.61 | 16.67 | 16.74 | 16.80 | 16.87 | 16.93 | 17.00 | 17.06 |
| — | 0.78 | 0.78 | 0.77 | 0.76 | 0.76 | 0.75 | 0.75 | 0.74 | 0.74 | 0.74 | 0.74 | 0.74 |
| #23 | 17.13 | 17.19 | 17.26 | 17.32 | 17.38 | 17.45 | 17.51 | 17.58 | 17.64 | 17.71 | 17.77 | 17.84 |
| — | 0.74 | 0.74 | 0.74 | 0.74 | 0.74 | 0.75 | 0.75 | 0.75 | 0.76 | 0.76 | 0.77 | 0.77 |
| #24 | 17.90 | 17.97 | 18.03 | 18.10 | 18.16 | 18.23 | 18.29 | 18.36 | 18.42 | 18.48 | 18.55 | 18.61 |
| — | 0.77 | 0.78 | 0.78 | 0.78 | 0.78 | 0.78 | 0.79 | 0.79 | 0.78 | 0.78 | 0.78 | 0.78 |
| #25 | 18.68 | 18.74 | 18.81 | 18.87 | 18.94 | 19.00 | 19.07 | 19.13 | 19.20 | 19.26 | 19.33 | 19.39 |
| — | 0.78 | 0.78 | 0.77 | 0.77 | 0.77 | 0.76 | 0.76 | 0.76 | 0.75 | 0.75 | 0.75 | 0.75 |
| #26 | 19.46 | 19.52 | 19.58 | 19.65 | 19.71 | 19.78 | 19.84 | 19.91 | 19.97 | 20.04 | 20.10 | 20.17 |
| — | 0.75 | 0.75 | 0.75 | 0.76 | 0.76 | 0.77 | 0.77 | 0.78 | 0.79 | 0.80 | 0.81 | 0.82 |
| #27 | 20.23 | 20.30 | 20.36 | 20.43 | 20.49 | 20.56 | 20.62 | 20.69 | 20.75 | 20.82 | 20.88 | 20.95 |
| — | 0.84 | 0.85 | 0.87 | 0.88 | 0.90 | 0.92 | 0.94 | 0.96 | 0.98 | 1.00 | 1.02 | 1.04 |
| #28 | 21.01 | 21.08 | 21.14 | 21.21 | 21.27 | 21.34 | 21.40 | 21.47 | 21.53 | 21.60 | 21.66 | 21.73 |
| — | 1.06 | 1.08 | 1.09 | 1.11 | 1.12 | 1.14 | 1.15 | 1.16 | 1.17 | 1.17 | 1.18 | 1.18 |
| #29 | 21.79 | 21.86 | 21.92 | 21.99 | 22.05 | 22.12 | 22.18 | 22.25 | 22.32 | 22.38 | 22.45 | 22.51 |
| — | 1.18 | 1.18 | 1.18 | 1.17 | 1.17 | 1.16 | 1.15 | 1.15 | 1.14 | 1.13 | 1.12 | 1.11 |
| #30 | 22.58 | 22.64 | 22.71 | 22.77 | 22.84 | 22.90 | 22.97 | 23.03 | 23.10 | 23.16 | 23.23 | 23.29 |
| — | 1.11 | 1.10 | 1.09 | 1.09 | 1.08 | 1.08 | 1.08 | 1.08 | 1.08 | 1.08 | 1.08 | 1.09 |

TABLE 2

| Distances between conductors (2/3) | | | | | | | | | | | | |
|---|---|---|---|---|---|---|---|---|---|---|---|---|
| #31 | 23.36 | 23.42 | 23.49 | 23.55 | 23.62 | 23.68 | 23.75 | 23.81 | 23.88 | 23.94 | 24.01 | 24.07 |
| — | 1.09 | 1.10 | 1.10 | 1.11 | 1.12 | 1.13 | 1.13 | 1.14 | 1.15 | 1.15 | 1.16 | 1.16 |
| #32 | 24.14 | 24.20 | 24.27 | 24.33 | 24.40 | 24.47 | 24.53 | 24.60 | 24.66 | 24.73 | 24.79 | 24.86 |
| — | 1.16 | 1.16 | 1.16 | 1.16 | 1.15 | 1.14 | 1.13 | 1.11 | 1.09 | 1.07 | 1.05 | 1.02 |
| #33 | 24.92 | 24.99 | 25.05 | 25.12 | 25.18 | 25.25 | 25.31 | 25.37 | 25.44 | 25.50 | 25.57 | 25.63 |
| — | 1.00 | 0.97 | 0.94 | 0.91 | 0.88 | 0.85 | 0.82 | 0.79 | 0.76 | 0.73 | 0.70 | 0.68 |
| #34 | 25.70 | 25.76 | 25.83 | 25.89 | 25.96 | 26.02 | 26.08 | 26.15 | 26.21 | 26.28 | 26.34 | 26.41 |
| — | 0.65 | 0.63 | 0.61 | 0.59 | 0.57 | 0.56 | 0.54 | 0.53 | 0.52 | 0.52 | 0.51 | 0.51 |
| #35 | 26.47 | 26.54 | 26.60 | 26.66 | 26.73 | 26.79 | 26.86 | 26.92 | 26.99 | 27.05 | 27.12 | 27.18 |
| — | 0.51 | 0.50 | 0.51 | 0.51 | 0.51 | 0.52 | 0.52 | 0.53 | 0.54 | 0.55 | 0.55 | 0.56 |
| #36 | 27.24 | 27.31 | 27.37 | 27.44 | 27.50 | 27.57 | 27.63 | 27.70 | 27.76 | 27.82 | 27.89 | 27.95 |
| — | 0.57 | 0.58 | 0.59 | 0.59 | 0.60 | 0.60 | 0.61 | 0.61 | 0.61 | 0.61 | 0.60 | 0.60 |
| #37 | 28.02 | 28.08 | 28.15 | 28.21 | 28.28 | 28.34 | 28.41 | 28.47 | 28.53 | 28.60 | 28.66 | 28.73 |
| — | 0.59 | 0.59 | 0.58 | 0.57 | 0.56 | 0.55 | 0.54 | 0.53 | 0.52 | 0.51 | 0.50 | 0.50 |
| #38 | 28.79 | 28.86 | 28.92 | 28.98 | 29.05 | 29.11 | 29.18 | 29.24 | 29.31 | 29.37 | 29.44 | 29.50 |
| — | 0.50 | 0.49 | 0.49 | 0.50 | 0.50 | 0.51 | 0.53 | 0.54 | 0.57 | 0.59 | 0.63 | 0.67 |
| #39 | 29.56 | 29.63 | 29.69 | 29.76 | 29.82 | 29.89 | 29.95 | 30.02 | 30.09 | 30.15 | 30.22 | 30.29 |
| — | 0.72 | 0.78 | 0.84 | 0.92 | 1.02 | 1.12 | 1.25 | 1.39 | 1.56 | 1.74 | 1.95 | 2.19 |
| #40 | 30.35 | 30.42 | 30.49 | 30.56 | 30.62 | 30.69 | 30.76 | 30.84 | 30.91 | 30.98 | 31.05 | 31.12 |
| — | 2.44 | 2.73 | 3.04 | 3.36 | 3.70 | 4.06 | 4.41 | 4.76 | 5.10 | 5.42 | 5.70 | 5.93 |
| #41 | 31.20 | 31.27 | 31.34 | 31.41 | 31.49 | 31.56 | 31.63 | 31.70 | 31.78 | 31.85 | 31.92 | 31.99 |
| — | 6.11 | 6.23 | 6.29 | 6.27 | 6.18 | 6.01 | 5.78 | 5.49 | 5.14 | 4.76 | 4.34 | 3.91 |
| #42 | 32.05 | 32.12 | 32.19 | 32.26 | 32.32 | 32.39 | 32.45 | 32.52 | 32.58 | 32.65 | 32.71 | 32.78 |
| — | 3.48 | 3.05 | 2.64 | 2.26 | 1.91 | 1.59 | 1.32 | 1.08 | 0.88 | 0.71 | 0.56 | 0.45 |

TABLE 2-continued

| Distances between conductors (2/3) | | | | | | | | | | | | |
|---|---|---|---|---|---|---|---|---|---|---|---|---|
| #43 | 32.84 | 32.91 | 32.97 | 33.03 | 33.10 | 33.16 | 33.23 | 33.29 | 33.35 | 33.42 | 33.48 | 33.54 |
| — | 0.35 | 0.28 | 0.21 | 0.17 | 0.13 | 0.10 | 0.08 | 0.06 | 0.05 | 0.04 | 0.03 | 0.03 |
| #44 | 33.61 | 33.67 | 33.74 | 33.80 | 33.86 | 33.93 | 33.99 | 34.06 | 34.12 | 34.18 | 34.25 | 34.31 |
| — | 0.02 | 0.02 | 0.02 | 0.02 | 0.02 | 0.02 | 0.02 | 0.02 | 0.02 | 0.02 | 0.03 | 0.04 |
| #45 | 34.37 | 34.44 | 34.50 | 34.57 | 34.63 | 34.69 | 34.76 | 34.82 | 34.89 | 34.95 | 35.02 | 35.08 |
| — | 0.05 | 0.06 | 0.07 | 0.10 | 0.13 | 0.17 | 0.22 | 0.29 | 0.38 | 0.49 | 0.63 | 0.80 |
| #46 | 35.15 | 35.21 | 35.28 | 35.34 | 35.41 | 35.48 | 35.55 | 35.62 | 35.69 | 35.76 | 35.83 | 35.91 |
| — | 1.02 | 1.30 | 1.62 | 2.02 | 2.48 | 3.01 | 3.62 | 4.28 | 5.00 | 5.76 | 6.54 | 7.32 |
| #47 | 35.98 | 36.06 | 36.14 | 36.22 | 36.30 | 36.38 | 36.46 | 36.54 | 36.62 | 36.70 | 36.78 | 36.85 |
| — | 8.08 | 8.79 | 9.43 | 9.98 | 10.41 | 10.70 | 10.86 | 10.86 | 10.70 | 10.41 | 9.99 | 9.46 |
| #48 | 36.93 | 37.01 | 37.08 | 37.15 | 37.23 | 37.30 | 37.37 | 37.44 | 37.51 | 37.57 | 37.64 | 37.71 |
| — | 8.83 | 8.15 | 7.42 | 6.67 | 5.92 | 5.19 | 4.50 | 3.86 | 3.28 | 2.76 | 2.30 | 1.91 |
| #49 | 37.77 | 37.84 | 37.90 | 37.97 | 38.03 | 38.10 | 38.16 | 38.23 | 38.29 | 38.35 | 38.42 | 38.48 |
| — | 1.57 | 1.29 | 1.06 | 0.86 | 0.71 | 0.58 | 0.47 | 0.39 | 0.32 | 0.27 | 0.22 | 0.19 |
| #50 | 38.55 | 38.61 | 38.67 | 38.74 | 38.80 | 38.87 | 38.93 | 38.99 | 39.06 | 39.12 | 39.19 | 39.25 |
| — | 0.16 | 0.14 | 0.12 | 0.11 | 0.10 | 0.09 | 0.09 | 0.09 | 0.09 | 0.09 | 0.09 | 0.09 |
| #51 | 39.31 | 39.38 | 39.44 | 39.51 | 39.57 | 39.63 | 39.70 | 39.76 | 39.83 | 39.89 | 39.95 | 40.02 |
| — | 0.10 | 0.11 | 0.12 | 0.13 | 0.14 | 0.16 | 0.18 | 0.20 | 0.23 | 0.26 | 0.29 | 0.33 |
| #52 | 40.08 | 40.15 | 40.21 | 40.27 | 40.34 | 40.40 | 40.47 | 40.53 | 40.60 | 40.66 | 40.73 | 40.79 |
| — | 0.37 | 0.41 | 0.46 | 0.51 | 0.56 | 0.61 | 0.66 | 0.71 | 0.76 | 0.80 | 0.85 | 0.88 |
| #53 | 40.86 | 40.92 | 40.99 | 41.05 | 41.12 | 41.18 | 41.25 | 41.31 | 41.38 | 41.44 | 41.51 | 41.57 |
| — | 0.92 | 0.95 | 0.97 | 0.99 | 1.00 | 1.01 | 1.01 | 1.01 | 1.01 | 1.01 | 1.00 | 1.00 |
| #54 | 41.64 | 41.70 | 41.77 | 41.83 | 41.90 | 41.96 | 42.03 | 42.09 | 42.16 | 42.22 | 42.29 | 42.35 |
| — | 0.99 | 0.98 | 0.98 | 0.98 | 0.98 | 0.98 | 0.98 | 0.99 | 1.00 | 1.02 | 1.04 | 1.07 |
| #55 | 42.42 | 42.48 | 42.55 | 42.61 | 42.68 | 42.74 | 42.81 | 42.87 | 42.94 | 43.01 | 43.07 | 43.14 |
| — | 1.10 | 1.14 | 1.18 | 1.23 | 1.28 | 1.34 | 1.40 | 1.47 | 1.54 | 1.62 | 1.70 | 1.78 |
| #56 | 43.20 | 43.27 | 43.34 | 43.40 | 43.47 | 43.54 | 43.60 | 43.67 | 43.74 | 43.80 | 43.87 | 43.94 |
| — | 1.86 | 1.95 | 2.03 | 2.10 | 2.17 | 2.24 | 2.29 | 2.34 | 2.37 | 2.39 | 2.40 | 2.39 |
| #57 | 44.01 | 44.07 | 44.14 | 44.27 | 44.27 | 44.34 | 44.41 | 44.47 | 44.54 | 44.60 | 44.67 | 44.74 |
| — | 2.37 | 2.33 | 2.28 | 2.22 | 2.15 | 2.07 | 1.98 | 1.89 | 1.79 | 1.69 | 1.59 | 1.49 |
| #58 | 44.80 | 44.87 | 44.93 | 45.00 | 45.06 | 45.13 | 45.19 | 45.26 | 45.32 | 45.39 | 45.45 | 45.51 |
| — | 1.40 | 1.30 | 1.22 | 1.13 | 1.05 | 0.98 | 0.92 | 0.86 | 0.80 | 0.75 | 0.71 | 0.67 |
| #59 | 45.58 | 45.64 | 45.71 | 45.77 | 45.84 | 45.90 | 45.97 | 46.03 | 46.09 | 46.16 | 46.22 | 46.29 |
| — | 0.64 | 0.61 | 0.59 | 0.56 | 0.55 | 0.53 | 0.52 | 0.52 | 0.51 | 0.51 | 0.51 | 0.51 |
| #60 | 46.35 | 46.42 | 46.48 | 46.55 | 46.61 | 46.67 | 46.74 | 46.80 | 46.87 | 46.93 | 47.00 | 47.06 |
| — | 0.51 | 0.52 | 0.53 | 0.53 | 0.54 | 0.55 | 0.56 | 0.58 | 0.59 | 0.60 | 0.61 | 0.62 |

TABLE 3

| Distances between conductors (3/3) | | | | | | | | | | | | |
|---|---|---|---|---|---|---|---|---|---|---|---|---|
| #61 | 47.13 | 47.19 | 47.26 | 47.32 | 47.38 | 47.45 | 47.51 | 47.58 | 47.64 | 47.71 | 47.77 | 47.84 |
| — | 0.63 | 0.64 | 0.64 | 0.65 | 0.65 | 0.65 | 0.65 | 0.65 | 0.65 | 0.64 | 0.64 | 0.63 |
| #62 | 47.90 | 47.97 | 48.03 | 48.09 | 48.16 | 48.22 | 48.29 | 48.35 | 48.42 | 48.48 | 48.55 | 48.61 |
| — | 0.62 | 0.61 | 0.60 | 0.60 | 0.59 | 0.58 | 0.57 | 0.56 | 0.55 | 0.55 | 0.55 | 0.54 |
| #63 | 48.67 | 48.74 | 48.80 | 48.87 | 48.93 | 49.00 | 49.06 | 49.13 | 49.19 | 49.25 | 49.32 | 49.38 |
| — | 0.54 | 0.54 | 0.55 | 0.55 | 0.56 | 0.57 | 0.58 | 0.59 | 0.61 | 0.63 | 0.65 | 0.68 |
| #64 | 49.45 | 49.51 | 49.58 | 49.64 | 49.71 | 49.77 | 49.84 | 49.90 | 49.97 | 50.03 | 50.10 | 50.16 |
| — | 0.71 | 0.74 | 0.77 | 0.81 | 0.85 | 0.89 | 0.93 | 0.98 | 1.03 | 1.08 | 1.13 | 1.18 |
| #65 | 50.23 | 50.29 | 50.36 | 50.42 | 50.49 | 50.56 | 50.62 | 50.69 | 50.75 | 50.82 | 50.88 | 50.95 |
| — | 1.22 | 1.27 | 1.32 | 1.36 | 1.40 | 1.44 | 1.47 | 1.49 | 1.52 | 1.53 | 1.54 | 1.54 |
| #66 | 51.02 | 51.08 | 51.15 | 51.21 | 51.28 | 51.34 | 51.41 | 51.47 | 51.54 | 51.61 | 51.67 | 51.74 |
| — | 1.54 | 1.54 | 1.52 | 1.51 | 1.49 | 1.46 | 1.44 | 1.41 | 1.38 | 1.35 | 1.32 | 1.28 |
| #67 | 51.80 | 51.87 | 51.93 | 52.00 | 52.06 | 52.13 | 52.19 | 52.26 | 52.32 | 52.39 | 52.45 | 52.52 |
| — | 1.25 | 1.22 | 1.19 | 1.16 | 1.14 | 1.11 | 1.09 | 1.07 | 1.06 | 1.04 | 1.03 | 1.02 |
| #68 | 52.58 | 52.65 | 52.71 | 52.78 | 52.84 | 52.91 | 52.97 | 53.04 | 53.10 | 53.17 | 53.23 | 53.30 |
| — | 1.01 | 1.00 | 1.00 | 0.99 | 0.99 | 0.99 | 1.00 | 1.00 | 1.00 | 1.01 | 1.01 | 1.01 |
| #69 | 53.36 | 53.43 | 53.49 | 53.56 | 53.62 | 53.69 | 53.75 | 53.82 | 53.88 | 53.95 | 54.01 | 54.08 |
| — | 1.02 | 1.02 | 1.02 | 1.02 | 1.02 | 1.02 | 1.02 | 1.01 | 1.00 | 0.99 | 0.98 | 0.96 |
| #70 | 54.14 | 54.21 | 54.27 | 54.34 | 54.40 | 54.47 | 54.53 | 54.60 | 54.66 | 54.73 | 54.79 | 54.86 |
| — | 0.95 | 0.93 | 0.91 | 0.89 | 0.87 | 0.85 | 0.82 | 0.80 | 0.78 | 0.75 | 0.73 | 0.71 |
| #71 | 54.92 | 54.99 | 55.05 | 55.11 | 55.18 | 55.24 | 55.31 | 55.37 | 55.44 | 55.50 | 55.57 | 55.63 |
| — | 0.69 | 0.67 | 0.65 | 0.63 | 0.61 | 0.60 | 0.59 | 0.57 | 0.56 | 0.56 | 0.55 | 0.55 |
| #72 | 55.69 | 55.76 | 55.82 | 55.89 | 55.95 | 56.02 | 56.08 | 56.15 | 56.21 | 56.27 | 56.34 | 56.40 |
| — | 0.54 | 0.54 | 0.55 | 0.55 | 0.55 | 0.56 | 0.57 | 0.58 | 0.59 | 0.60 | 0.62 | 0.63 |
| #73 | 56.47 | 56.53 | 56.60 | 56.66 | 56.73 | 56.79 | 56.86 | 56.92 | 56.99 | 57.05 | 57.12 | 57.18 |
| — | 0.65 | 0.67 | 0.69 | 0.71 | 0.73 | 0.75 | 0.77 | 0.79 | 0.81 | 0.83 | 0.85 | 0.87 |
| #74 | 57.24 | 57.31 | 57.37 | 57.44 | 57.50 | 57.57 | 57.63 | 57.70 | 57.76 | 57.83 | 57.89 | 57.96 |
| — | 0.88 | 0.90 | 0.91 | 0.92 | 0.93 | 0.94 | 0.95 | 0.96 | 0.96 | 0.96 | 0.96 | 0.96 |
| #75 | 58.02 | 58.09 | 58.15 | 58.22 | 58.28 | 58.35 | 58.41 | 58.48 | 58.54 | 58.61 | 58.67 | 58.74 |
| — | 0.96 | 0.96 | 0.96 | 0.95 | 0.95 | 0.95 | 0.94 | 0.94 | 0.94 | 0.94 | 0.94 | 0.94 |
| #76 | 58.80 | 58.87 | 58.93 | 59.00 | 59.06 | 59.13 | 59.19 | 59.26 | 59.32 | 59.39 | 59.45 | 59.52 |
| — | 0.94 | 0.94 | 0.95 | 0.95 | 0.96 | 0.97 | 0.98 | 0.99 | 1.01 | 1.02 | 1.04 | 1.05 |

TABLE 3-continued

| Distances between conductors (3/3) | | | | | | | | | | | | |
|---|---|---|---|---|---|---|---|---|---|---|---|---|
| #77 | 59.58 | 59.65 | 59.71 | 59.78 | 59.84 | 59.91 | 59.97 | 60.04 | 60.10 | 60.17 | 60.24 | 60.30 |
| — | 1.07 | 1.09 | 1.11 | 1.12 | 1.14 | 1.16 | 1.18 | 1.19 | 1.21 | 1.22 | 1.24 | 1.25 |
| #78 | 60.37 | 60.43 | 60.50 | 60.56 | 60.63 | 60.69 | 60.76 | 60.82 | 60.89 | 60.95 | 61.02 | 61.08 |
| — | 1.25 | 1.26 | 1.26 | 1.26 | 1.26 | 1.25 | 1.24 | 1.23 | 1.22 | 1.20 | 1.18 | 1.16 |
| #79 | 61.15 | 61.21 | 61.28 | 61.34 | 61.41 | 61.48 | 61.54 | 61.61 | 61.67 | 61.73 | 61.80 | 61.86 |
| — | 1.14 | 1.11 | 1.09 | 1.06 | 1.04 | 1.01 | 0.99 | 0.96 | 0.94 | 0.92 | 0.89 | 0.87 |
| #80 | 61.93 | 61.99 | 62.06 | 62.12 | 62.19 | 62.25 | 62.32 | 62.38 | 62.45 | 62.51 | 62.58 | 62.64 |
| — | 0.85 | 0.84 | 0.82 | 0.80 | 0.79 | 0.78 | 0.77 | 0.76 | 0.75 | 0.75 | 0.74 | 0.74 |
| #81 | 62.71 | 62.77 | 62.84 | 62.90 | 62.96 | 63.03 | 63.09 | 63.16 | 63.22 | 63.29 | 63.35 | 63.42 |
| — | 0.74 | 0.74 | 0.74 | 0.74 | 0.74 | 0.74 | 0.75 | 0.75 | 0.76 | 0.76 | 0.77 | 0.77 |
| #82 | 63.48 | 63.55 | 63.61 | 63.68 | 63.74 | 63.81 | 63.87 | 63.94 | 64.00 | 64.06 | 64.13 | 64.19 |
| — | 0.78 | 0.78 | 0.79 | 0.79 | 0.79 | 0.79 | 0.79 | 0.79 | 0.79 | 0.79 | 0.79 | 0.79 |
| #83 | 64.26 | 64.32 | 64.39 | 64.45 | 64.52 | 64.58 | 64.65 | 64.71 | 64.78 | 64.84 | 64.91 | 64.97 |
| — | 0.78 | 0.78 | 0.77 | 0.77 | 0.76 | 0.75 | 0.75 | 0.74 | 0.74 | 0.73 | 0.72 | 0.72 |
| #84 | 65.04 | 65.10 | 65.16 | 65.23 | 65.29 | | | | | | | |
| — | 0.72 | 0.71 | 0.71 | 0.71 | 0.71 | | | | | | | |

Figure 6:
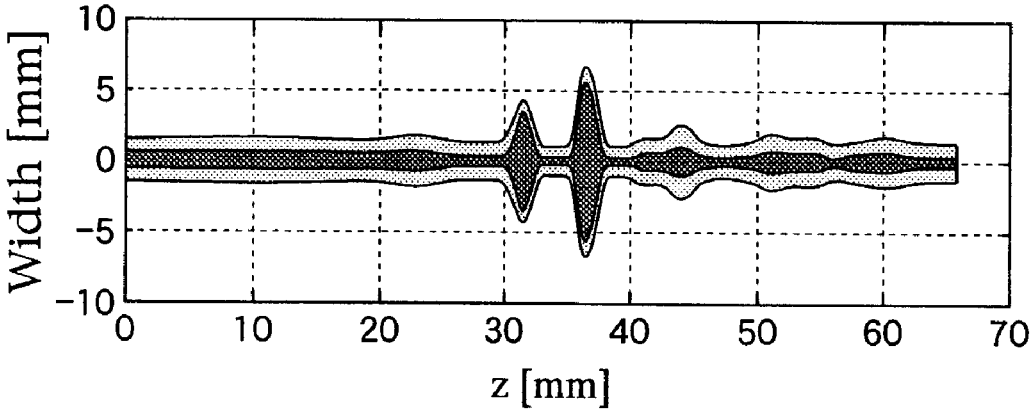
FIG. 6 is a graph showing the shape of the symmetric-type two-conductor coplanar strip in the reflection-type bandpass filter fabricated in Embodiment 1.

FIG. 6 shows the shape of the conductors in the reflection-type bandpass filter 1 of Embodiment 1. In the figure, the lightly shaded portion represents the conductors 3 and 4, and the heavily shaded portion represents the non-conducting portion 5. A non-reflecting terminator, or an R=50Ω resistance, is provided on the terminating side (the face at z=65.29 mm) of this reflection-type bandpass filter 1. The non-reflecting terminator or resistance may be connected directly to the terminating end of the reflection-type bandpass filter 1. The thicknesses of the metal films of the conductors 3 and 4 are to be thick compared with the skin depth at f=1 GHz, $\delta s=\sqrt{\{2/(\omega\mu_0\sigma)\}}$ Here ω, $\mu_0$, and σ are respectively the angular frequency, magnetic permeability in vacuum, and the conductivity of the metal. For example, when using copper, the thickness of the conductors 3 and 4 should be 2.1 μm or greater. This bandpass filter 1 is used in a system with a characteristic impedance of 50Ω.

Figure 7:
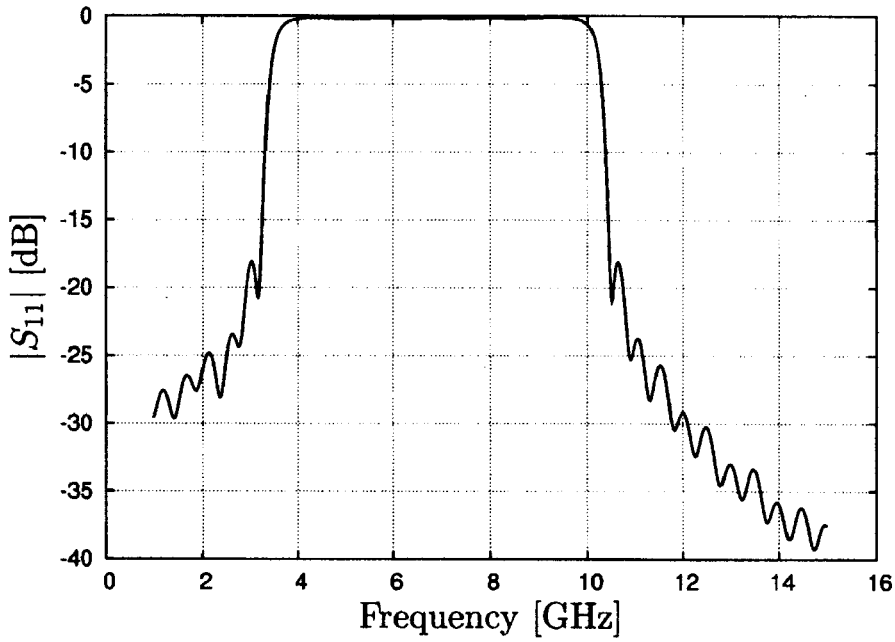
FIG. 7 is a graph showing the reflected wave amplitude characteristic in the reflection-type bandpass filter fabricated in Embodiment 1.
Figure 8:
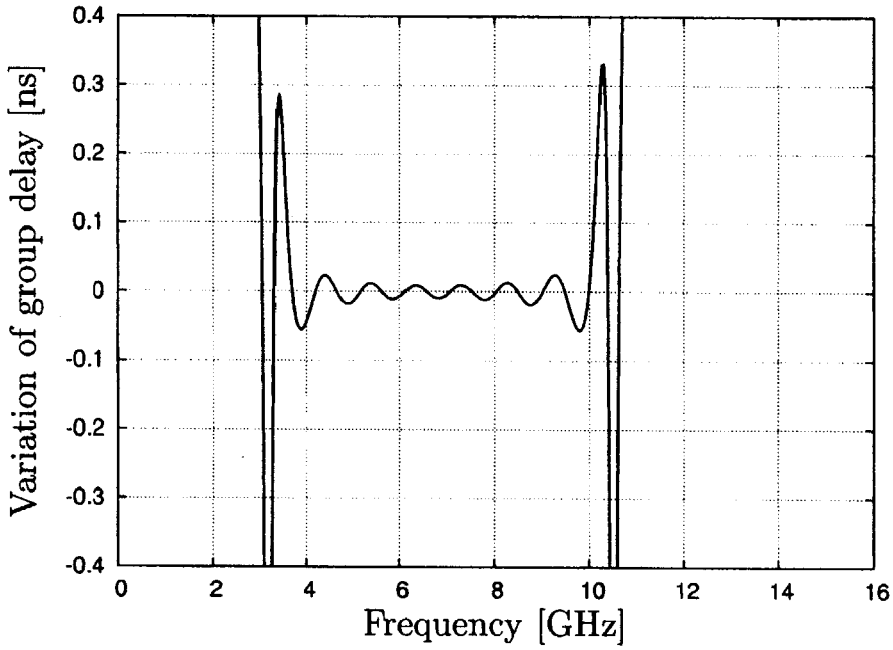
FIG. 8 is a graph showing the reflected wave group delay characteristic in the reflection-type bandpass filter fabricated in Embodiment 1.

FIG. 7 and FIG. 8 show the amplitude characteristic and group delay characteristic respectively of reflected waves ($S_{11}$) in the bandpass filter 1 of Embodiment 1. As shown in the figures, in the range of frequencies f for which 3.7 GHz≦f≦10.0 GHz, the reflectance is −1 dB or greater, and the group delay variation is within ±0.05 ns. In the region f<3.1 GHz or f>10.6 GHz, the reflectance is −17 dB or lower.

Embodiment 2

Figure 9:
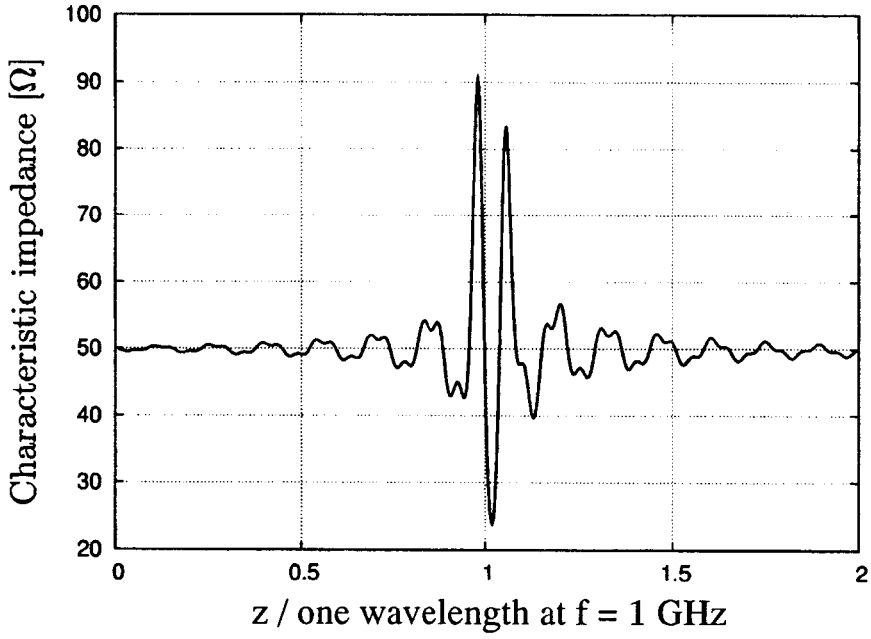
FIG. 9 is a graph showing the characteristic impedance distribution of the reflection-type bandpass filter fabricated in Embodiment 2.

A Kaiser window was used for which the reflectance is 0.9 at frequencies f in the range 3.4 GHz≦f≦10.3 GHz, and is 0 elsewhere, and for which A=30. Design was performed using two wavelengths of signals at frequency f=1 GHz propagating in the coplanar strip as the waveguide length, and setting the system characteristic impedance to 50Ω. FIG. 9 shows the distribution in the z-axis direction of the local characteristic impedance obtained in the inverse problem.

Figure 10:
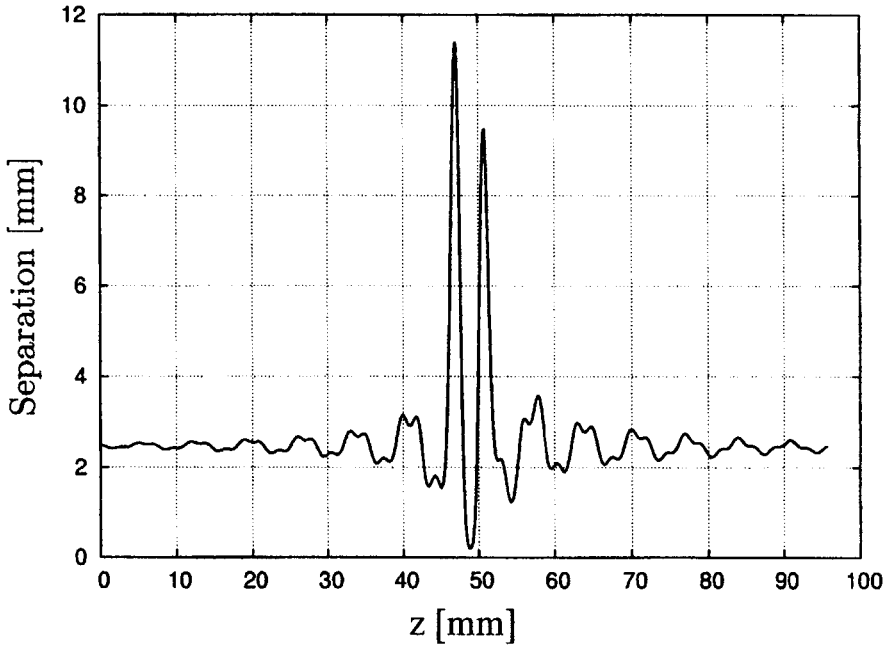
FIG. 10 is a graph showing the distribution of the distance between conductors of the symmetric-type two-conductor coplanar strip in the reflection-type bandpass filter fabricated in Embodiment 2.

FIG. 10 shows the distribution in the z-axis direction of the distance between conductors s, when using a dielectric substrate 2 with a thickness h=2 mm and relative permittivity $\in_r$=90, and when the conductive width w=1 mm. Tables 4 through 6 list the distances between conductors s.

TABLE 4

| Distances between conductors (1/3) | | | | | | | | | | | | |
|---|---|---|---|---|---|---|---|---|---|---|---|---|
| z(mm) | 0.00 | 0.10 | 0.19 | 0.29 | 0.38 | 0.48 | 0.57 | 0.67 | 0.76 | 0.86 | 0.96 | 1.05 |
| s(mm) | 2.49 | 2.49 | 2.49 | 2.49 | 2.48 | 2.48 | 2.47 | 2.46 | 2.46 | 2.45 | 2.44 | 2.44 |
| #2 | 1.15 | 1.24 | 1.34 | 1.43 | 1.53 | 1.62 | 1.72 | 1.81 | 1.91 | 2.00 | 2.10 | 2.20 |
| — | 2.43 | 2.43 | 2.43 | 2.42 | 2.42 | 2.42 | 2.42 | 2.42 | 2.43 | 2.43 | 2.43 | 2.44 |
| #3 | 2.29 | 2.39 | 2.48 | 2.58 | 2.67 | 2.77 | 2.86 | 2.96 | 3.06 | 3.15 | 3.25 | 3.34 |
| — | 2.44 | 2.44 | 2.45 | 2.45 | 2.45 | 2.45 | 2.45 | 2.45 | 2.45 | 2.45 | 2.45 | 2.45 |
| #4 | 3.44 | 3.53 | 3.63 | 3.72 | 3.82 | 3.91 | 4.01 | 4.11 | 4.20 | 4.30 | 4.39 | 4.49 |
| — | 2.45 | 2.45 | 2.45 | 2.45 | 2.46 | 2.46 | 2.47 | 2.48 | 2.49 | 2.50 | 2.50 | 2.51 |
| #5 | 4.58 | 4.68 | 4.77 | 4.87 | 4.97 | 5.06 | 5.16 | 5.25 | 5.35 | 5.44 | 5.54 | 5.64 |
| — | 2.52 | 2.53 | 2.53 | 2.54 | 2.54 | 2.54 | 2.54 | 2.54 | 2.53 | 2.53 | 2.53 | 2.52 |
| #6 | 5.73 | 5.83 | 5.92 | 6.02 | 6.11 | 6.21 | 6.30 | 6.40 | 6.50 | 6.59 | 6.69 | 6.78 |
| — | 2.52 | 2.51 | 2.51 | 2.51 | 2.51 | 2.51 | 2.51 | 2.51 | 2.51 | 2.51 | 2.51 | 2.51 |
| #7 | 6.88 | 6.97 | 7.07 | 7.17 | 7.26 | 7.36 | 7.45 | 7.55 | 7.64 | 7.74 | 7.83 | 7.93 |
| — | 2.51 | 2.51 | 2.51 | 2.50 | 2.50 | 2.49 | 2.48 | 2.47 | 2.46 | 2.45 | 2.44 | 2.43 |
| #8 | 8.02 | 8.12 | 8.22 | 8.31 | 8.41 | 8.50 | 8.60 | 8.69 | 8.79 | 8.88 | 8.98 | 9.07 |
| — | 2.42 | 2.41 | 2.41 | 2.40 | 2.40 | 2.40 | 2.40 | 2.40 | 2.40 | 2.40 | 2.41 | 2.41 |
| #9 | 9.17 | 9.26 | 9.36 | 9.46 | 9.55 | 9.65 | 9.74 | 9.84 | 9.93 | 10.03 | 10.12 | 10.22 |
| — | 2.42 | 2.42 | 2.43 | 2.43 | 2.43 | 2.43 | 2.43 | 2.43 | 2.43 | 2.43 | 2.43 | 2.43 |
| #10 | 10.31 | 10.41 | 10.51 | 10.60 | 10.70 | 10.79 | 10.89 | 10.98 | 11.08 | 11.17 | 11.27 | 11.37 |
| — | 2.43 | 2.43 | 2.43 | 2.43 | 2.44 | 2.45 | 2.46 | 2.47 | 2.48 | 2.49 | 2.51 | 2.52 |
| #11 | 11.46 | 11.56 | 11.65 | 11.75 | 11.84 | 11.94 | 12.04 | 12.13 | 12.23 | 12.32 | 12.42 | 12.51 |
| — | 2.53 | 2.54 | 2.55 | 2.56 | 2.57 | 2.57 | 2.57 | 2.57 | 2.57 | 2.56 | 2.56 | 2.55 |
| #12 | 12.61 | 12.70 | 12.80 | 12.90 | 12.99 | 13.09 | 13.18 | 13.28 | 13.37 | 13.47 | 13.57 | 13.66 |
| — | 2.54 | 2.54 | 2.53 | 2.53 | 2.53 | 2.52 | 2.52 | 2.52 | 2.53 | 2.53 | 2.53 | 2.53 |
| #13 | 13.76 | 13.85 | 13.95 | 14.04 | 14.14 | 14.24 | 14.33 | 14.43 | 14.52 | 14.62 | 14.71 | 14.81 |
| — | 2.53 | 2.53 | 2.53 | 2.53 | 2.52 | 2.51 | 2.50 | 2.49 | 2.47 | 2.46 | 2.44 | 2.43 |

TABLE 4-continued

| Distances between conductors (1/3) | | | | | | | | | | | | |
|---|---|---|---|---|---|---|---|---|---|---|---|---|
| #14 | 14.90 | 15.00 | 15.09 | 15.19 | 15.29 | 15.38 | 15.48 | 15.57 | 15.67 | 15.76 | 15.86 | 15.95 |
| — | 2.41 | 2.40 | 2.39 | 2.38 | 2.37 | 2.36 | 2.36 | 2.36 | 2.36 | 2.37 | 2.37 | 2.38 |
| #15 | 16.05 | 16.14 | 16.24 | 16.33 | 16.43 | 16.52 | 16.62 | 16.72 | 16.81 | 16.91 | 17.00 | 17.10 |
| — | 2.39 | 2.39 | 2.40 | 2.41 | 2.41 | 2.41 | 2.41 | 2.41 | 2.41 | 2.41 | 2.40 | 2.40 |
| #16 | 17.19 | 17.29 | 17.38 | 17.48 | 17.57 | 17.67 | 17.76 | 17.86 | 17.96 | 18.05 | 18.15 | 18.24 |
| — | 2.40 | 2.40 | 2.40 | 2.40 | 2.41 | 2.42 | 2.43 | 2.45 | 2.46 | 2.48 | 2.50 | 2.52 |
| #17 | 18.34 | 18.43 | 18.53 | 18.63 | 18.72 | 18.82 | 18.91 | 19.01 | 19.10 | 19.20 | 19.30 | 19.39 |
| — | 2.54 | 2.56 | 2.57 | 2.59 | 2.60 | 2.61 | 2.61 | 2.61 | 2.61 | 2.61 | 2.60 | 2.59 |
| #18 | 19.49 | 19.58 | 19.68 | 19.77 | 19.87 | 19.97 | 20.06 | 20.16 | 20.25 | 20.35 | 20.44 | 20.54 |
| — | 2.58 | 2.58 | 2.57 | 2.56 | 2.56 | 2.55 | 2.55 | 2.55 | 2.55 | 2.56 | 2.56 | 2.57 |
| #19 | 20.64 | 20.73 | 20.83 | 20.92 | 21.02 | 21.11 | 21.21 | 21.31 | 21.40 | 21.50 | 21.59 | 21.69 |
| — | 2.57 | 2.57 | 2.57 | 2.57 | 2.56 | 2.55 | 2.54 | 2.52 | 2.50 | 2.48 | 2.46 | 2.43 |
| #20 | 21.78 | 21.88 | 21.97 | 22.07 | 22.16 | 22.26 | 22.35 | 22.45 | 22.55 | 22.64 | 22.74 | 22.83 |
| — | 2.41 | 2.39 | 2.37 | 2.35 | 2.34 | 2.33 | 2.32 | 2.31 | 2.31 | 2.32 | 2.32 | 2.33 |
| #21 | 22.93 | 23.02 | 23.12 | 23.21 | 23.31 | 22.40 | 23.50 | 23.59 | 23.69 | 23.78 | 23.88 | 23.97 |
| — | 2.34 | 2.35 | 2.36 | 2.37 | 2.37 | 2.38 | 2.38 | 2.38 | 2.38 | 2.37 | 2.37 | 2.36 |
| #22 | 24.07 | 24.16 | 24.26 | 24.36 | 24.45 | 24.55 | 24.64 | 24.74 | 24.83 | 24.93 | 25.02 | 25.12 |
| — | 2.36 | 2.36 | 2.36 | 2.36 | 2.36 | 2.37 | 2.39 | 2.41 | 2.43 | 2.45 | 2.48 | 2.51 |
| #23 | 25.21 | 25.31 | 25.41 | 25.50 | 25.60 | 25.69 | 25.79 | 25.89 | 25.98 | 26.08 | 26.17 | 26.27 |
| — | 2.54 | 2.57 | 2.59 | 2.62 | 2.64 | 2.66 | 2.67 | 2.68 | 2.68 | 2.68 | 2.67 | 2.66 |
| #24 | 26.37 | 26.46 | 26.56 | 26.65 | 26.75 | 26.84 | 26.94 | 27.04 | 27.13 | 27.23 | 27.32 | 27.42 |
| — | 2.65 | 2.64 | 2.63 | 2.62 | 2.61 | 2.60 | 2.60 | 2.60 | 2.60 | 2.60 | 2.61 | 2.62 |
| #25 | 27.52 | 27.61 | 27.71 | 27.80 | 27.90 | 27.99 | 28.09 | 28.19 | 28.28 | 28.38 | 28.47 | 28.57 |
| — | 2.62 | 2.63 | 2.63 | 2.63 | 2.62 | 2.61 | 2.60 | 2.58 | 2.55 | 2.52 | 2.49 | 2.45 |
| #26 | 28.66 | 28.76 | 28.85 | 28.95 | 29.04 | 29.14 | 29.24 | 29.33 | 29.43 | 29.52 | 29.62 | 29.71 |
| — | 2.41 | 2.38 | 2.35 | 2.32 | 2.29 | 2.27 | 2.25 | 2.24 | 2.24 | 2.24 | 2.24 | 2.25 |
| #27 | 29.81 | 29.90 | 30.00 | 30.09 | 30.19 | 30.28 | 30.38 | 30.47 | 30.57 | 30.66 | 30.76 | 30.85 |
| — | 2.26 | 2.28 | 2.29 | 2.30 | 2.31 | 2.32 | 2.32 | 2.32 | 2.32 | 2.32 | 2.31 | 2.30 |
| #28 | 30.95 | 31.04 | 31.14 | 31.23 | 31.33 | 31.42 | 31.52 | 31.61 | 31.71 | 31.80 | 31.90 | 31.99 |
| — | 2.29 | 2.29 | 2.28 | 2.28 | 2.29 | 2.30 | 2.31 | 2.33 | 2.36 | 2.40 | 2.44 | 2.48 |
| #29 | 32.09 | 32.19 | 32.28 | 32.38 | 32.47 | 32.57 | 32.67 | 32.76 | 32.86 | 32.96 | 33.05 | 33.15 |
| — | 2.53 | 2.57 | 2.62 | 2.66 | 2.71 | 2.74 | 2.77 | 2.79 | 2.80 | 2.80 | 2.80 | 2.79 |
| #30 | 33.24 | 33.34 | 33.44 | 33.53 | 33.63 | 33.72 | 33.82 | 33.92 | 34.01 | 34.11 | 34.20 | 34.30 |
| — | 2.77 | 2.76 | 2.74 | 2.72 | 2.70 | 2.69 | 2.68 | 2.68 | 2.68 | 2.69 | 2.70 | 2.71 |

TABLE 5

| Distances between conductors (2/3) | | | | | | | | | | | | |
|---|---|---|---|---|---|---|---|---|---|---|---|---|
| #31 | 34.40 | 34.49 | 34.59 | 34.68 | 34.78 | 34.88 | 34.97 | 35.07 | 35.16 | 35.26 | 35.36 | 35.45 |
| — | 2.72 | 2.74 | 2.75 | 2.75 | 2.75 | 2.74 | 2.72 | 2.69 | 2.65 | 2.60 | 2.55 | 2.49 |
| #32 | 35.55 | 35.64 | 35.74 | 35.83 | 35.93 | 36.02 | 36.12 | 36.21 | 36.31 | 36.40 | 36.50 | 36.59 |
| — | 2.43 | 2.37 | 2.32 | 2.26 | 2.21 | 2.17 | 2.14 | 2.11 | 2.10 | 2.09 | 2.09 | 2.10 |
| #33 | 36.69 | 36.78 | 36.88 | 36.97 | 37.07 | 37.16 | 37.26 | 37.35 | 37.45 | 37.54 | 37.63 | 37.73 |
| — | 2.11 | 2.13 | 2.14 | 2.16 | 2.18 | 2.20 | 2.21 | 2.21 | 2.21 | 2.20 | 2.19 | 2.18 |
| #34 | 37.82 | 37.92 | 38.01 | 38.11 | 38.20 | 38.30 | 38.39 | 38.49 | 38.58 | 38.68 | 38.77 | 38.87 |
| — | 2.16 | 2.15 | 2.14 | 2.13 | 2.13 | 2.13 | 2.15 | 2.18 | 2.22 | 2.27 | 2.34 | 2.41 |
| #35 | 38.96 | 39.06 | 39.16 | 39.25 | 39.35 | 39.45 | 39.54 | 39.64 | 39.74 | 39.83 | 39.93 | 40.03 |
| — | 2.50 | 2.59 | 2.68 | 2.78 | 2.87 | 2.95 | 3.02 | 3.08 | 3.12 | 3.14 | 3.15 | 3.14 |
| #36 | 40.12 | 40.22 | 40.32 | 40.41 | 40.51 | 40.61 | 40.70 | 40.80 | 40.90 | 40.99 | 41.09 | 41.19 |
| — | 3.12 | 3.09 | 3.05 | 3.02 | 2.98 | 2.95 | 2.93 | 2.92 | 2.92 | 2.93 | 2.95 | 2.98 |
| #37 | 41.28 | 41.38 | 41.48 | 41.57 | 41.67 | 41.77 | 41.87 | 41.96 | 42.06 | 42.15 | 42.25 | 42.35 |
| — | 3.01 | 3.04 | 3.08 | 3.10 | 3.11 | 3.10 | 3.08 | 3.02 | 2.95 | 2.85 | 2.73 | 2.60 |
| #38 | 42.44 | 42.54 | 42.63 | 42.73 | 42.82 | 42.92 | 43.01 | 43.10 | 43.20 | 43.29 | 43.38 | 43.48 |
| — | 2.46 | 2.32 | 2.18 | 2.05 | 1.93 | 1.82 | 1.73 | 1.67 | 1.61 | 1.58 | 1.57 | 1.57 |
| #39 | 43.57 | 43.67 | 43.76 | 43.85 | 43.95 | 44.04 | 44.13 | 44.23 | 44.32 | 44.42 | 44.51 | 44.61 |
| — | 1.58 | 1.61 | 1.64 | 1.69 | 1.73 | 1.76 | 1.79 | 1.81 | 1.82 | 1.81 | 1.78 | 1.75 |
| #40 | 44.70 | 44.79 | 44.89 | 44.98 | 45.07 | 45.17 | 45.26 | 45.35 | 45.45 | 45.54 | 45.64 | 45.73 |
| — | 1.70 | 1.65 | 1.61 | 1.57 | 1.54 | 1.54 | 1.56 | 1.62 | 1.72 | 1.87 | 2.08 | 2.37 |
| #41 | 45.83 | 45.93 | 46.02 | 46.13 | 46.23 | 46.33 | 46.44 | 46.55 | 46.66 | 46.78 | 46.89 | 47.01 |
| — | 2.75 | 3.24 | 3.86 | 4.62 | 5.51 | 6.52 | 7.60 | 8.70 | 9.73 | 10.59 | 11.18 | 11.41 |
| #42 | 47.12 | 47.24 | 47.35 | 47.46 | 47.57 | 47.67 | 47.77 | 47.87 | 47.96 | 48.06 | 48.15 | 48.24 |
| — | 11.23 | 10.65 | 9.71 | 8.51 | 7.16 | 5.80 | 4.52 | 3.40 | 2.48 | 1.78 | 1.26 | 0.89 |
| #43 | 48.33 | 48.43 | 48.52 | 48.61 | 48.70 | 48.79 | 48.88 | 48.97 | 49.06 | 49.15 | 49.25 | 49.34 |
| — | 0.63 | 0.46 | 0.35 | 0.27 | 0.23 | 0.21 | 0.20 | 0.21 | 0.24 | 0.29 | 0.37 | 0.50 |
| #44 | 49.43 | 49.52 | 49.62 | 49.71 | 49.81 | 49.90 | 50.00 | 50.11 | 50.21 | 50.32 | 50.43 | 50.54 |
| — | 0.69 | 0.96 | 1.34 | 1.86 | 2.54 | 3.39 | 4.39 | 5.48 | 6.58 | 7.61 | 8.48 | 9.11 |
| #45 | 50.65 | 50.76 | 50.87 | 50.98 | 51.09 | 51.20 | 51.30 | 51.40 | 51.50 | 51.60 | 51.70 | 51.80 |
| — | 9.44 | 9.45 | 9.17 | 8.65 | 7.96 | 7.18 | 6.36 | 5.58 | 4.86 | 4.23 | 3.70 | 3.27 |
| #46 | 51.90 | 51.99 | 52.09 | 52.18 | 52.28 | 52.37 | 52.47 | 52.56 | 52.66 | 52.75 | 52.85 | 52.94 |
| — | 2.92 | 2.66 | 2.46 | 2.33 | 2.24 | 2.18 | 2.16 | 2.16 | 2.17 | 2.18 | 2.19 | 2.18 |
| #47 | 53.04 | 53.13 | 53.23 | 53.32 | 53.42 | 53.51 | 53.60 | 53.70 | 53.79 | 53.88 | 53.98 | 54.07 |
| — | 2.17 | 2.13 | 2.07 | 1.99 | 1.90 | 1.79 | 1.69 | 1.58 | 1.48 | 1.40 | 1.33 | 1.27 |

TABLE 5-continued

| Distances between conductors (2/3) | | | | | | | | | | | | |
|---|---|---|---|---|---|---|---|---|---|---|---|---|
| #48 | 54.16 | 54.26 | 54.35 | 54.44 | 54.53 | 54.63 | 54.72 | 54.82 | 54.91 | 55.00 | 55.10 | 55.19 |
| — | 1.24 | 1.23 | 1.23 | 1.26 | 1.31 | 1.38 | 1.47 | 1.59 | 1.73 | 1.88 | 2.04 | 2.22 |
| #49 | 55.29 | 55.38 | 55.48 | 55.58 | 55.67 | 55.77 | 55.87 | 55.96 | 56.06 | 56.16 | 56.25 | 56.35 |
| — | 2.39 | 2.56 | 2.71 | 2.84 | 2.94 | 3.01 | 3.06 | 3.08 | 3.07 | 3.06 | 3.03 | 3.00 |
| #50 | 56.45 | 56.54 | 56.64 | 56.74 | 56.83 | 56.93 | 57.03 | 57.12 | 57.22 | 57.32 | 57.42 | 57.51 |
| — | 2.98 | 2.96 | 2.95 | 2.97 | 2.99 | 3.04 | 3.09 | 3.17 | 3.25 | 3.33 | 3.41 | 3.48 |
| #51 | 57.61 | 57.71 | 57.81 | 57.91 | 58.00 | 58.10 | 58.20 | 58.30 | 58.39 | 58.49 | 58.59 | 58.68 |
| — | 3.54 | 3.57 | 3.58 | 3.56 | 3.50 | 3.42 | 3.31 | 3.18 | 3.04 | 2.89 | 2.74 | 2.59 |
| #52 | 58.78 | 58.87 | 58.97 | 59.06 | 59.16 | 59.25 | 59.35 | 59.44 | 59.53 | 59.63 | 59.72 | 59.82 |
| — | 2.46 | 2.33 | 2.23 | 2.14 | 2.07 | 2.02 | 1.99 | 1.97 | 1.97 | 1.97 | 1.99 | 2.01 |
| #53 | 59.91 | 60.01 | 60.10 | 60.20 | 60.29 | 60.39 | 60.48 | 60.58 | 60.67 | 60.76 | 60.86 | 60.95 |
| — | 2.03 | 2.05 | 2.07 | 2.09 | 2.09 | 2.09 | 2.08 | 2.06 | 2.04 | 2.01 | 1.98 | 1.95 |
| #54 | 61.05 | 61.14 | 61.24 | 61.33 | 61.43 | 61.52 | 61.61 | 61.71 | 61.80 | 61.90 | 61.99 | 62.09 |
| — | 1.93 | 1.91 | 1.91 | 1.91 | 1.92 | 1.95 | 1.99 | 2.05 | 2.11 | 2.19 | 2.28 | 2.37 |
| #55 | 62.18 | 62.28 | 62.38 | 62.47 | 62.57 | 62.66 | 62.76 | 62.86 | 62.95 | 63.05 | 63.15 | 63.24 |
| — | 2.47 | 2.57 | 2.66 | 2.75 | 2.83 | 2.89 | 2.93 | 2.96 | 2.98 | 2.98 | 2.96 | 2.94 |
| #56 | 63.34 | 63.44 | 63.53 | 63.63 | 63.73 | 63.82 | 63.92 | 64.01 | 64.11 | 64.21 | 64.30 | 64.40 |
| — | 2.91 | 2.88 | 2.85 | 2.82 | 2.80 | 2.79 | 2.78 | 2.78 | 2.79 | 2.81 | 2.83 | 2.85 |
| #57 | 64.50 | 64.59 | 64.69 | 64.79 | 64.88 | 64.98 | 65.08 | 65.17 | 65.27 | 65.36 | 65.46 | 65.55 |
| — | 2.87 | 2.89 | 2.90 | 2.91 | 2.90 | 2.88 | 2.84 | 2.80 | 2.74 | 2.67 | 2.60 | 2.53 |
| #58 | 65.65 | 65.75 | 65.84 | 65.94 | 66.03 | 66.13 | 66.22 | 66.32 | 66.41 | 66.50 | 66.60 | 66.69 |
| — | 2.45 | 2.37 | 2.30 | 2.24 | 2.19 | 2.14 | 2.11 | 2.08 | 2.07 | 2.07 | 2.07 | 2.08 |
| #59 | 66.79 | 66.88 | 66.98 | 67.07 | 67.17 | 67.26 | 67.36 | 67.45 | 67.55 | 67.64 | 67.74 | 67.83 |
| — | 2.10 | 2.12 | 2.15 | 2.17 | 2.19 | 2.21 | 2.22 | 2.23 | 2.23 | 2.23 | 2.22 | 2.22 |
| #60 | 67.93 | 68.02 | 68.12 | 68.21 | 68.31 | 68.40 | 68.50 | 68.59 | 68.69 | 68.78 | 68.88 | 68.97 |
| — | 2.20 | 2.19 | 2.19 | 2.18 | 2.18 | 2.19 | 2.21 | 2.23 | 2.26 | 2.30 | 2.35 | 2.40 |

TABLE 6

| Distances between conductors (3/3) | | | | | | | | | | | | |
|---|---|---|---|---|---|---|---|---|---|---|---|---|
| #61 | 69.07 | 69.16 | 69.26 | 69.36 | 69.45 | 69.55 | 69.64 | 69.74 | 69.84 | 69.93 | 70.03 | 70.13 |
| — | 2.46 | 2.52 | 2.58 | 2.64 | 2.70 | 2.74 | 2.79 | 2.82 | 2.84 | 2.85 | 2.85 | 2.84 |
| #62 | 70.22 | 70.32 | 70.41 | 70.51 | 70.61 | 70.70 | 70.80 | 70.89 | 70.99 | 71.09 | 71.18 | 71.28 |
| — | 2.82 | 2.80 | 2.77 | 2.74 | 2.71 | 2.69 | 2.67 | 2.65 | 2.64 | 2.64 | 2.64 | 2.64 |
| #63 | 71.37 | 71.47 | 71.57 | 71.66 | 71.76 | 71.85 | 71.95 | 72.05 | 72.14 | 72.24 | 72.33 | 72.43 |
| — | 2.64 | 2.65 | 2.66 | 2.66 | 2.66 | 2.66 | 2.65 | 2.63 | 2.61 | 2.58 | 2.54 | 2.50 |
| #64 | 72.52 | 72.62 | 72.71 | 72.81 | 72.90 | 73.00 | 73.09 | 73.19 | 73.28 | 73.38 | 73.47 | 73.57 |
| — | 2.46 | 2.41 | 2.36 | 2.32 | 2.28 | 2.24 | 2.21 | 2.19 | 2.17 | 2.16 | 2.16 | 2.16 |
| #65 | 73.66 | 73.76 | 73.85 | 73.95 | 74.04 | 74.14 | 74.23 | 74.33 | 74.42 | 74.52 | 74.61 | 74.71 |
| — | 2.17 | 2.19 | 2.20 | 2.22 | 2.25 | 2.27 | 2.29 | 2.30 | 2.32 | 2.33 | 2.33 | 2.34 |
| #66 | 74.81 | 74.90 | 75.00 | 75.09 | 75.19 | 75.28 | 75.38 | 75.47 | 75.57 | 75.66 | 75.76 | 75.85 |
| — | 2.34 | 2.33 | 2.33 | 2.33 | 2.33 | 2.33 | 2.33 | 2.34 | 2.35 | 2.37 | 2.39 | 2.42 |
| #67 | 75.95 | 76.04 | 76.14 | 76.24 | 76.33 | 76.43 | 76.52 | 76.62 | 76.72 | 76.81 | 76.91 | 77.00 |
| — | 2.46 | 2.49 | 2.53 | 2.57 | 2.61 | 2.64 | 2.68 | 2.70 | 2.72 | 2.74 | 2.74 | 2.74 |
| #68 | 77.10 | 77.20 | 77.29 | 77.39 | 77.48 | 77.58 | 77.68 | 77.77 | 77.87 | 77.96 | 78.06 | 78.15 |
| — | 2.74 | 2.72 | 2.71 | 2.68 | 2.66 | 2.64 | 2.62 | 2.60 | 2.58 | 2.56 | 2.55 | 2.54 |
| #69 | 78.25 | 78.35 | 78.44 | 78.54 | 78.63 | 78.73 | 78.82 | 78.92 | 79.02 | 79.11 | 79.21 | 79.30 |
| — | 2.54 | 2.54 | 2.54 | 2.54 | 2.54 | 2.54 | 2.54 | 2.54 | 2.53 | 2.52 | 2.50 | 2.48 |
| #70 | 79.40 | 79.49 | 79.59 | 79.68 | 79.78 | 79.87 | 79.97 | 80.06 | 80.16 | 80.25 | 80.35 | 80.44 |
| — | 2.46 | 2.43 | 2.40 | 2.37 | 2.34 | 2.32 | 2.29 | 2.27 | 2.25 | 2.24 | 2.23 | 2.23 |
| #71 | 80.54 | 80.63 | 80.73 | 80.82 | 80.92 | 81.01 | 81.11 | 81.21 | 81.30 | 81.40 | 81.49 | 81.59 |
| — | 2.23 | 2.24 | 2.25 | 2.27 | 2.28 | 2.30 | 2.32 | 2.34 | 2.36 | 2.37 | 2.39 | 2.40 |
| #72 | 81.68 | 81.78 | 81.87 | 81.97 | 82.06 | 82.16 | 82.25 | 82.35 | 82.45 | 82.54 | 82.64 | 82.73 |
| — | 2.40 | 2.41 | 2.41 | 2.41 | 2.41 | 2.41 | 2.41 | 2.41 | 2.42 | 2.42 | 2.43 | 2.44 |
| #73 | 82.83 | 82.92 | 83.02 | 83.11 | 83.21 | 83.31 | 83.40 | 83.50 | 83.59 | 83.69 | 83.78 | 83.88 |
| — | 2.46 | 2.48 | 2.50 | 2.53 | 2.55 | 2.58 | 2.60 | 2.62 | 2.64 | 2.65 | 2.66 | 2.67 |
| #74 | 83.98 | 84.07 | 84.17 | 84.26 | 84.36 | 84.46 | 84.55 | 84.65 | 84.74 | 84.84 | 84.93 | 85.03 |
| — | 2.67 | 2.66 | 2.65 | 2.64 | 2.62 | 2.60 | 2.58 | 2.56 | 2.54 | 2.53 | 2.51 | 2.50 |
| #75 | 85.13 | 85.22 | 85.32 | 85.41 | 85.51 | 85.60 | 85.70 | 85.79 | 85.89 | 85.99 | 86.08 | 86.18 |
| — | 2.49 | 2.48 | 2.48 | 2.48 | 2.48 | 2.48 | 2.48 | 2.48 | 2.47 | 2.47 | 2.47 | 2.46 |
| #76 | 86.27 | 86.37 | 86.46 | 86.56 | 86.65 | 86.75 | 86.84 | 86.94 | 87.03 | 87.13 | 87.22 | 87.32 |
| — | 2.45 | 2.43 | 2.42 | 2.40 | 2.38 | 2.36 | 2.35 | 2.33 | 2.31 | 2.30 | 2.29 | 2.29 |
| #77 | 87.41 | 87.51 | 87.61 | 87.70 | 87.80 | 87.89 | 87.99 | 88.08 | 88.18 | 88.27 | 88.37 | 88.46 |
| — | 2.29 | 2.29 | 2.30 | 2.30 | 2.32 | 2.33 | 2.35 | 2.36 | 2.38 | 2.40 | 2.41 | 2.43 |
| #78 | 88.56 | 88.65 | 88.75 | 88.84 | 88.94 | 89.04 | 89.13 | 89.23 | 89.32 | 89.42 | 89.51 | 89.61 |
| — | 2.44 | 2.45 | 2.45 | 2.46 | 2.46 | 2.46 | 2.46 | 2.46 | 2.46 | 2.46 | 2.46 | 2.47 |
| #79 | 89.70 | 89.80 | 89.90 | 89.99 | 90.09 | 90.18 | 90.28 | 90.37 | 90.47 | 90.57 | 90.66 | 90.76 |
| — | 2.47 | 2.48 | 2.49 | 2.51 | 2.52 | 2.54 | 2.55 | 2.57 | 2.58 | 2.59 | 2.60 | 2.61 |
| #80 | 90.85 | 90.95 | 91.04 | 91.14 | 91.24 | 91.33 | 91.43 | 91.52 | 91.62 | 91.71 | 91.81 | 91.91 |
| — | 2.61 | 2.61 | 2.61 | 2.60 | 2.59 | 2.58 | 2.56 | 2.54 | 2.53 | 2.51 | 2.49 | 2.48 |
| #81 | 92.00 | 92.10 | 92.19 | 92.29 | 92.38 | 92.48 | 92.57 | 92.67 | 92.76 | 92.86 | 92.96 | 93.05 |
| — | 2.47 | 2.46 | 2.45 | 2.44 | 2.44 | 2.44 | 2.44 | 2.44 | 2.44 | 2.44 | 2.44 | 2.44 |

TABLE 6-continued

| Distances between conductors (3/3) | | | | | | | | | | | | |
|---|---|---|---|---|---|---|---|---|---|---|---|---|
| #82 | 93.15 | 93.24 | 93.34 | 93.43 | 93.53 | 93.62 | 93.72 | 93.81 | 93.91 | 94.00 | 94.10 | 94.20 |
| — | 2.43 | 2.43 | 2.42 | 2.41 | 2.40 | 2.39 | 2.38 | 2.37 | 2.36 | 2.35 | 2.34 | 2.33 |
| #83 | 94.29 | 94.39 | 94.48 | 94.58 | 94.67 | 94.77 | 94.86 | 94.96 | 95.05 | 95.15 | 95.24 | 95.34 |
| — | 2.33 | 2.33 | 2.33 | 2.34 | 2.34 | 2.35 | 2.37 | 2.38 | 2.39 | 2.41 | 2.42 | 2.44 |
| #84 | 95.43 | 95.53 | 95.63 | 95.72 | 95.82 | | | | | | | |
| — | 2.45 | 2.46 | 2.47 | 2.48 | 2.48 | | | | | | | |

Figure 11:
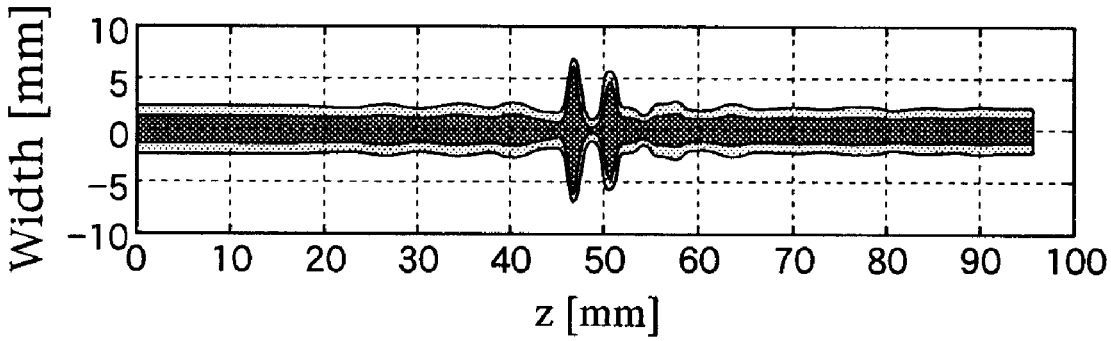
FIG. 11 is a graph showing the shape of the symmetric-type two-conductor coplanar strip in the reflection-type bandpass filter fabricated in Embodiment 2.

FIG. 11 shows the shape of the conductors in the reflection-type bandpass filter 1 of Embodiment 2. In the figure, the lightly shaded portion represents the conductors 3 and 4, and the heavily shaded portion represents the non-conducting portion 5. A non-reflecting terminator, or an R=50Ω resistance, is provided on the terminating side (the face at z=95.82 mm) of this reflection-type bandpass filter 1. The thicknesses of the metal films of the conductors 3 and 4 are to be thick compared with the skin depth at f=1 GHz. For example, when using copper, the thickness of the conductors 3 and 4 should be 2.1 μm or greater. This bandpass filter 1 is used in a system with a characteristic impedance of 50Ω.

Figure 12:
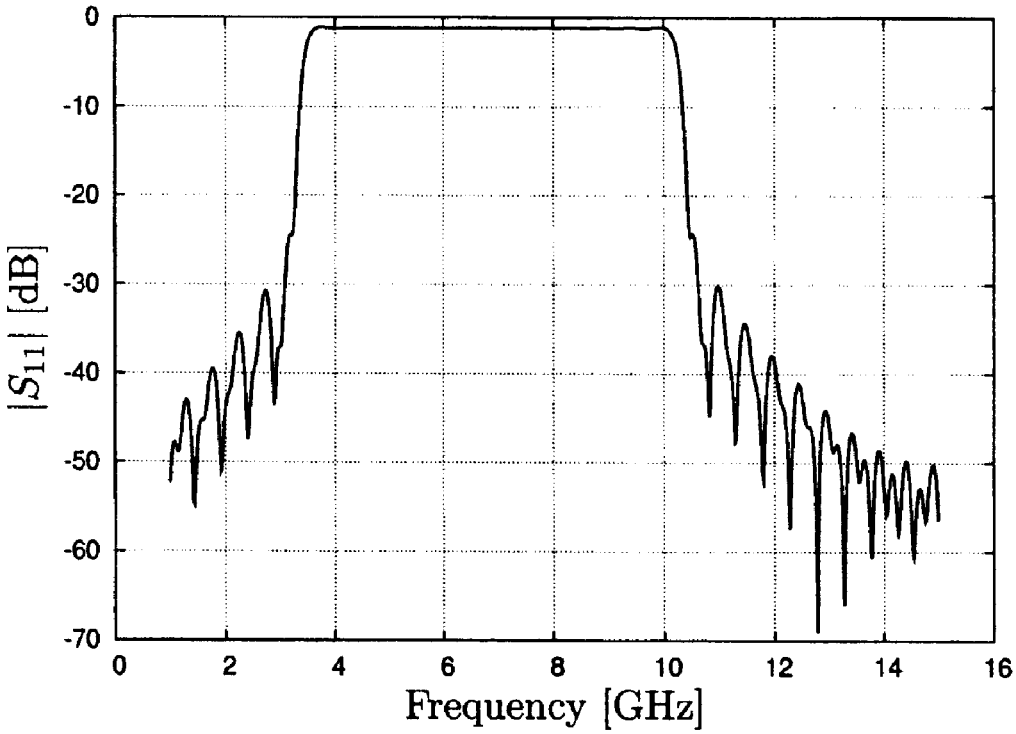
FIG. 12 is a graph showing the reflected wave amplitude characteristic in the reflection-type bandpass filter fabricated in Embodiment 2.
Figure 13:
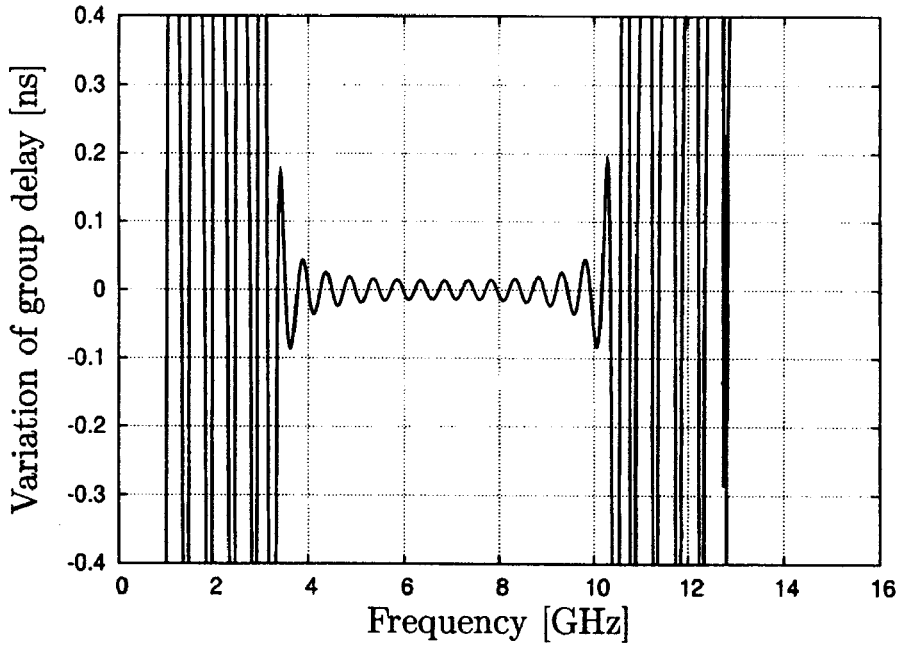
FIG. 13 is a graph showing the reflected wave group delay characteristic in the reflection-type bandpass filter fabricated in Embodiment 2.

FIG. 12 and FIG. 13 show the amplitude characteristic and group delay characteristic respectively of reflected waves ($S_{11}$) in the bandpass filter 1 of Embodiment 2. As shown in the figures, in the range of frequencies f for which 3.8 GHz≦f≦9.9 GHz, the reflectance is −1 dB or greater, and the group delay variation is within ±0.1 ns. In the region f<3.1 GHz or f>10.6 GHz, the reflectance is −20 dB or lower.

Embodiment 3

Figure 14:
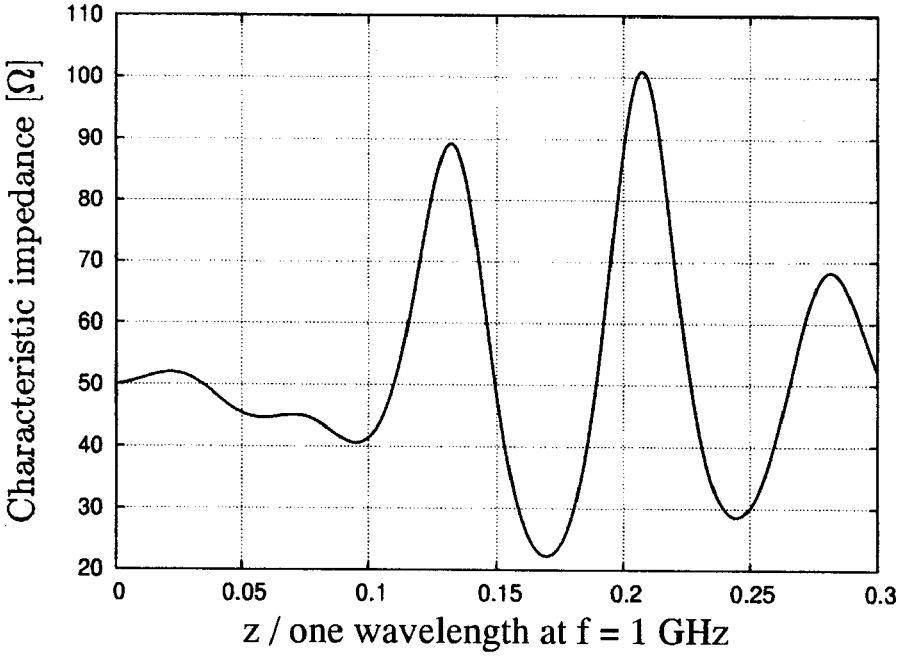
FIG. 14 is a graph showing the characteristic impedance distribution of the reflection-type bandpass filter fabricated in Embodiment 3.

A Kaiser window was used for which the reflectance is 1 at frequencies f in the range 3.7 GHz≦f≦10.0 GHz, and is 0 elsewhere, and for which A=30. Design was performed using 0.3 wavelength of signals at frequency f=1 GHz propagating in the coplanar strip as the waveguide length, and setting the system characteristic impedance to 50ω. FIG. 14 shows the distribution in the z-axis direction of the local characteristic impedance obtained in the inverse problem.

Figure 15:
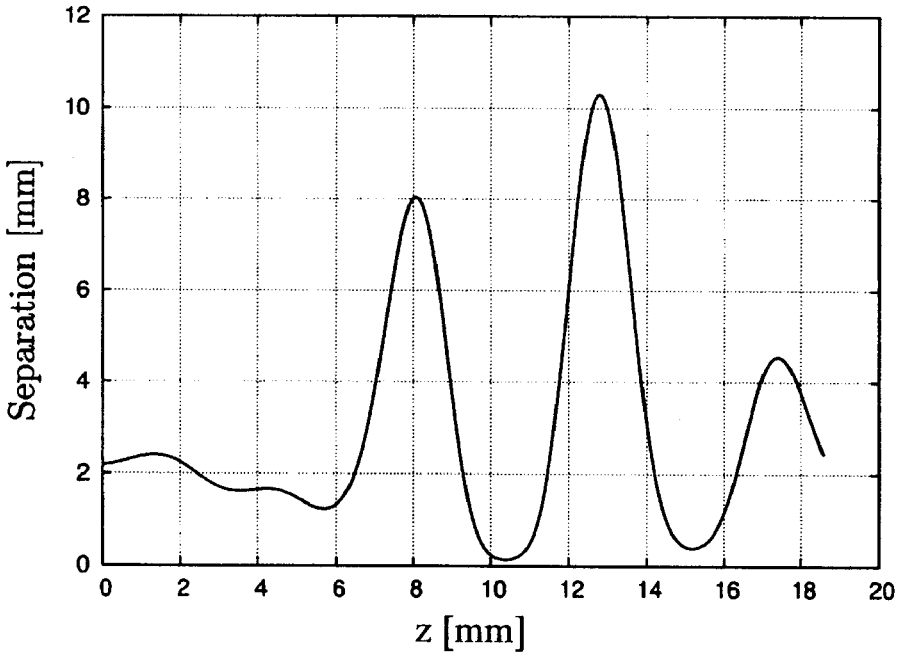
FIG. 15 is a graph showing the distribution of the distance between conductors of the symmetric-type two-conductor coplanar strip in the reflection-type bandpass filter fabricated in Embodiment 1.

FIG. 15 shows the distribution in the z-axis direction of the distance between conductors s, when using a dielectric substrate 2 with a thickness h=1 mm and relative permittivity $\epsilon_r$=90, and when the conductor width w=2 mm. Table 7 lists the distances between conductors s.

TABLE 7

| Distances between conductors | | | | | | | | | | | | |
|---|---|---|---|---|---|---|---|---|---|---|---|---|
| z(mm) | 0.00 | 0.06 | 0.12 | 0.18 | 0.24 | 0.30 | 0.36 | 0.43 | 0.49 | 0.55 | 0.61 | 0.67 |
| s(mm) | 2.18 | 2.19 | 2.20 | 2.20 | 2.21 | 2.22 | 2.24 | 2.25 | 2.26 | 2.28 | 2.29 | 2.30 |
| #2 | 0.73 | 0.79 | 0.85 | 0.91 | 0.97 | 1.04 | 1.10 | 1.16 | 1.22 | 1.28 | 1.34 | 1.40 |
| — | 2.32 | 2.33 | 2.35 | 2.36 | 2.37 | 2.38 | 2.39 | 2.40 | 2.41 | 2.41 | 2.41 | 2.41 |
| #3 | 1.46 | 1.53 | 1.59 | 1.65 | 1.71 | 1.77 | 1.83 | 1.89 | 1.95 | 2.01 | 2.07 | 2.14 |
| — | 2.41 | 2.40 | 2.39 | 2.38 | 2.36 | 2.35 | 2.33 | 2.30 | 2.27 | 2.25 | 2.22 | 2.18 |
| #4 | 2.20 | 2.26 | 2.32 | 2.38 | 2.44 | 2.50 | 2.56 | 2.62 | 2.68 | 2.74 | 2.80 | 2.86 |
| — | 2.15 | 2.11 | 2.08 | 2.04 | 2.01 | 1.97 | 1.93 | 1.90 | 1.87 | 1.83 | 1.80 | 1.78 |
| #5 | 2.91 | 2.97 | 3.03 | 3.09 | 3.15 | 3.21 | 3.27 | 3.33 | 3.39 | 3.45 | 3.51 | 3.56 |
| — | 1.75 | 1.73 | 1.70 | 1.68 | 1.67 | 1.65 | 1.64 | 1.63 | 1.63 | 1.62 | 1.62 | 1.62 |
| #6 | 3.62 | 3.68 | 3.74 | 3.80 | 3.86 | 3.92 | 3.98 | 4.04 | 4.10 | 4.16 | 4.21 | 4.27 |
| — | 1.62 | 1.62 | 1.63 | 1.63 | 1.64 | 1.64 | 1.65 | 1.66 | 1.66 | 1.66 | 1.67 | 1.67 |
| #7 | 4.33 | 4.39 | 4.45 | 4.51 | 4.57 | 4.63 | 4.69 | 4.75 | 4.80 | 4.86 | 4.92 | 4.98 |
| — | 1.66 | 1.66 | 1.65 | 1.64 | 1.63 | 1.62 | 1.60 | 1.58 | 1.56 | 1.53 | 1.51 | 1.48 |
| #8 | 5.04 | 5.10 | 5.16 | 5.21 | 5.27 | 5.33 | 5.39 | 5.45 | 5.50 | 5.56 | 5.62 | 5.68 |
| — | 1.45 | 1.43 | 1.40 | 1.37 | 1.34 | 1.32 | 1.30 | 1.28 | 1.26 | 1.25 | 1.24 | 1.24 |
| #9 | 5.74 | 5.79 | 5.85 | 5.91 | 5.97 | 6.03 | 6.08 | 6.14 | 6.20 | 6.26 | 6.32 | 6.38 |
| — | 1.24 | 1.25 | 1.26 | 1.28 | 1.31 | 1.34 | 1.39 | 1.45 | 1.51 | 1.59 | 1.68 | 1.78 |
| #10 | 6.44 | 6.50 | 6.56 | 6.62 | 6.68 | 6.75 | 6.81 | 6.87 | 6.94 | 7.00 | 7.07 | 7.13 |
| — | 1.90 | 2.04 | 2.19 | 2.37 | 2.56 | 2.77 | 3.00 | 3.25 | 3.53 | 3.83 | 4.14 | 4.47 |
| #11 | 7.20 | 7.27 | 7.34 | 7.41 | 7.48 | 7.55 | 7.62 | 7.70 | 7.77 | 7.84 | 7.92 | 7.99 |
| — | 4.82 | 5.18 | 5.54 | 5.91 | 6.27 | 6.62 | 6.94 | 7.24 | 7.51 | 7.72 | 7.89 | 7.99 |
| #12 | 8.07 | 8.14 | 8.22 | 8.29 | 8.36 | 8.44 | 8.51 | 8.58 | 8.65 | 8.72 | 8.79 | 8.86 |
| — | 8.04 | 8.01 | 7.92 | 7.75 | 7.53 | 7.25 | 6.91 | 6.53 | 6.12 | 5.69 | 5.24 | 4.78 |
| #13 | 8.92 | 8.99 | 9.05 | 9.12 | 9.18 | 9.24 | 9.30 | 9.36 | 9.42 | 9.47 | 9.53 | 9.59 |
| — | 4.33 | 3.89 | 3.46 | 3.06 | 2.68 | 2.34 | 2.02 | 1.73 | 1.48 | 1.25 | 1.06 | 0.89 |
| #14 | 9.65 | 9.70 | 9.76 | 9.81 | 9.87 | 9.92 | 9.98 | 10.03 | 10.09 | 10.14 | 10.20 | 10.25 |
| — | 0.74 | 0.62 | 0.52 | 0.43 | 0.36 | 0.31 | 0.26 | 0.23 | 0.20 | 0.17 | 0.16 | 0.15 |
| #15 | 10.30 | 10.36 | 10.41 | 10.47 | 10.52 | 10.58 | 10.63 | 10.69 | 10.74 | 10.79 | 10.85 | 10.90 |
| — | 0.14 | 0.13 | 0.13 | 0.13 | 0.14 | 0.15 | 0.16 | 0.18 | 0.21 | 0.24 | 0.29 | 0.34 |
| #16 | 10.96 | 11.02 | 11.07 | 11.13 | 11.18 | 11.24 | 11.30 | 11.36 | 11.42 | 11.48 | 11.54 | 11.60 |
| — | 0.41 | 0.49 | 0.59 | 0.71 | 0.85 | 1.03 | 1.23 | 1.47 | 1.74 | 2.05 | 2.41 | 2.80 |
| #17 | 11.66 | 11.73 | 11.80 | 11.86 | 11.93 | 12.00 | 12.07 | 12.15 | 12.22 | 12.30 | 12.37 | 12.45 |
| — | 3.24 | 3.71 | 4.23 | 4.77 | 5.35 | 5.94 | 6.55 | 7.15 | 7.74 | 8.30 | 8.82 | 9.28 |
| #18 | 12.53 | 12.60 | 12.68 | 12.76 | 12.84 | 12.92 | 13.00 | 13.08 | 13.15 | 13.23 | 13.31 | 13.38 |
| — | 9.67 | 9.97 | 10.19 | 10.30 | 10.31 | 10.21 | 10.02 | 9.73 | 9.37 | 8.93 | 8.44 | 7.91 |
| #19 | 13.45 | 13.53 | 13.60 | 13.67 | 13.73 | 13.80 | 13.87 | 13.93 | 13.99 | 14.06 | 14.12 | 14.18 |
| — | 7.36 | 6.79 | 6.22 | 5.66 | 5.11 | 4.59 | 4.10 | 3.65 | 3.23 | 2.85 | 2.50 | 2.19 |

TABLE 7-continued

| Distances between conductors | | | | | | | | | | | | |
|---|---|---|---|---|---|---|---|---|---|---|---|---|
| #20 | 14.24 | 14.30 | 14.36 | 14.41 | 14.47 | 14.53 | 14.59 | 14.64 | 14.70 | 14.75 | 14.81 | 14.87 |
| — | 1.91 | 1.67 | 1.46 | 1.27 | 1.11 | 0.97 | 0.85 | 0.75 | 0.67 | 0.60 | 0.54 | 0.50 |
| #21 | 14.92 | 14.98 | 15.03 | 15.09 | 15.14 | 15.20 | 15.25 | 15.31 | 15.36 | 15.42 | 15.47 | 15.53 |
| — | 0.46 | 0.43 | 0.41 | 0.40 | 0.39 | 0.39 | 0.39 | 0.40 | 0.41 | 0.43 | 0.46 | 0.50 |
| #22 | 15.58 | 15.64 | 15.70 | 15.75 | 15.81 | 15.87 | 15.92 | 15.98 | 16.04 | 16.10 | 16.16 | 16.21 |
| — | 0.54 | 0.59 | 0.65 | 0.72 | 0.79 | 0.88 | 0.99 | 1.10 | 1.22 | 1.36 | 1.51 | 1.67 |
| #23 | 16.27 | 16.33 | 16.40 | 16.46 | 16.52 | 16.58 | 16.64 | 16.71 | 16.77 | 16.84 | 16.90 | 16.97 |
| — | 1.85 | 2.03 | 2.23 | 2.43 | 2.63 | 2.84 | 3.05 | 3.26 | 3.46 | 3.65 | 3.83 | 4.00 |
| #24 | 17.03 | 17.10 | 17.17 | 17.23 | 17.30 | 17.37 | 17.43 | 17.50 | 17.57 | 17.63 | 17.70 | 17.77 |
| — | 4.15 | 4.27 | 4.38 | 4.46 | 4.52 | 4.55 | 4.56 | 4.54 | 4.50 | 4.44 | 4.36 | 4.26 |
| #25 | 17.83 | 17.90 | 17.96 | 18.03 | 18.09 | 18.16 | 18.22 | 18.28 | 18.35 | 18.41 | 18.47 | 18.53 |
| — | 4.14 | 4.02 | 3.88 | 3.74 | 3.59 | 3.43 | 3.28 | 3.13 | 2.98 | 2.84 | 2.70 | 2.56 |
| #26 | 18.59 | | | | | | | | | | | |
| — | 2.43 | | | | | | | | | | | |

Figure 16:
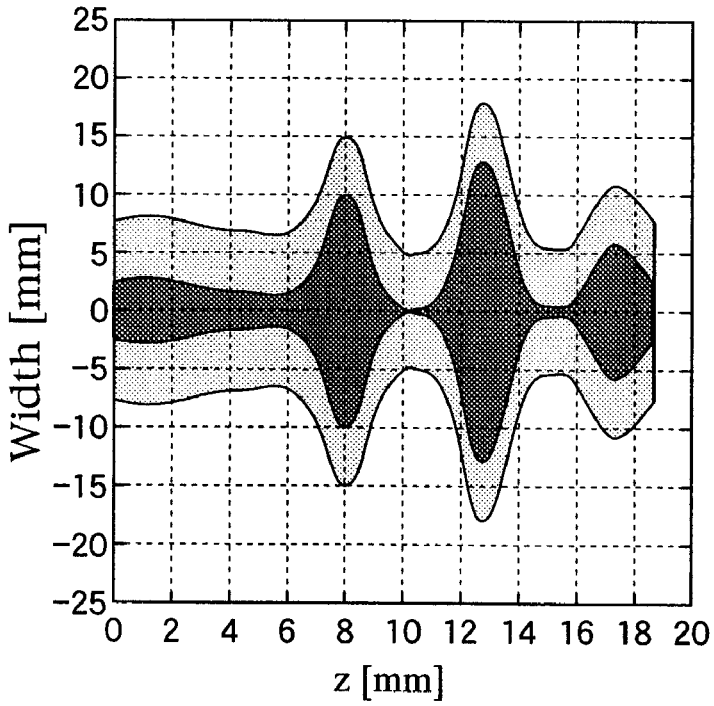
FIG. 16 is a graph showing the shape of the symmetric-type two-conductor coplanar strip in the reflection-type bandpass filter fabricated in Embodiment 3.

FIG. 16 shows the shape of the conductors in the reflection-type bandpass filter 1 of Embodiment 3. In the figure, the lightly shaded portion represents the conductors 3 and 4, and the heavily shaded portion represents the non-conducting portion 5. A non-reflecting terminator, or an R=50Ω resistance, is provided on the terminating side (the face at z=18.59 mm) of this reflection-type bandpass filter 1. The thicknesses of the metal films of the conductors 3 and 4 are to be thick compared with the skin depth at f=1 GHz. For example, when using copper, the thickness of the conductors 3 and 4 should be 2.1 μm or greater. This bandpass filter 1 is used in a system with a characteristic impedance of 50Ω.

Figure 17:
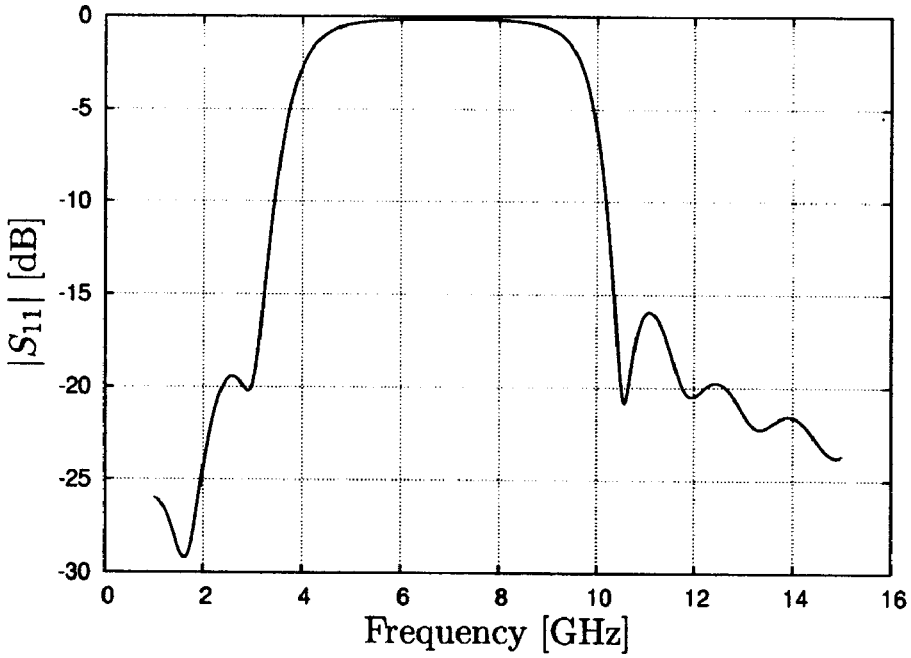
FIG. 17 is a graph showing the reflected wave amplitude characteristic in the reflection-type bandpass filter fabricated in Embodiment 3.
Figure 18:
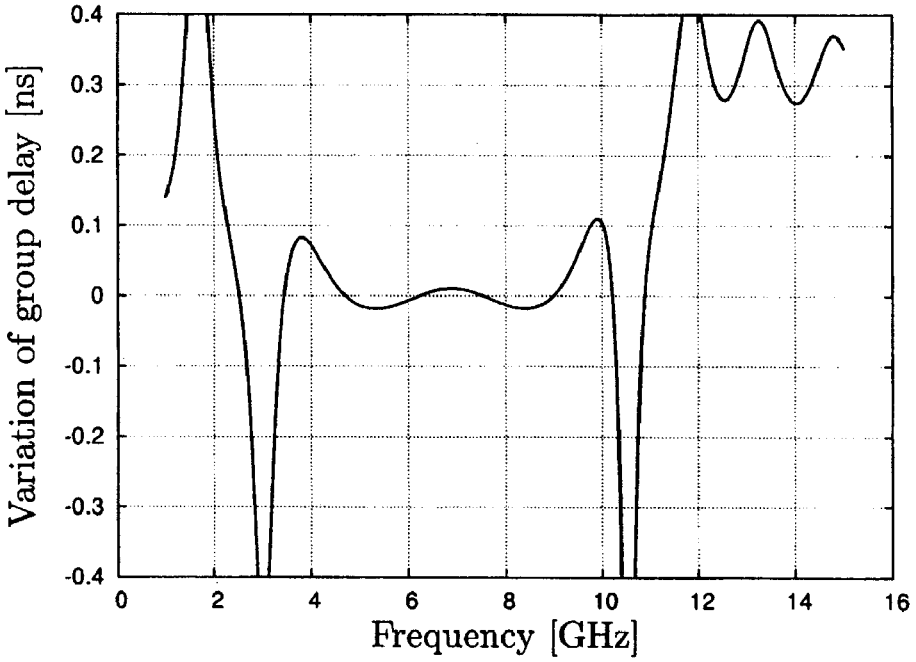
FIG. 18 is a graph showing the reflected wave group delay characteristic in the reflection-type bandpass filter fabricated in Embodiment 3.

FIG. 17 and FIG. 18 show the amplitude characteristic and group delay characteristic respectively of reflected waves ($S_{11}$) in the bandpass filter 1 of Embodiment 3. As shown in the figures, in the range of frequencies f for which 4.2 GHz≦f≦9.6 GHz, the reflectance is −2 dB or greater, and the group delay variation is within ±0.15 ns. In the region f<3.1 GHz or f>10.6 GHz, the reflectance is −15 dB or lower.

Embodiment 4

Figure 19:
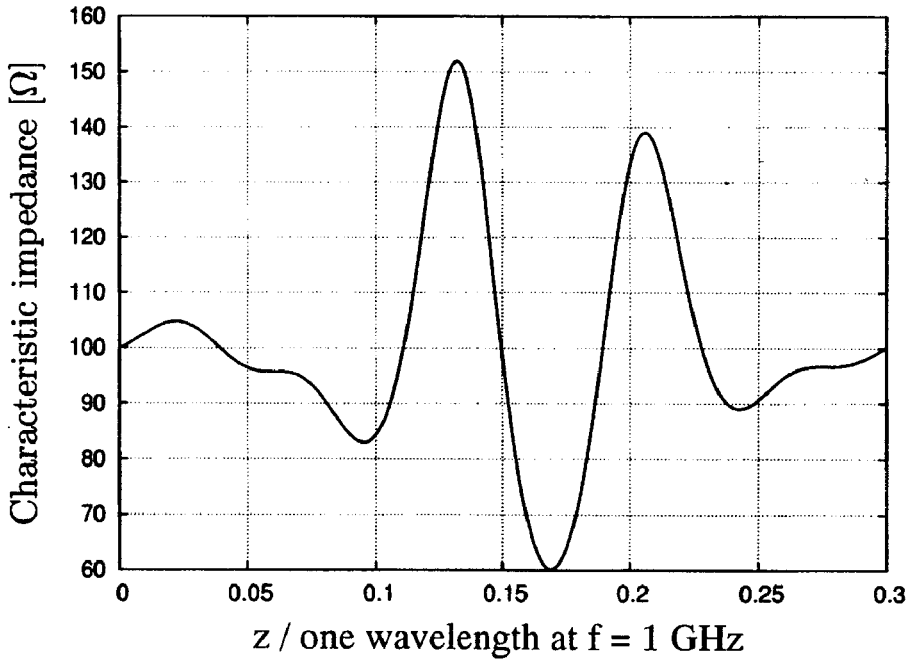
FIG. 19 is a graph showing the characteristic impedance distribution of the reflection-type bandpass filter fabricated in Embodiment 4.

A Kaiser window was used for which the reflectance is 0.8 at frequencies f in the range 3.7 GHz≦f≦10.0 GHz, and is 0 elsewhere, and for which A=30. Design was performed using 0.3 wavelength of signals at frequency f=1 GHz propagating in the coplanar strip as the waveguide length, and setting the system characteristic impedance to 100Ω. FIG. 19 shows the distribution in the z-axis direction of the local characteristic impedance obtained in the inverse problem.

Figure 20:
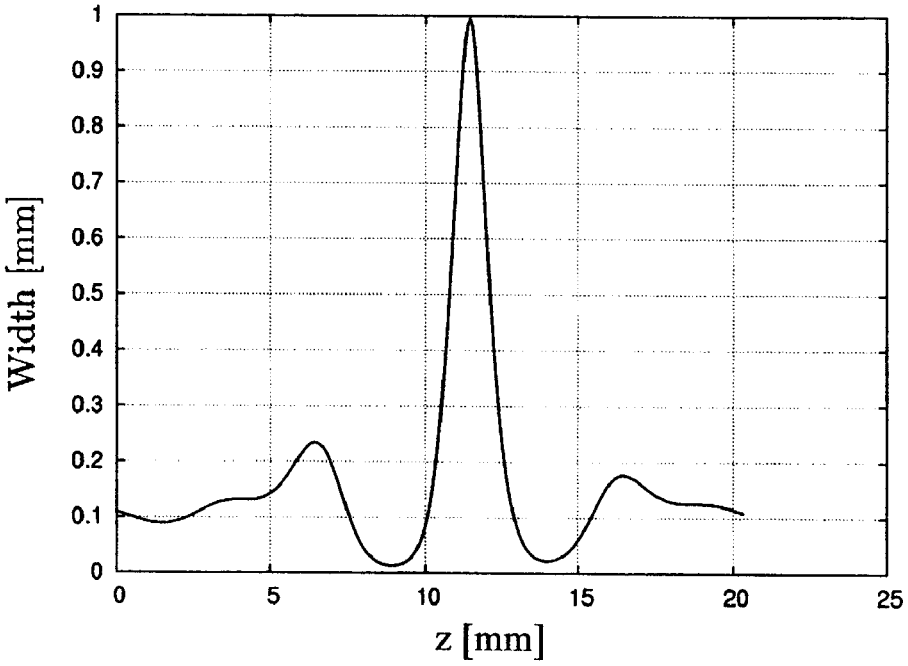
FIG. 20 is a graph showing the distribution of the conductor width of the symmetric-type two-conductor coplanar strip in the reflection-type bandpass filter fabricated in Embodiment 4.

FIG. 20 shows the distribution in the z-axis direction of the conductor width w, when using a dielectric substrate 2 with a thickness h=1 mm and relative permittivity $\in_r$=40, and when the distance between conductors s=1 mm. Table 8 lists the conductor widths w.

TABLE 8

| Conductor widths | | | | | | | | | | | | |
|---|---|---|---|---|---|---|---|---|---|---|---|---|
| z(mm) | 0.00 | 0.07 | 0.13 | 0.20 | 0.27 | 0.34 | 0.40 | 0.47 | 0.54 | 0.61 | 0.67 | 0.74 |
| w(mm) | 0.11 | 0.11 | 0.11 | 0.11 | 0.10 | 0.10 | 0.10 | 0.10 | 0.10 | 0.10 | 0.10 | 0.10 |
| #2 | 0.81 | 0.88 | 0.94 | 1.01 | 1.08 | 1.15 | 1.21 | 1.28 | 1.35 | 1.42 | 1.48 | 1.55 |
| — | 0.10 | 0.09 | 0.09 | 0.09 | 0.09 | 0.09 | 0.09 | 0.09 | 0.09 | 0.09 | 0.09 | 0.09 |
| #3 | 1.62 | 1.68 | 1.75 | 1.82 | 1.89 | 1.95 | 2.02 | 2.09 | 2.16 | 2.22 | 2.29 | 2.36 |
| — | 0.09 | 0.09 | 0.09 | 0.09 | 0.09 | 0.09 | 0.09 | 0.09 | 0.10 | 0.10 | 0.10 | 0.10 |
| #4 | 2.43 | 2.49 | 2.56 | 2.63 | 2.70 | 2.76 | 2.83 | 2.90 | 2.97 | 3.03 | 3.10 | 3.17 |
| — | 0.10 | 0.10 | 0.11 | 0.11 | 0.11 | 0.11 | 0.11 | 0.12 | 0.12 | 0.12 | 0.12 | 0.12 |
| #5 | 3.24 | 3.30 | 3.37 | 3.44 | 3.51 | 3.57 | 3.64 | 3.71 | 3.78 | 3.84 | 3.91 | 3.98 |
| — | 0.12 | 0.13 | 0.13 | 0.13 | 0.13 | 0.13 | 0.13 | 0.13 | 0.13 | 0.13 | 0.13 | 0.13 |
| #6 | 4.05 | 4.11 | 4.18 | 4.25 | 4.32 | 4.39 | 4.45 | 4.52 | 4.59 | 4.66 | 4.72 | 4.79 |
| — | 0.13 | 0.13 | 0.13 | 0.13 | 0.13 | 0.13 | 0.13 | 0.13 | 0.13 | 0.13 | 0.13 | 0.14 |
| #7 | 4.86 | 4.93 | 4.99 | 5.06 | 5.13 | 5.20 | 5.26 | 5.33 | 5.40 | 5.47 | 5.54 | 5.60 |
| — | 0.14 | 0.14 | 0.14 | 0.15 | 0.15 | 0.15 | 0.16 | 0.16 | 0.16 | 0.17 | 0.17 | 0.18 |
| #8 | 5.67 | 5.74 | 5.81 | 5.88 | 5.94 | 6.01 | 6.08 | 6.15 | 6.22 | 6.29 | 6.35 | 6.42 |
| — | 0.19 | 0.19 | 0.20 | 0.20 | 0.21 | 0.21 | 0.22 | 0.22 | 0.23 | 0.23 | 0.23 | 0.23 |
| #9 | 6.49 | 6.56 | 6.63 | 6.69 | 6.76 | 6.83 | 6.90 | 6.97 | 7.04 | 7.10 | 7.17 | 7.24 |
| — | 0.23 | 0.23 | 0.23 | 0.23 | 0.22 | 0.21 | 0.20 | 0.19 | 0.18 | 0.17 | 0.16 | 0.15 |
| #10 | 7.31 | 7.37 | 7.44 | 7.51 | 7.58 | 7.64 | 7.71 | 7.78 | 7.84 | 7.91 | 7.98 | 8.05 |
| — | 0.14 | 0.13 | 0.12 | 0.11 | 0.09 | 0.08 | 0.08 | 0.07 | 0.06 | 0.05 | 0.05 | 0.04 |
| #11 | 8.11 | 8.18 | 8.25 | 8.31 | 8.38 | 8.45 | 8.51 | 8.58 | 8.65 | 8.72 | 8.78 | 8.85 |
| — | 0.04 | 0.03 | 0.03 | 0.02 | 0.02 | 0.02 | 0.02 | 0.02 | 0.02 | 0.01 | 0.01 | 0.01 |
| #12 | 8.92 | 8.98 | 9.05 | 9.12 | 9.18 | 9.25 | 9.32 | 9.38 | 9.45 | 9.52 | 9.58 | 9.65 |
| — | 0.01 | 0.01 | 0.01 | 0.01 | 0.02 | 0.02 | 0.02 | 0.02 | 0.02 | 0.03 | 0.03 | 0.04 |
| #13 | 9.72 | 9.79 | 9.85 | 9.92 | 9.99 | 10.06 | 10.12 | 10.19 | 10.26 | 10.33 | 10.39 | 10.46 |
| — | 0.04 | 0.05 | 0.06 | 0.07 | 0.08 | 0.10 | 0.12 | 0.14 | 0.16 | 0.19 | 0.22 | 0.26 |
| #14 | 10.53 | 10.60 | 10.67 | 10.74 | 10.81 | 10.88 | 10.95 | 11.02 | 11.10 | 11.17 | 11.24 | 11.32 |
| — | 0.30 | 0.34 | 0.39 | 0.45 | 0.51 | 0.57 | 0.64 | 0.71 | 0.78 | 0.85 | 0.91 | 0.95 |
| #15 | 11.39 | 11.47 | 11.54 | 11.62 | 11.69 | 11.76 | 11.84 | 11.91 | 11.98 | 12.05 | 12.12 | 12.19 |
| — | 0.98 | 0.99 | 0.98 | 0.95 | 0.91 | 0.85 | 0.78 | 0.71 | 0.65 | 0.58 | 0.52 | 0.46 |

TABLE 8-continued

| Conductor widths | | | | | | | | | | | | |
|---|---|---|---|---|---|---|---|---|---|---|---|---|
| #16 | 12.26 | 12.33 | 12.40 | 12.47 | 12.54 | 12.60 | 12.67 | 12.74 | 12.81 | 12.88 | 12.94 | 13.01 |
| — | 0.40 | 0.35 | 0.31 | 0.27 | 0.23 | 0.20 | 0.18 | 0.15 | 0.13 | 0.11 | 0.10 | 0.08 |
| #17 | 13.08 | 13.14 | 13.21 | 13.28 | 13.35 | 13.41 | 13.48 | 13.55 | 13.61 | 13.68 | 13.75 | 13.81 |
| — | 0.07 | 0.06 | 0.05 | 0.05 | 0.04 | 0.04 | 0.03 | 0.03 | 0.03 | 0.03 | 0.03 | 0.02 |
| #18 | 13.88 | 13.95 | 14.02 | 14.08 | 14.15 | 14.22 | 14.28 | 14.35 | 14.42 | 14.48 | 14.55 | 14.62 |
| — | 0.02 | 0.02 | 0.02 | 0.02 | 0.02 | 0.02 | 0.03 | 0.03 | 0.03 | 0.03 | 0.03 | 0.04 |
| #19 | 14.68 | 14.75 | 14.82 | 14.89 | 14.95 | 15.02 | 15.09 | 15.15 | 15.22 | 15.29 | 15.36 | 15.42 |
| — | 0.04 | 0.04 | 0.05 | 0.05 | 0.06 | 0.06 | 0.07 | 0.07 | 0.08 | 0.09 | 0.09 | 0.10 |
| #20 | 15.49 | 15.56 | 15.63 | 15.69 | 15.76 | 15.83 | 15.90 | 15.97 | 16.03 | 16.10 | 16.17 | 16.24 |
| — | 0.11 | 0.12 | 0.12 | 0.13 | 0.14 | 0.15 | 0.15 | 0.16 | 0.16 | 0.17 | 0.17 | 0.17 |
| #21 | 16.30 | 16.37 | 16.44 | 16.51 | 16.58 | 16.64 | 16.71 | 16.78 | 16.85 | 16.92 | 16.98 | 17.05 |
| — | 0.17 | 0.18 | 0.18 | 0.18 | 0.18 | 0.17 | 0.17 | 0.17 | 0.17 | 0.17 | 0.16 | 0.16 |
| #22 | 17.12 | 17.19 | 17.25 | 17.32 | 17.39 | 17.46 | 17.53 | 17.59 | 17.66 | 17.73 | 17.80 | 17.86 |
| — | 0.16 | 0.15 | 0.15 | 0.15 | 0.15 | 0.14 | 0.14 | 0.14 | 0.14 | 0.14 | 0.13 | 0.13 |
| #23 | 17.93 | 18.00 | 18.07 | 18.13 | 18.20 | 18.27 | 18.34 | 18.40 | 18.47 | 18.54 | 18.61 | 18.67 |
| — | 0.13 | 0.13 | 0.13 | 0.13 | 0.13 | 0.13 | 0.13 | 0.13 | 0.13 | 0.13 | 0.13 | 0.13 |
| #24 | 18.74 | 18.81 | 18.88 | 18.94 | 19.01 | 19.08 | 19.15 | 19.21 | 19.28 | 19.35 | 19.42 | 19.48 |
| — | 0.13 | 0.13 | 0.13 | 0.13 | 0.13 | 0.13 | 0.13 | 0.12 | 0.12 | 0.12 | 0.12 | 0.12 |
| #25 | 19.55 | 19.62 | 19.69 | 19.76 | 19.82 | 19.89 | 19.96 | 20.03 | 20.09 | 20.16 | 20.23 | 20.30 |
| — | 0.12 | 0.12 | 0.12 | 0.12 | 0.12 | 0.12 | 0.12 | 0.11 | 0.11 | 0.11 | 0.11 | 0.11 |
| #26 | 20.36 | | | | | | | | | | | |
| — | 0.11 | | | | | | | | | | | |

Figure 21:
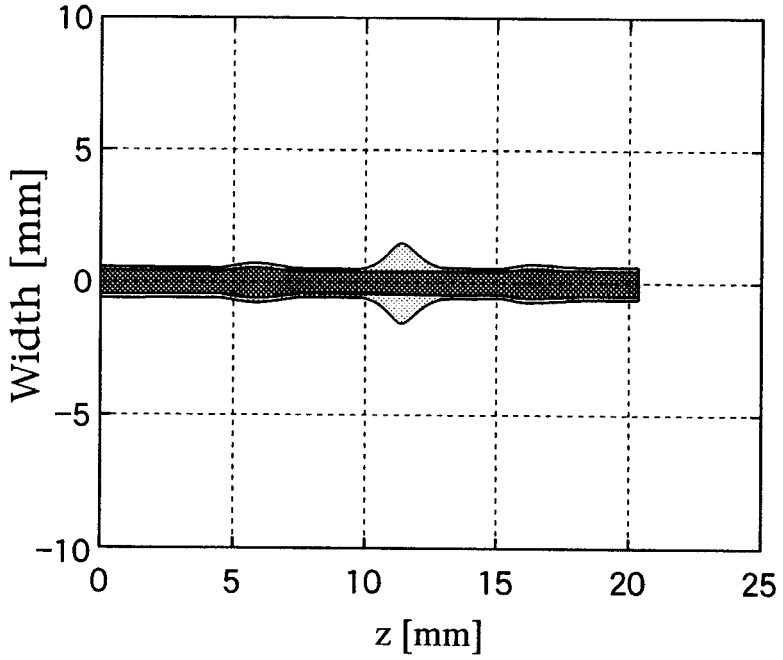
FIG. 21 is a graph showing the shape of the symmetric-type two-conductor coplanar strip in the reflection-type bandpass filter fabricated in Embodiment 4.
Figure 22:
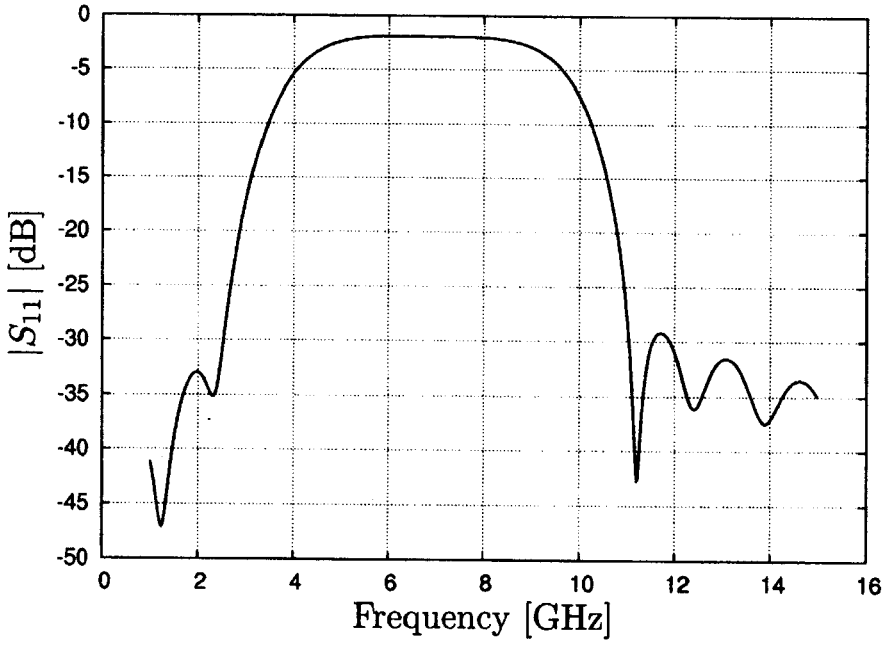
FIG. 22 is a graph showing the reflected wave amplitude characteristic in the reflection-type bandpass filter fabricated in Embodiment 4.
Figure 23:
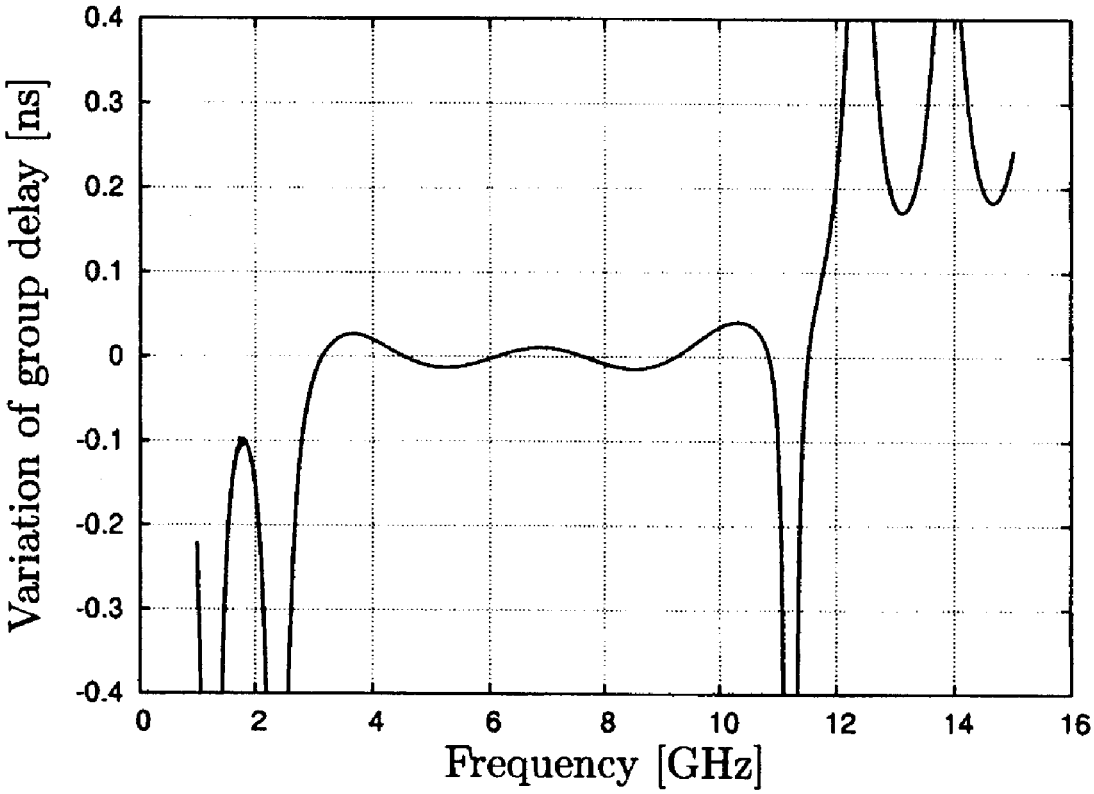
FIG. 23 is a graph showing the reflected wave group delay characteristic in the reflection-type bandpass filter fabricated in Embodiment 4.

FIG. 21 shows the shape of the conductors in the reflection-type bandpass filter 1 of Embodiment 4. In the figure, the lightly shaded portion represents the conductors 3 and 4, and the heavily shaded portion represents the non-conducting portion 5. A non-reflecting terminator, or an R=100Ω resistance, is provided on the terminating side (the face at z=20.36 mm) of this reflection-type bandpass filter 1. The thicknesses of the metal films of the conductors 3 and 4 are to be thick compared with the skin depth at f=1 GHz. For example, when using copper, the thickness of the conductors 3 and 4 should be 2.1 μm or greater. This bandpass filter 1 is used in a system with a characteristic impedance of 100Ω.

FIG. 17 and FIG. 18 show the amplitude characteristic and group delay characteristic respectively of reflected waves ($S_{11}$) in the bandpass filter 1 of Embodiment 4. As shown in the figures, in the range of frequencies f for which 4.5 GHz≦f≦9.2 GHz, the reflectance is −5 dB or greater, and the group delay variation is within ±0.05 ns. In the region f<3.1 GHz or f>10.6 GHz, the reflectance is −20 dB or lower.

Figure 24:
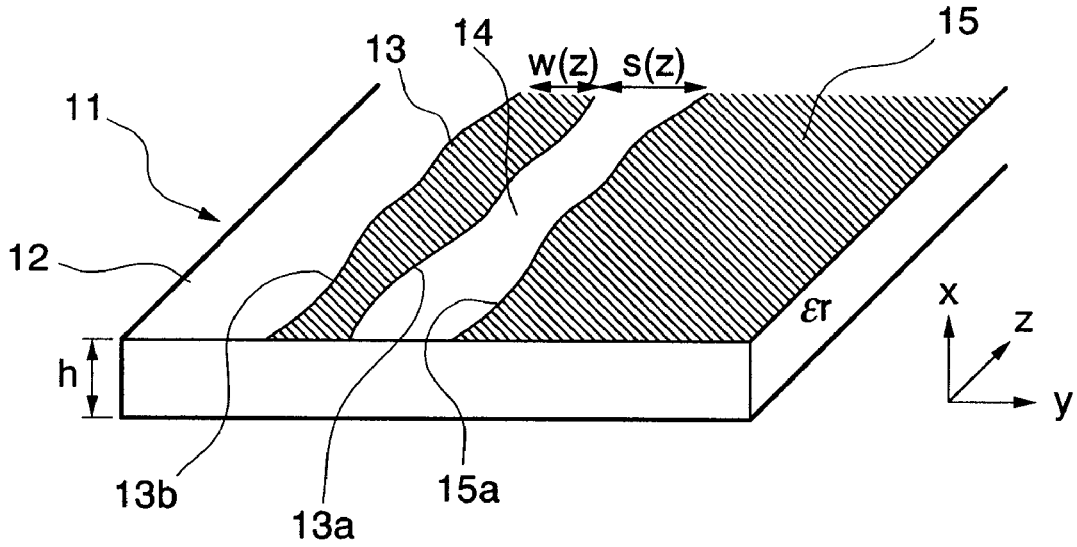
FIG. 24 is a perspective view showing one aspect of a reflection-type bandpass filter of the invention.

FIG. 24 is a perspective view showing in summary the configuration of a reflection-type bandpass filter of Embodiments 5 through 7. In the figure, the symbol 11 is the reflection-type bandpass filter, 12 is a dielectric substrate, 13 is a band-shaped conductor, 14 is a non-conducting portion, and 15 is a side conductor.

The reflection-type bandpass filter 11 comprises a dielectric substrate 12, a band-shaped conductor 13 provided on the surface of the dielectric substrate 12, and a side conductor 15 provided on one side of the band-shaped conductor 13 securing a prescribed distance between conductors with a non-conducting portion 14 intervening; and the band-shaped conductor width or the distance between conductors, or both, are distributed non-uniformly along the band-shaped conductor length direction.

As shown in FIG. 24, the z axis is taken along the length direction of the band-shaped conductor 13, the y axis is taken in the direction perpendicular to the z axis and parallel to the surface of the dielectric substrate 12, and the x axis is taken in the direction perpendicular to the y axis and to the z axis. The length extending in the z axis direction from the end face on the input end is z. The side edge of the band-shaped conductor 13 on the side in the z-axis direction of the non-conducting portion 14 is 13*a*, and the side edge on the other side is 13*b*. The side edge of the side conductor 15 in the z-axis direction on the side of the non-conducting portion 14 is 15*a*.

The reflection-type bandpass filter 11 has a configuration in which a non-uniform asymmetric-type two-conductor coplanar strip (a coplanar strip in which two conductors (the band-shaped conductor 13 and side conductor 15) are arranged asymmetrically and width of the conductors are distributed non-uniformly) is provided. In this reflection-type bandpass filter 11, the side conductor 15 is semi-infinite, or the width of the side conductor 15 is several times of the widths of the center conductor 13 and the non-conducting portion 14. Therefore, the side conductor 15 can be used in configuring a slot line, slot antenna, or similar. Moreover, compared with a uniform symmetric-type two-conductor coplanar strip (a coplanar strip in which two conductors are arranged symmetrically and width of the conductors are distributed uniformly), the characteristic impedance of the non-uniform asymmetric-type two-conductor coplanar strip is high.

Here, when either the width w of the band-shaped conductor 13 (hereafter the "band-shaped conductor width w") or the conductor-to-conductor distance between the band-shaped conductor 13 and the side conductor 15 (hereafter the "distance between conductors s" in the following Embodiments 5 through 7), or both, of the coplanar strip are varied, the characteristic impedance can be changed (see Reference 12 with respect to the characteristic impedance).

Figure 25:
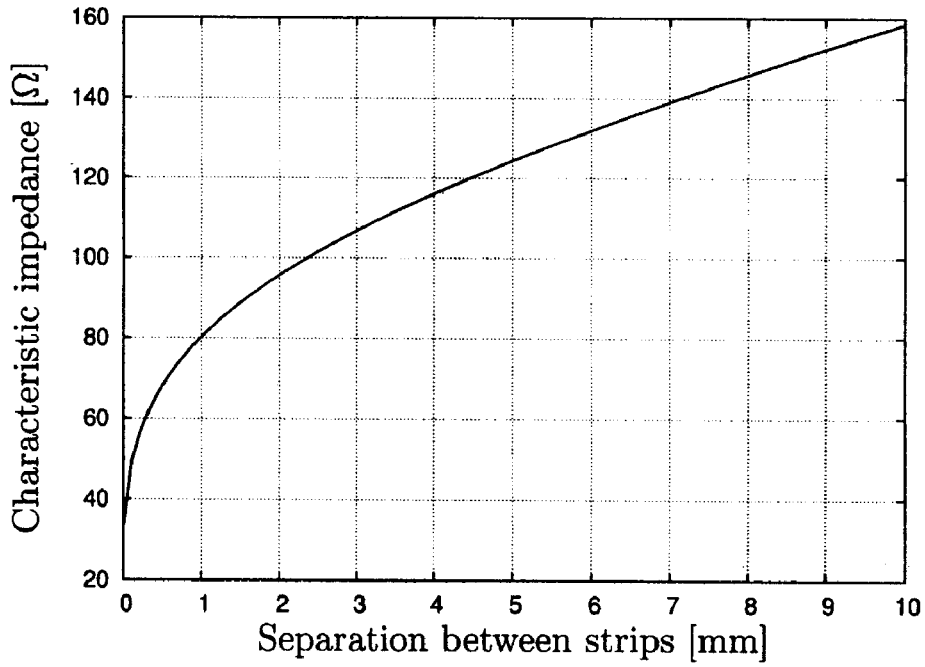
FIG. 25 is a graph showing the conductor-to-conductor distance dependence of the characteristic impedance in the coplanar strip.
Figure 26:
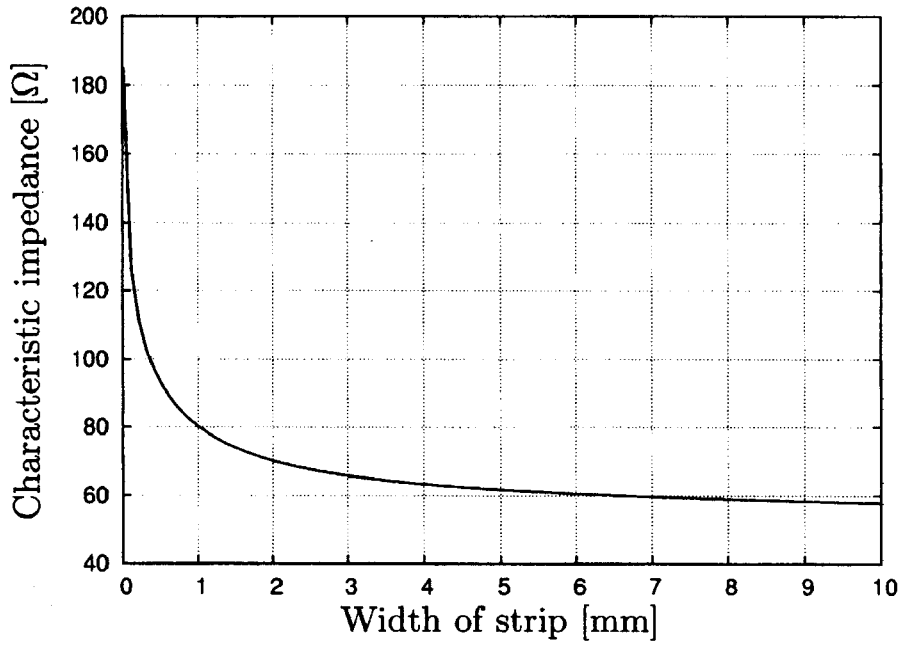
FIG. 26 is a graph showing the band-shaped conductor width dependence of the characteristic impedance in the coplanar strip.

FIG. 25 shows the dependence of the characteristic impedance on the distance between conductors s, when the band-shaped conductor width w=1 mm, the thickness h of the dielectric substrate 12 is 2 mm, and the relative permittivity $\in_r$ of the dielectric substrate 12 is 45. FIG. 26 shows the dependence of the characteristic impedance on the band-shaped conductor width w, when the distance between conductors s=1 mm, h=2 mm, and $\in_r$=45.

In this invention, the band-shaped conductor width w or distance between conductors s was calculated based on the local characteristic impedance obtained from equation (7), and a bandpass filter 11 was manufactured so as to satisfy the calculated band-shaped conductor width w or distance between conductors s. By this means, reflection-type band-pass filters 11 having the desired pass band were obtained.

Figure 27:
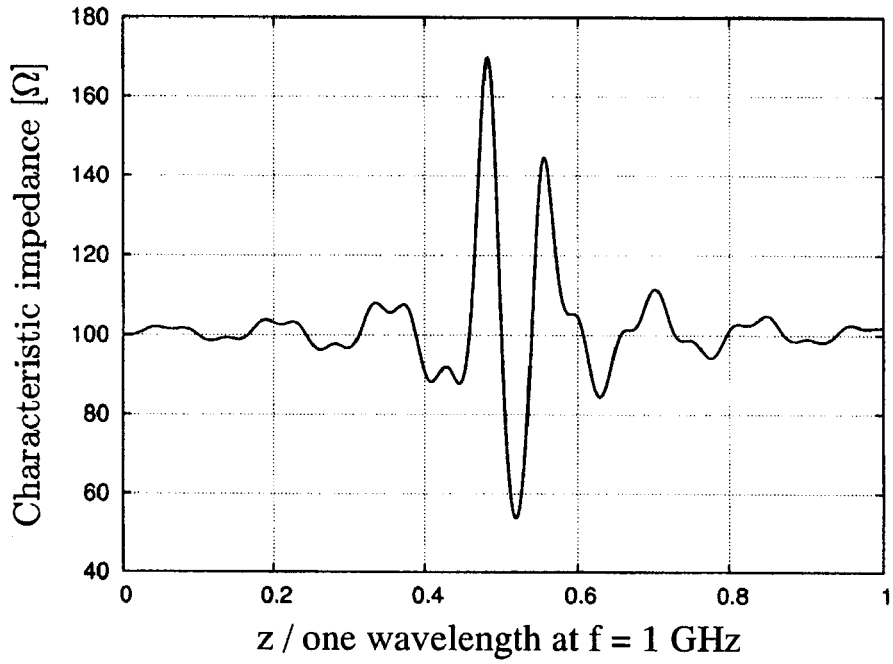
FIG. 27 is a graph showing the characteristic impedance distribution of the reflection-type bandpass filter fabricated in Embodiment 5.

A Kaiser window was used for which the reflectance is 0.8 at frequencies f in the range 3.4 GHz≦f≦10.3 GHz, and is 0 elsewhere, and for which A=30. Design was performed using one wavelength of signals at frequency f=1 GHz propagating in the coplanar strip as the waveguide length, and setting the system characteristic impedance to 100Ω. FIG. 27 shows the distribution in the z-axis direction of the local characteristic impedance obtained in the inverse problem. The horizontal axis is z divided by one wavelength at f=1 GHz; similar axes are used in FIG. 34 and FIG. 41 below.

Figure 28:
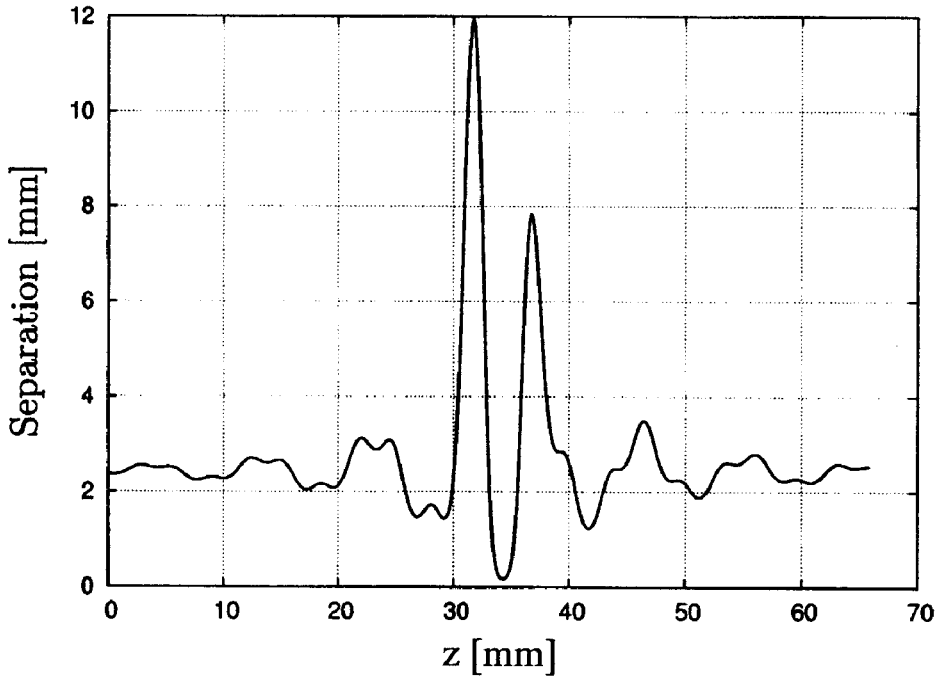
FIG. 28 is a graph showing the distribution of the distance between conductors of the coplanar strip in the reflection-type bandpass filter fabricated in Embodiment 5.

FIG. 28 shows the distribution in the z-axis direction of the distance between conductors s, when using a dielectric substrate 12 with a thickness h=2 mm and relative permittivity $\in_r$=45, and when the band-shaped conductor width w=2 mm. Tables 9 through 11 list the distances between conductors s.

TABLE 9

Distances between conductors (1/3)

| z(mm) | 0.00 | 0.07 | 0.13 | 0.20 | 0.26 | 0.33 | 0.39 | 0.46 | 0.52 | 0.59 | 0.65 | 0.72 |
|---|---|---|---|---|---|---|---|---|---|---|---|---|
| s(mm) | 2.37 | 2.37 | 2.37 | 2.37 | 2.37 | 2.36 | 2.36 | 2.36 | 2.36 | 2.36 | 2.37 | 2.37 |
| #2 | 0.79 | 0.85 | 0.92 | 0.98 | 1.05 | 1.11 | 1.18 | 1.24 | 1.31 | 1.38 | 1.44 | 1.51 |
| — | 2.37 | 2.37 | 2.37 | 2.38 | 2.38 | 2.39 | 2.39 | 2.40 | 2.40 | 2.41 | 2.42 | 2.43 |
| #3 | 1.57 | 1.64 | 1.70 | 1.77 | 1.83 | 1.90 | 1.97 | 2.03 | 2.10 | 2.16 | 2.23 | 2.29 |
| — | 2.44 | 2.44 | 2.45 | 2.46 | 2.47 | 2.48 | 2.49 | 2.50 | 2.50 | 2.51 | 2.52 | 2.53 |
| #4 | 2.36 | 2.43 | 2.49 | 2.56 | 2.62 | 2.69 | 2.75 | 2.82 | 2.89 | 2.95 | 3.02 | 3.08 |
| — | 2.53 | 2.54 | 2.54 | 2.55 | 2.55 | 2.55 | 2.55 | 2.55 | 2.55 | 2.55 | 2.55 | 2.55 |
| #5 | 3.15 | 3.21 | 3.28 | 3.35 | 3.41 | 3.48 | 3.54 | 3.61 | 3.67 | 3.74 | 3.81 | 3.87 |
| — | 2.55 | 2.55 | 2.54 | 2.54 | 2.54 | 2.53 | 2.53 | 2.53 | 2.52 | 2.52 | 2.51 | 2.51 |
| #6 | 3.94 | 4.00 | 4.07 | 4.13 | 4.20 | 4.27 | 4.33 | 4.40 | 4.46 | 4.53 | 4.59 | 4.66 |
| — | 2.51 | 2.51 | 2.50 | 2.50 | 2.50 | 2.50 | 2.50 | 2.50 | 2.50 | 2.50 | 2.51 | 2.51 |
| #7 | 4.73 | 4.79 | 4.86 | 4.92 | 4.99 | 5.05 | 5.12 | 5.19 | 5.25 | 5.32 | 5.38 | 5.45 |
| — | 2.51 | 2.51 | 2.52 | 2.52 | 2.52 | 2.52 | 2.52 | 2.52 | 2.52 | 2.52 | 2.52 | 2.52 |
| #8 | 5.51 | 5.58 | 5.65 | 5.71 | 5.78 | 5.84 | 5.91 | 5.97 | 6.04 | 6.10 | 6.17 | 6.24 |
| — | 2.52 | 2.52 | 2.51 | 2.51 | 2.50 | 2.49 | 2.49 | 2.48 | 2.47 | 2.46 | 2.45 | 2.44 |
| #9 | 6.30 | 6.37 | 6.43 | 6.50 | 6.56 | 6.63 | 6.69 | 6.76 | 6.83 | 6.89 | 6.96 | 7.02 |
| — | 2.42 | 2.41 | 2.40 | 2.39 | 2.37 | 2.36 | 2.35 | 2.33 | 2.32 | 2.31 | 2.30 | 2.29 |
| #10 | 7.09 | 7.15 | 7.22 | 7.28 | 7.35 | 7.41 | 7.48 | 7.54 | 7.61 | 7.67 | 7.74 | 7.81 |
| — | 2.28 | 2.27 | 2.26 | 2.26 | 2.25 | 2.25 | 2.25 | 2.24 | 2.24 | 2.24 | 2.24 | 2.24 |
| #11 | 7.87 | 7.94 | 8.00 | 8.07 | 8.13 | 8.20 | 8.26 | 8.33 | 8.39 | 8.46 | 8.52 | 8.59 |
| — | 2.25 | 2.25 | 2.25 | 2.26 | 2.26 | 2.26 | 2.27 | 2.27 | 2.28 | 2.28 | 2.29 | 2.29 |
| #12 | 8.66 | 8.72 | 8.79 | 8.85 | 8.92 | 8.98 | 9.05 | 9.11 | 9.18 | 9.24 | 9.31 | 9.37 |
| — | 2.30 | 2.30 | 2.30 | 2.31 | 2.31 | 2.31 | 2.31 | 2.31 | 2.31 | 2.31 | 2.30 | 2.30 |
| #13 | 9.44 | 9.51 | 9.57 | 9.64 | 9.70 | 9.77 | 9.83 | 9.90 | 9.96 | 10.03 | 10.09 | 10.16 |
| — | 2.30 | 2.29 | 2.29 | 2.29 | 2.28 | 2.28 | 2.28 | 2.28 | 2.27 | 2.27 | 2.27 | 2.28 |
| #14 | 10.22 | 10.29 | 10.36 | 10.42 | 10.49 | 10.55 | 10.62 | 10.68 | 10.75 | 10.81 | 10.88 | 10.94 |
| — | 2.28 | 2.28 | 2.29 | 2.29 | 2.30 | 2.31 | 2.32 | 2.33 | 2.34 | 2.35 | 2.37 | 2.39 |
| #15 | 11.01 | 11.08 | 11.14 | 11.21 | 11.27 | 11.34 | 11.40 | 11.47 | 11.53 | 11.60 | 11.67 | 11.73 |
| — | 2.40 | 2.42 | 2.44 | 2.46 | 2.48 | 2.50 | 2.52 | 2.54 | 2.56 | 2.58 | 2.60 | 2.61 |
| #16 | 11.80 | 11.86 | 11.93 | 12.00 | 12.06 | 12.13 | 12.19 | 12.26 | 12.33 | 12.39 | 12.46 | 12.52 |
| — | 2.63 | 2.64 | 2.66 | 2.67 | 2.68 | 2.69 | 2.70 | 2.70 | 2.71 | 2.71 | 2.71 | 2.71 |
| #17 | 12.59 | 12.66 | 12.72 | 12.79 | 12.85 | 12.92 | 12.98 | 13.05 | 13.12 | 13.18 | 13.25 | 13.31 |
| — | 2.71 | 2.70 | 2.70 | 2.69 | 2.69 | 2.68 | 2.67 | 2.66 | 2.66 | 2.65 | 2.64 | 2.63 |
| #18 | 13.38 | 13.45 | 13.51 | 13.58 | 13.64 | 13.71 | 13.78 | 13.84 | 13.91 | 13.97 | 14.04 | 14.10 |
| — | 2.63 | 2.62 | 2.61 | 2.61 | 2.61 | 2.61 | 2.61 | 2.61 | 2.61 | 2.61 | 2.61 | 2.62 |
| #19 | 14.17 | 14.24 | 14.30 | 14.37 | 14.43 | 14.50 | 14.57 | 14.63 | 14.70 | 14.76 | 14.83 | 14.89 |
| — | 2.62 | 2.63 | 2.63 | 2.64 | 2.64 | 2.65 | 2.66 | 2.66 | 2.66 | 2.67 | 2.67 | 2.67 |
| #20 | 14.96 | 15.03 | 15.09 | 15.16 | 15.22 | 15.29 | 15.36 | 15.42 | 15.49 | 15.55 | 15.62 | 15.68 |
| — | 2.67 | 2.66 | 2.66 | 2.65 | 2.64 | 2.63 | 2.61 | 2.60 | 2.58 | 2.56 | 2.53 | 2.51 |
| #21 | 15.75 | 15.82 | 15.88 | 15.95 | 16.01 | 16.08 | 16.14 | 16.21 | 16.27 | 16.34 | 16.40 | 16.47 |
| — | 2.49 | 2.46 | 2.43 | 2.40 | 2.38 | 2.35 | 2.32 | 2.29 | 2.26 | 2.24 | 2.21 | 2.19 |
| #22 | 16.54 | 16.60 | 16.67 | 16.73 | 16.80 | 16.86 | 16.93 | 16.99 | 17.06 | 17.12 | 17.19 | 17.25 |
| — | 2.17 | 2.15 | 2.13 | 2.11 | 2.10 | 2.08 | 2.07 | 2.06 | 2.06 | 2.05 | 2.05 | 2.05 |
| #23 | 17.32 | 17.38 | 17.45 | 17.51 | 17.58 | 17.64 | 17.71 | 17.77 | 17.84 | 17.90 | 17.97 | 18.03 |
| — | 2.05 | 2.05 | 2.06 | 2.06 | 2.07 | 2.08 | 2.09 | 2.09 | 2.10 | 2.11 | 2.12 | 2.13 |
| #24 | 18.10 | 18.16 | 18.23 | 18.29 | 18.36 | 18.42 | 18.49 | 18.55 | 18.62 | 18.68 | 18.75 | 18.82 |
| — | 2.14 | 2.15 | 2.16 | 2.16 | 2.17 | 2.17 | 2.17 | 2.17 | 2.17 | 2.17 | 2.16 | 2.16 |
| #25 | 18.88 | 18.95 | 19.01 | 19.08 | 19.14 | 19.21 | 19.27 | 19.34 | 19.40 | 19.47 | 19.53 | 19.60 |
| — | 2.15 | 2.15 | 2.14 | 2.13 | 2.12 | 2.11 | 2.11 | 2.10 | 2.09 | 2.09 | 2.09 | 2.08 |
| #26 | 19.66 | 19.73 | 19.79 | 19.86 | 19.92 | 19.99 | 20.05 | 20.12 | 20.18 | 20.25 | 20.31 | 20.38 |
| — | 2.08 | 2.09 | 2.09 | 2.10 | 2.11 | 2.12 | 2.14 | 2.16 | 2.18 | 2.20 | 2.23 | 2.26 |
| #27 | 20.44 | 20.51 | 20.58 | 20.64 | 20.71 | 20.77 | 20.84 | 20.90 | 20.97 | 21.04 | 21.10 | 21.17 |
| — | 2.30 | 2.33 | 2.37 | 2.41 | 2.46 | 2.50 | 2.55 | 2.60 | 2.65 | 2.69 | 2.74 | 2.79 |
| #28 | 21.23 | 21.30 | 21.37 | 21.43 | 21.50 | 21.57 | 21.63 | 21.70 | 21.76 | 21.83 | 21.90 | 21.96 |
| — | 2.83 | 2.88 | 2.92 | 2.96 | 2.99 | 3.02 | 3.05 | 3.07 | 3.09 | 3.11 | 3.12 | 3.12 |
| #29 | 22.03 | 22.10 | 22.16 | 22.23 | 22.30 | 22.36 | 22.43 | 22.50 | 22.56 | 22.63 | 22.70 | 22.76 |
| — | 3.13 | 3.12 | 3.12 | 3.11 | 3.09 | 3.08 | 3.06 | 3.04 | 3.02 | 3.01 | 2.99 | 2.97 |
| #30 | 22.83 | 22.89 | 22.96 | 23.03 | 23.09 | 23.16 | 23.23 | 23.29 | 23.36 | 23.42 | 23.49 | 23.56 |
| — | 2.95 | 2.93 | 2.92 | 2.90 | 2.89 | 2.89 | 2.88 | 2.88 | 2.88 | 2.89 | 2.89 | 2.90 |

TABLE 10

| Distances between conductors (2/3) | | | | | | | | | | | | |
|---|---|---|---|---|---|---|---|---|---|---|---|---|
| #31 | 23.62 | 23.69 | 23.76 | 23.82 | 23.89 | 23.95 | 24.02 | 24.09 | 24.15 | 24.22 | 24.29 | 24.35 |
| — | 2.91 | 2.93 | 2.94 | 2.96 | 2.98 | 3.00 | 3.02 | 3.03 | 3.05 | 3.06 | 3.08 | 3.08 |
| #32 | 24.42 | 24.49 | 24.55 | 24.62 | 24.69 | 24.75 | 24.82 | 24.88 | 24.95 | 25.02 | 25.08 | 25.15 |
| — | 3.09 | 3.09 | 3.08 | 3.07 | 3.05 | 3.03 | 3.00 | 2.96 | 2.92 | 2.87 | 2.81 | 2.75 |
| #33 | 25.22 | 25.28 | 25.35 | 25.41 | 25.48 | 25.54 | 25.61 | 25.67 | 25.74 | 25.80 | 25.87 | 25.93 |
| — | 2.69 | 2.62 | 2.55 | 2.47 | 2.40 | 2.32 | 2.25 | 2.17 | 2.10 | 2.03 | 1.96 | 1.90 |
| #34 | 26.00 | 26.06 | 26.13 | 26.19 | 26.26 | 26.32 | 26.39 | 26.45 | 26.52 | 26.58 | 26.64 | 26.71 |
| — | 1.84 | 1.78 | 1.73 | 1.68 | 1.64 | 1.60 | 1.56 | 1.54 | 1.51 | 1.49 | 1.48 | 1.47 |
| #35 | 26.77 | 26.84 | 26.90 | 26.97 | 27.03 | 27.09 | 27.16 | 27.22 | 27.29 | 27.35 | 27.42 | 27.48 |
| — | 1.46 | 1.46 | 1.47 | 1.47 | 1.48 | 1.49 | 1.51 | 1.53 | 1.55 | 1.57 | 1.59 | 1.61 |
| #36 | 27.55 | 27.61 | 27.67 | 27.74 | 27.80 | 27.87 | 27.93 | 28.00 | 28.06 | 28.13 | 28.19 | 28.26 |
| — | 1.63 | 1.65 | 1.67 | 1.69 | 1.70 | 1.72 | 1.72 | 1.73 | 1.73 | 1.72 | 1.72 | 1.71 |
| #37 | 28.32 | 28.39 | 28.45 | 28.51 | 28.58 | 28.64 | 28.71 | 28.77 | 28.84 | 28.90 | 28.97 | 29.03 |
| — | 1.69 | 1.67 | 1.65 | 1.63 | 1.60 | 1.58 | 1.55 | 1.53 | 1.50 | 1.48 | 1.46 | 1.45 |
| #38 | 29.09 | 29.16 | 29.22 | 29.29 | 29.35 | 29.42 | 29.48 | 29.54 | 29.61 | 29.67 | 29.74 | 29.80 |
| — | 1.44 | 1.43 | 1.43 | 1.44 | 1.46 | 1.48 | 1.52 | 1.56 | 1.62 | 1.69 | 1.78 | 1.88 |
| #39 | 29.87 | 29.93 | 30.00 | 30.06 | 30.13 | 30.20 | 30.26 | 30.33 | 30.40 | 30.47 | 30.54 | 30.61 |
| — | 2.00 | 2.15 | 2.32 | 2.51 | 2.74 | 2.99 | 3.28 | 3.60 | 3.97 | 4.36 | 4.80 | 5.27 |
| #40 | 30.68 | 30.75 | 30.82 | 30.89 | 30.97 | 31.04 | 31.12 | 31.20 | 31.27 | 31.35 | 31.43 | 31.51 |
| — | 5.77 | 6.30 | 6.85 | 7.43 | 8.01 | 8.59 | 9.16 | 9.72 | 10.23 | 10.71 | 11.12 | 11.46 |
| #41 | 31.59 | 31.67 | 31.75 | 31.83 | 31.91 | 31.99 | 32.07 | 32.15 | 32.23 | 32.30 | 32.38 | 32.45 |
| — | 11.71 | 11.87 | 11.93 | 11.88 | 11.73 | 11.47 | 11.11 | 10.65 | 10.11 | 9.51 | 8.85 | 8.16 |
| #42 | 32.53 | 32.60 | 32.67 | 32.74 | 32.81 | 32.88 | 32.94 | 33.01 | 33.07 | 33.14 | 33.20 | 33.27 |
| — | 7.44 | 6.71 | 5.98 | 5.28 | 4.61 | 3.98 | 3.40 | 2.87 | 2.41 | 2.00 | 1.66 | 1.37 |
| #43 | 33.33 | 33.40 | 33.46 | 33.52 | 33.59 | 33.65 | 33.71 | 33.78 | 33.84 | 33.90 | 33.97 | 34.03 |
| — | 1.13 | 0.93 | 0.77 | 0.64 | 0.54 | 0.45 | 0.38 | 0.33 | 0.29 | 0.25 | 0.22 | 0.20 |
| #44 | 34.09 | 34.15 | 34.22 | 34.28 | 34.34 | 34.41 | 34.47 | 34.53 | 34.60 | 34.66 | 34.72 | 34.78 |
| — | 0.19 | 0.18 | 0.17 | 0.17 | 0.17 | 0.17 | 0.18 | 0.19 | 0.21 | 0.23 | 0.26 | 0.29 |
| #45 | 34.85 | 34.91 | 34.97 | 35.04 | 35.10 | 35.16 | 35.23 | 35.29 | 35.36 | 35.42 | 35.49 | 35.55 |
| — | 0.34 | 0.39 | 0.46 | 0.54 | 0.63 | 0.75 | 0.89 | 1.06 | 1.26 | 1.50 | 1.77 | 2.08 |
| #46 | 35.62 | 35.68 | 35.75 | 35.82 | 35.88 | 35.95 | 36.02 | 36.09 | 36.16 | 36.23 | 36.31 | 36.38 |
| — | 2.42 | 2.80 | 3.21 | 3.65 | 4.10 | 4.56 | 5.02 | 5.47 | 5.90 | 6.31 | 6.68 | 7.00 |
| #47 | 36.45 | 36.53 | 36.60 | 36.67 | 36.75 | 36.82 | 36.90 | 36.97 | 37.04 | 37.12 | 37.19 | 37.26 |
| — | 7.28 | 7.50 | 7.67 | 7.78 | 7.83 | 7.82 | 7.77 | 7.66 | 7.51 | 7.32 | 7.10 | 6.85 |
| #48 | 37.33 | 37.40 | 37.48 | 37.55 | 37.62 | 37.69 | 37.76 | 37.82 | 37.89 | 37.96 | 38.03 | 38.10 |
| — | 6.59 | 6.32 | 6.04 | 5.75 | 5.48 | 5.20 | 4.94 | 4.69 | 4.46 | 4.24 | 4.05 | 3.86 |
| #49 | 38.16 | 38.23 | 38.30 | 38.37 | 38.43 | 38.50 | 38.56 | 38.63 | 38.70 | 38.76 | 38.83 | 38.90 |
| — | 3.70 | 3.55 | 3.42 | 3.31 | 3.21 | 3.13 | 3.06 | 3.00 | 2.95 | 2.91 | 2.89 | 2.87 |
| #50 | 38.96 | 39.03 | 39.09 | 39.16 | 39.23 | 39.29 | 39.36 | 39.43 | 39.49 | 39.56 | 39.62 | 39.69 |
| — | 2.86 | 2.85 | 2.84 | 2.84 | 2.84 | 2.85 | 2.85 | 2.84 | 2.84 | 2.83 | 2.82 | 2.80 |
| #51 | 39.76 | 39.82 | 39.89 | 39.95 | 40.02 | 40.09 | 40.15 | 40.22 | 40.28 | 40.35 | 40.41 | 40.48 |
| — | 2.77 | 2.74 | 2.70 | 2.65 | 2.60 | 2.54 | 2.47 | 2.40 | 2.33 | 2.25 | 2.17 | 2.09 |
| #52 | 40.54 | 40.61 | 40.67 | 40.74 | 40.80 | 40.87 | 40.93 | 41.00 | 41.06 | 41.12 | 41.19 | 41.25 |
| — | 2.01 | 1.93 | 1.86 | 1.78 | 1.71 | 1.64 | 1.58 | 1.52 | 1.47 | 1.42 | 1.38 | 1.34 |
| #53 | 41.32 | 41.38 | 41.44 | 41.51 | 41.57 | 41.64 | 41.70 | 41.76 | 41.83 | 41.89 | 41.96 | 42.02 |
| — | 1.31 | 1.28 | 1.26 | 1.24 | 1.23 | 1.23 | 1.23 | 1.23 | 1.24 | 1.26 | 1.28 | 1.30 |
| #54 | 42.09 | 42.15 | 42.21 | 42.28 | 42.34 | 42.41 | 42.47 | 42.54 | 42.60 | 42.67 | 42.73 | 42.80 |
| — | 1.33 | 1.36 | 1.40 | 1.44 | 1.49 | 1.54 | 1.59 | 1.65 | 1.71 | 1.77 | 1.83 | 1.89 |
| #55 | 42.86 | 42.93 | 42.99 | 43.06 | 43.12 | 43.19 | 43.25 | 43.32 | 43.38 | 43.45 | 43.51 | 43.58 |
| — | 1.95 | 2.01 | 2.07 | 2.12 | 2.17 | 2.22 | 2.27 | 2.31 | 2.35 | 2.38 | 2.41 | 2.43 |
| #56 | 43.64 | 43.71 | 43.78 | 43.84 | 43.91 | 43.97 | 44.04 | 44.10 | 44.17 | 44.24 | 44.30 | 44.37 |
| — | 2.45 | 2.46 | 2.47 | 2.48 | 2.49 | 2.49 | 2.49 | 2.49 | 2.49 | 2.48 | 2.48 | 2.48 |
| #57 | 44.43 | 44.50 | 44.56 | 44.63 | 44.69 | 44.76 | 44.83 | 44.89 | 44.96 | 45.02 | 45.09 | 45.16 |
| — | 2.49 | 2.49 | 2.50 | 2.51 | 2.52 | 2.54 | 2.56 | 2.58 | 2.61 | 2.64 | 2.68 | 2.71 |
| #58 | 45.22 | 45.29 | 45.35 | 45.42 | 45.49 | 45.55 | 45.62 | 45.69 | 45.75 | 45.82 | 45.89 | 45.95 |
| — | 2.76 | 2.80 | 2.85 | 2.90 | 2.95 | 3.01 | 3.06 | 3.12 | 3.17 | 3.22 | 3.27 | 3.32 |
| #59 | 46.02 | 46.09 | 46.15 | 46.22 | 46.29 | 46.35 | 46.42 | 46.49 | 46.56 | 46.62 | 46.69 | 46.76 |
| — | 3.36 | 3.40 | 3.43 | 3.46 | 3.48 | 3.50 | 3.50 | 3.50 | 3.50 | 3.48 | 3.46 | 3.43 |
| #60 | 46.82 | 46.89 | 46.96 | 47.02 | 47.09 | 47.16 | 47.22 | 47.29 | 47.36 | 47.42 | 47.49 | 47.56 |
| — | 3.40 | 3.36 | 3.32 | 3.27 | 3.21 | 3.16 | 3.10 | 3.04 | 2.98 | 2.92 | 2.86 | 2.80 |

TABLE 11

| Distances between conductors (3/3) | | | | | | | | | | | | |
|---|---|---|---|---|---|---|---|---|---|---|---|---|
| #61 | 47.62 | 47.69 | 47.75 | 47.82 | 47.89 | 47.95 | 48.02 | 48.08 | 48.15 | 48.21 | 48.28 | 48.34 |
| — | 2.74 | 2.69 | 2.63 | 2.58 | 2.54 | 2.49 | 2.45 | 2.42 | 2.39 | 2.36 | 2.33 | 2.31 |
| #62 | 48.41 | 48.47 | 48.54 | 48.61 | 48.67 | 48.74 | 48.80 | 48.87 | 48.93 | 49.00 | 49.06 | 49.13 |
| — | 2.29 | 2.28 | 2.27 | 2.26 | 2.25 | 2.25 | 2.24 | 2.24 | 2.24 | 2.25 | 2.25 | 2.25 |
| #63 | 49.19 | 49.26 | 49.32 | 49.39 | 49.45 | 49.52 | 49.59 | 49.65 | 49.72 | 49.78 | 49.85 | 49.91 |
| — | 2.25 | 2.26 | 2.26 | 2.26 | 2.26 | 2.25 | 2.25 | 2.25 | 2.24 | 2.23 | 2.22 | 2.20 |
| #64 | 49.98 | 50.04 | 50.11 | 50.17 | 50.24 | 50.30 | 50.37 | 50.43 | 50.50 | 50.56 | 50.63 | 50.69 |
| — | 2.19 | 2.17 | 2.16 | 2.14 | 2.12 | 2.10 | 2.07 | 2.05 | 2.03 | 2.01 | 1.99 | 1.97 |

TABLE 11-continued

| Distances between conductors (3/3) | | | | | | | | | | | | |
|---|---|---|---|---|---|---|---|---|---|---|---|---|
| #65 | 50.76 | 50.82 | 50.89 | 50.95 | 51.02 | 51.08 | 51.15 | 51.21 | 51.28 | 51.34 | 51.41 | 51.47 |
| — | 1.96 | 1.94 | 1.93 | 1.91 | 1.90 | 1.90 | 1.89 | 1.89 | 1.89 | 1.89 | 1.89 | 1.90 |
| #66 | 51.54 | 51.60 | 51.67 | 51.73 | 51.80 | 51.86 | 51.93 | 51.99 | 52.06 | 52.12 | 52.19 | 52.25 |
| — | 1.91 | 1.93 | 1.94 | 1.96 | 1.98 | 2.01 | 2.03 | 2.06 | 2.09 | 2.12 | 2.15 | 2.18 |
| #67 | 52.32 | 52.38 | 52.45 | 52.51 | 52.58 | 52.64 | 52.71 | 52.78 | 52.84 | 52.91 | 52.97 | 53.04 |
| — | 2.22 | 2.25 | 2.29 | 2.32 | 2.35 | 2.38 | 2.41 | 2.44 | 2.47 | 2.50 | 2.52 | 2.54 |
| #68 | 53.10 | 53.17 | 53.24 | 53.30 | 53.37 | 53.43 | 53.50 | 53.56 | 53.63 | 53.70 | 53.76 | 53.83 |
| — | 2.56 | 2.57 | 2.59 | 2.60 | 2.61 | 2.61 | 2.62 | 2.62 | 2.62 | 2.62 | 2.62 | 2.61 |
| #69 | 53.89 | 53.96 | 54.03 | 54.09 | 54.16 | 54.22 | 54.29 | 54.35 | 54.42 | 54.49 | 54.55 | 54.62 |
| — | 2.61 | 2.61 | 2.60 | 2.60 | 2.59 | 2.59 | 2.59 | 2.59 | 2.59 | 2.59 | 2.59 | 2.59 |
| #70 | 54.68 | 54.75 | 54.82 | 54.88 | 54.95 | 55.01 | 55.08 | 55.14 | 55.21 | 55.28 | 55.34 | 55.41 |
| — | 2.60 | 2.61 | 2.61 | 2.62 | 2.63 | 2.64 | 2.66 | 2.67 | 2.68 | 2.70 | 2.71 | 2.73 |
| #71 | 55.47 | 55.54 | 55.61 | 55.67 | 55.74 | 55.80 | 55.87 | 55.94 | 56.00 | 56.07 | 56.13 | 56.20 |
| — | 2.74 | 2.75 | 2.76 | 2.78 | 2.79 | 2.79 | 2.80 | 2.81 | 2.81 | 2.81 | 2.81 | 2.80 |
| #72 | 56.27 | 56.33 | 56.40 | 56.47 | 56.53 | 56.60 | 56.66 | 56.73 | 56.79 | 56.86 | 56.93 | 56.99 |
| — | 2.79 | 2.78 | 2.77 | 2.76 | 2.74 | 2.72 | 2.70 | 2.68 | 2.66 | 2.63 | 2.61 | 2.58 |
| #73 | 57.06 | 57.12 | 57.19 | 57.26 | 57.32 | 57.39 | 57.45 | 57.52 | 57.58 | 57.65 | 57.71 | 57.78 |
| — | 2.56 | 2.53 | 2.50 | 2.48 | 2.45 | 2.43 | 2.40 | 2.38 | 2.36 | 2.34 | 2.32 | 2.31 |
| #74 | 57.84 | 57.91 | 57.98 | 58.04 | 58.11 | 58.17 | 58.24 | 58.30 | 58.37 | 58.43 | 58.50 | 58.56 |
| — | 2.29 | 2.28 | 2.27 | 2.26 | 2.25 | 2.24 | 2.24 | 2.23 | 2.23 | 2.23 | 2.23 | 2.23 |
| #75 | 58.63 | 58.69 | 58.76 | 58.82 | 58.89 | 58.96 | 59.02 | 59.09 | 59.15 | 59.22 | 59.28 | 59.35 |
| — | 2.24 | 2.24 | 2.24 | 2.25 | 2.25 | 2.26 | 2.26 | 2.27 | 2.27 | 2.27 | 2.28 | 2.28 |
| #76 | 59.41 | 59.48 | 59.54 | 59.61 | 59.67 | 59.74 | 59.80 | 59.87 | 59.94 | 60.00 | 60.07 | 60.13 |
| — | 2.28 | 2.28 | 2.28 | 2.28 | 2.28 | 2.28 | 2.27 | 2.27 | 2.26 | 2.26 | 2.25 | 2.25 |
| #77 | 60.20 | 60.26 | 60.33 | 60.39 | 60.46 | 60.52 | 60.59 | 60.65 | 60.72 | 60.78 | 60.85 | 60.91 |
| — | 2.24 | 2.24 | 2.23 | 2.22 | 2.22 | 2.21 | 2.21 | 2.21 | 2.21 | 2.20 | 2.20 | 2.21 |
| #78 | 60.98 | 61.05 | 61.11 | 61.18 | 61.24 | 61.31 | 61.37 | 61.44 | 61.50 | 61.57 | 61.63 | 61.70 |
| — | 2.21 | 2.21 | 2.22 | 2.22 | 2.23 | 2.24 | 2.25 | 2.26 | 2.27 | 2.29 | 2.30 | 2.32 |
| #79 | 61.76 | 61.83 | 61.90 | 61.96 | 62.03 | 62.09 | 62.16 | 62.22 | 62.29 | 62.35 | 62.42 | 62.49 |
| — | 2.33 | 2.35 | 2.37 | 2.38 | 2.40 | 2.42 | 2.44 | 2.45 | 2.47 | 2.49 | 2.50 | 2.52 |
| #80 | 62.55 | 62.62 | 62.68 | 62.75 | 62.81 | 62.88 | 62.95 | 63.01 | 63.08 | 63.14 | 63.21 | 63.27 |
| — | 2.53 | 2.54 | 2.55 | 2.56 | 2.57 | 2.58 | 2.58 | 2.59 | 2.59 | 2.59 | 2.59 | 2.59 |
| #81 | 63.34 | 63.41 | 63.47 | 63.54 | 63.60 | 63.67 | 63.74 | 63.80 | 63.87 | 63.93 | 64.00 | 64.06 |
| — | 2.59 | 2.59 | 2.59 | 2.58 | 2.58 | 2.57 | 2.57 | 2.56 | 2.55 | 2.55 | 2.54 | 2.54 |
| #82 | 64.13 | 64.20 | 64.26 | 64.33 | 64.39 | 64.46 | 64.52 | 64.59 | 64.66 | 64.72 | 64.79 | 64.85 |
| — | 2.53 | 2.53 | 2.52 | 2.52 | 2.52 | 2.51 | 2.51 | 2.51 | 2.51 | 2.51 | 2.51 | 2.51 |
| #83 | 64.92 | 64.98 | 65.05 | 65.12 | 65.18 | 65.25 | 65.31 | 65.38 | 65.44 | 65.51 | 65.58 | 65.64 |
| — | 2.52 | 2.52 | 2.52 | 2.52 | 2.53 | 2.53 | 2.53 | 2.53 | 2.54 | 2.54 | 2.54 | 2.54 |
| #84 | 65.71 | 65.71 | 65.84 | 65.90 | 65.97 | | | | | | | |
| — | 2.54 | 2.54 | 2.53 | 2.53 | 2.53 | | | | | | | |

Figure 29:
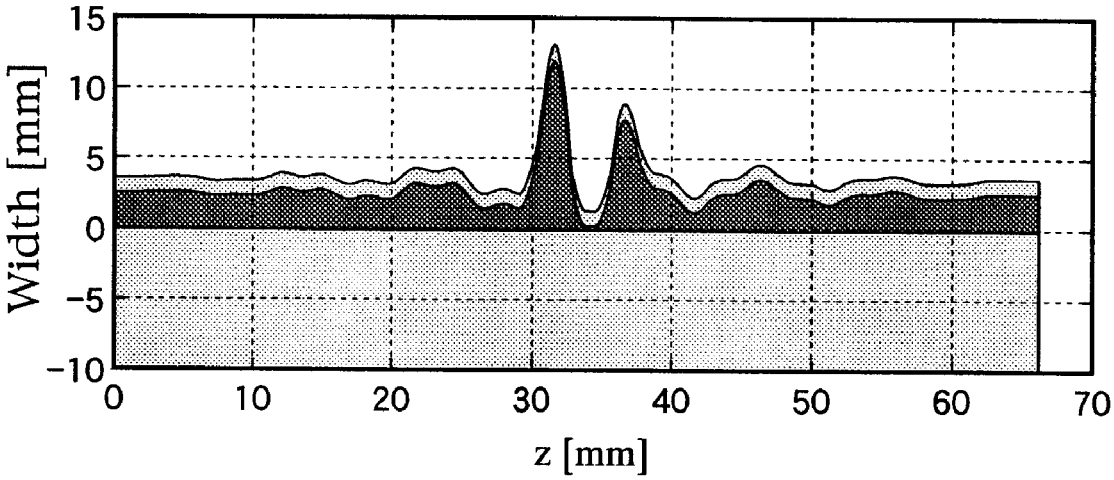
FIG. 29 is a graph showing the first shape of the coplanar strip in the reflection-type bandpass filter fabricated in Embodiment 5.
Figure 30:
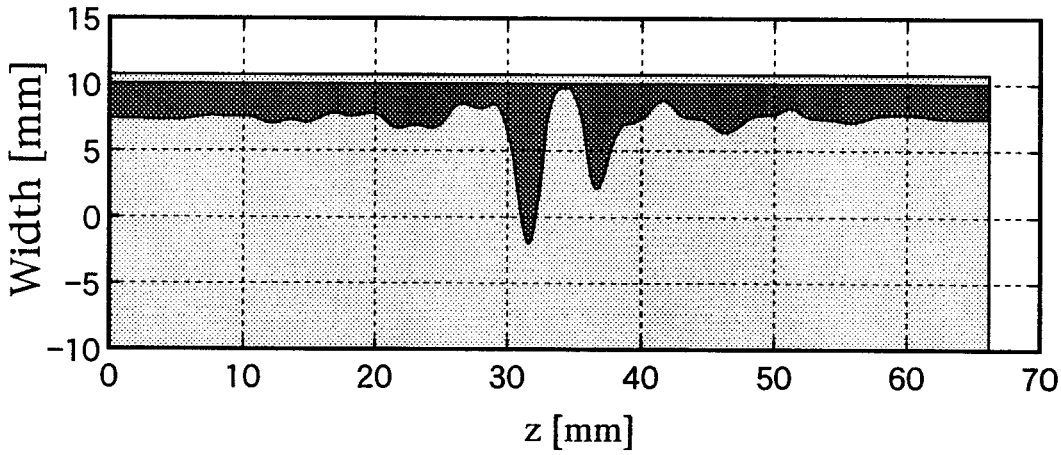
FIG. 30 is a graph showing the second shape of the coplanar strip in the reflection-type bandpass filter fabricated in Embodiment 5.
Figure 31:
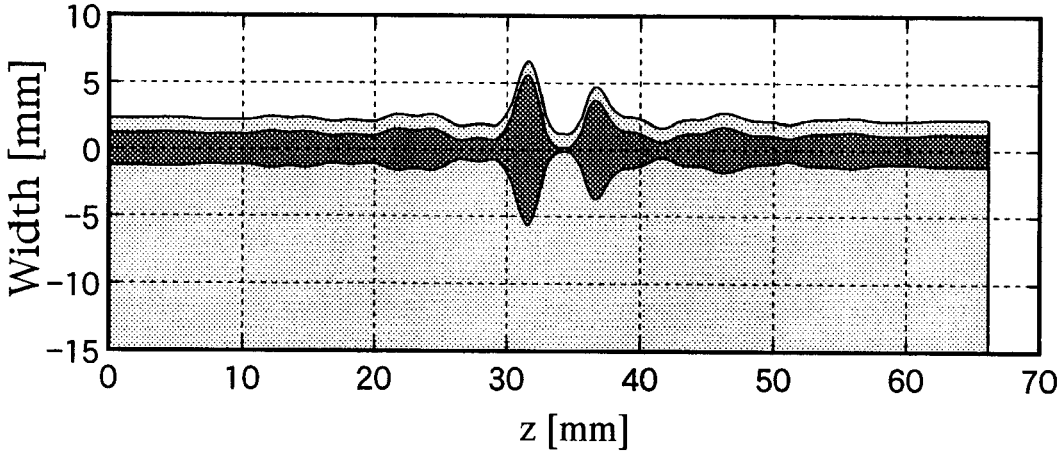
FIG. 31 is a graph showing the third shape of the coplanar strip in the reflection-type bandpass filter fabricated in Embodiment 5.

FIG. 29 to FIG. 31 show the shapes of the coplanar strip in the reflection-type bandpass filter 11 of Embodiment 5. In the figures, the lightly shaded portion represents the band-shaped conductor 13 and the side conductor 15, and the heavily shaded portion represents the non-conducting portion 14. In FIG. 29, a coplanar strip is formed with the side edge 15*a* of the side conductor 15 made a straight line, and with both side edges 13*a*, 13*b* of the band-shaped conductor 13 changed such that the distance between conductors s takes on calculated values and the band-shaped conductor width w=1 mm. In FIG. 30, a coplanar strip is formed with both side edges 13*a* and 13*b* of the band-shaped conductor 13 made a straight line, and with the side edge 15*a* of the side conductor 15 changed such that the distance between conductors s takes on calculated values. In FIG. 31, a coplanar strip is formed with the side edge 13*a* of the band-shaped conductor 13 and the side edge 15*a* of the side conductor 15 varied such that the distance between conductors s takes on calculated values, and so as to be symmetrical with respect to the center line of the non-conducting portion 14. A non-reflecting terminator, or an R=100Ω resistance, is provided on the terminating side (the face at z=5.97 mm) of this reflection-type bandpass filter 11. The thicknesses of the metal films of the band-shaped conductor 13 and of the side conductor 15 are to be thick compared with the skin depth at f=1 GHz, $\delta s=\sqrt{\{2/(\omega\mu_0\sigma)\}}$. For example, when using copper, the thickness of the band-shaped conductor 13 and of the side conductor 15 should be 2.1 μm or greater. This bandpass filter 11 is used in a system with a characteristic impedance of 100Ω.

Figure 32:
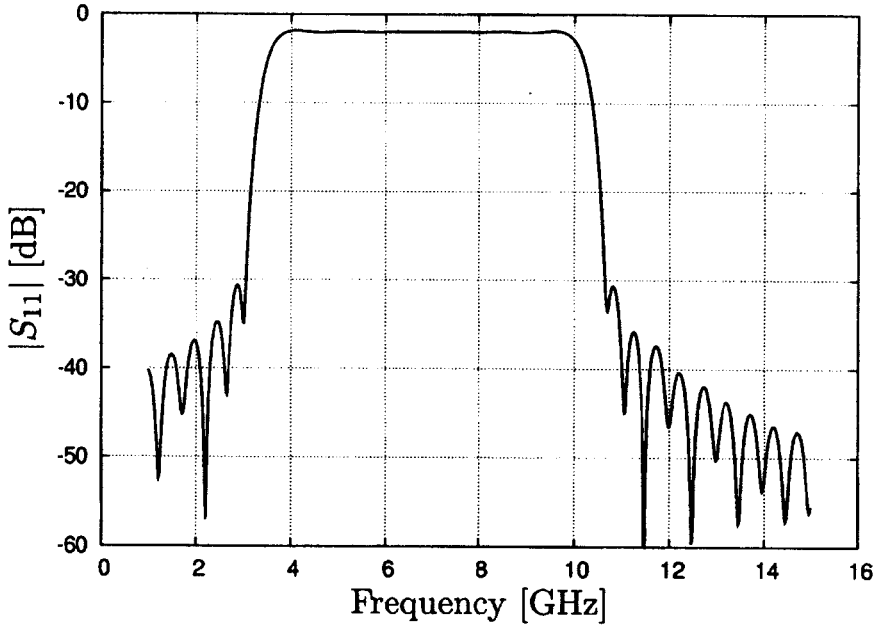
FIG. 32 is a graph showing the reflected wave amplitude characteristic in the reflection-type bandpass filter fabricated in Embodiment 5.
Figure 33:
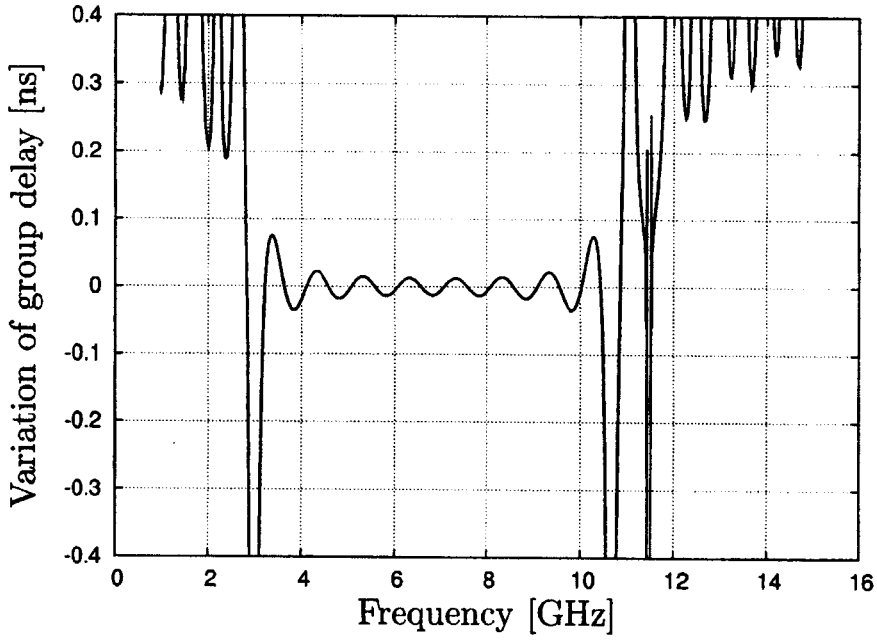
FIG. 33 is a graph showing the reflected wave group delay characteristic in the reflection-type bandpass filter fabricated in Embodiment 5.

FIG. 32 and FIG. 33 show the amplitude characteristic and group delay characteristic respectively of reflected waves ($S_{11}$) in the bandpass filter 11 of Embodiment 5. As shown in the figures, in the range of frequencies f for which 3.8 GHz≦f≦10.0 GHz, the reflectance is −5 dB or greater, and the group delay variation is within ±0.1 ns. In the region f<3.1 GHz or f>10.6 GHz, the reflectance is −20 dB or lower.

Embodiment 6

Figure 34:
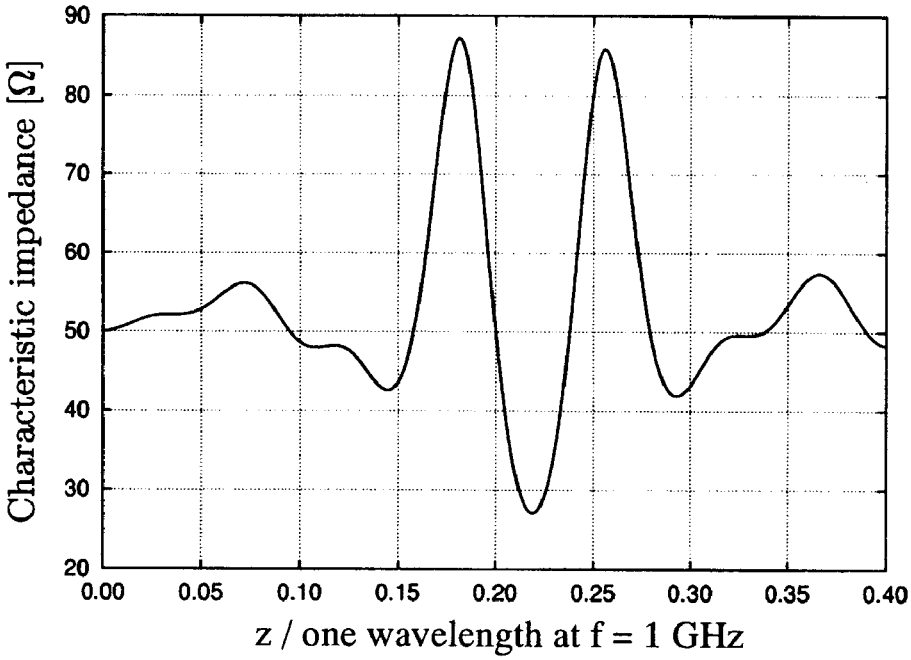
FIG. 34 is a graph showing the characteristic impedance distribution of the reflection-type bandpass filter fabricated in Embodiment 6.

A Kaiser window was used for which the reflectance is 0.9 at frequencies f in the range 3.8 GHz≦f≦9.9 GHz, and is 0 elsewhere, and for which A=30. Design was performed using 0.4 wavelength of signals at frequency f=1 GHz propagating in the coplanar strip as the waveguide length, and setting the system characteristic impedance to 50Ω. FIG. 34 shows the distribution in the z-axis direction of the local characteristic impedance obtained in the inverse problem.

Figure 35:
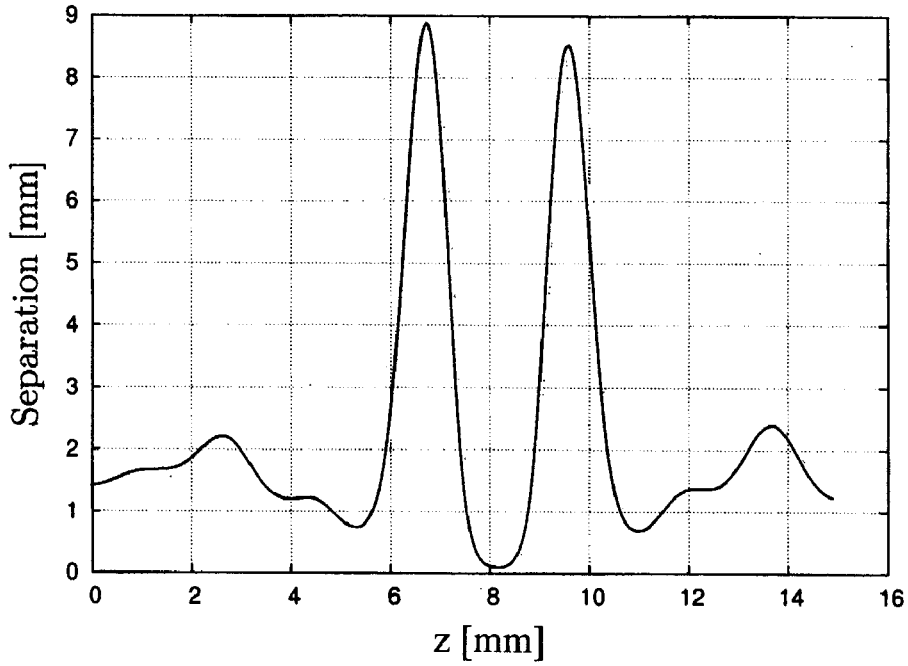
FIG. 35 is a graph showing the distribution of the distance between conductors of the coplanar strip in the reflection-type bandpass filter fabricated in Embodiment 6.

FIG. 35 shows the distribution in the z-axis direction of the distance between conductors s, when using a dielectric substrate 12 with a thickness h=2 mm and relative permittivity $\in_r$=140, and when the band-shaped conductor width w=1 mm. Table 12 lists the distances between conductors s.

TABLE 12

Distances between conductors

| z(mm) | 0.00 | 0.04 | 0.07 | 0.11 | 0.15 | 0.18 | 0.22 | 0.26 | 0.29 | 0.33 | 0.37 | 0.40 | 0.44 |
|---|---|---|---|---|---|---|---|---|---|---|---|---|---|
| s(mm) | 1.42 | 1.42 | 1.42 | 1.42 | 1.43 | 1.43 | 1.44 | 1.45 | 1.46 | 1.47 | 1.48 | 1.49 | 1.50 |
| #2 | 0.48 | 0.51 | 0.55 | 0.59 | 0.63 | 0.66 | 0.70 | 0.74 | 0.77 | 0.81 | 0.85 | 0.88 | 0.92 |
| — | 1.51 | 1.52 | 1.54 | 1.55 | 1.56 | 1.57 | 1.59 | 1.60 | 1.61 | 1.62 | 1.63 | 1.64 | 1.64 |
| #3 | 0.96 | 0.99 | 1.03 | 1.07 | 1.11 | 1.14 | 1.18 | 1.22 | 1.25 | 1.29 | 1.33 | 1.36 | 1.40 |
| — | 1.65 | 1.66 | 1.66 | 1.66 | 1.67 | 1.67 | 1.67 | 1.67 | 1.67 | 1.67 | 1.67 | 1.67 | 1.67 |
| #4 | 1.44 | 1.47 | 1.51 | 1.55 | 1.59 | 1.62 | 1.66 | 1.70 | 1.73 | 1.77 | 1.81 | 1.84 | 1.88 |
| — | 1.67 | 1.68 | 1.68 | 1.68 | 1.68 | 1.69 | 1.69 | 1.70 | 1.71 | 1.72 | 1.74 | 1.75 | 1.77 |
| #5 | 1.92 | 1.96 | 1.99 | 2.03 | 2.07 | 2.10 | 2.14 | 2.18 | 2.21 | 2.25 | 2.29 | 2.33 | 2.36 |
| — | 1.78 | 1.80 | 1.83 | 1.85 | 1.87 | 1.90 | 1.93 | 1.95 | 1.98 | 2.01 | 2.04 | 2.07 | 2.09 |
| #6 | 2.40 | 2.44 | 2.48 | 2.51 | 2.55 | 2.59 | 2.62 | 2.66 | 2.70 | 2.74 | 2.77 | 2.81 | 2.85 |
| — | 2.12 | 2.14 | 2.16 | 2.18 | 2.19 | 2.20 | 2.21 | 2.21 | 2.21 | 2.21 | 2.20 | 2.18 | 2.16 |
| #7 | 2.89 | 2.92 | 2.96 | 3.00 | 3.03 | 3.07 | 3.11 | 3.15 | 3.18 | 3.22 | 3.26 | 3.29 | 3.33 |
| — | 2.14 | 2.11 | 2.07 | 2.04 | 2.00 | 1.96 | 1.91 | 1.87 | 1.82 | 1.77 | 1.72 | 1.68 | 1.63 |
| #8 | 3.37 | 3.40 | 3.44 | 3.48 | 3.52 | 3.55 | 3.59 | 3.63 | 3.66 | 3.70 | 3.74 | 3.77 | 3.81 |
| — | 1.59 | 1.54 | 1.50 | 1.46 | 1.43 | 1.39 | 1.36 | 1.33 | 1.31 | 1.28 | 1.26 | 1.25 | 1.23 |
| #9 | 3.85 | 3.88 | 3.92 | 3.95 | 3.99 | 4.03 | 4.06 | 4.10 | 4.14 | 4.17 | 4.21 | 4.25 | 4.28 |
| — | 1.22 | 1.21 | 1.21 | 1.20 | 1.20 | 1.20 | 1.20 | 1.20 | 1.21 | 1.21 | 1.21 | 1.22 | 1.22 |
| #10 | 4.32 | 4.36 | 4.39 | 4.43 | 4.47 | 4.50 | 4.54 | 4.58 | 4.61 | 4.65 | 4.69 | 4.72 | 4.76 |
| — | 1.22 | 1.22 | 1.22 | 1.22 | 1.22 | 1.21 | 1.20 | 1.19 | 1.17 | 1.15 | 1.13 | 1.11 | 1.09 |
| #11 | 4.80 | 4.83 | 4.87 | 4.91 | 4.94 | 4.98 | 5.02 | 5.05 | 5.09 | 5.12 | 5.16 | 5.20 | 5.23 |
| — | 1.06 | 1.03 | 1.00 | 0.97 | 0.94 | 0.91 | 0.89 | 0.86 | 0.84 | 0.81 | 0.79 | 0.77 | 0.76 |
| #12 | 5.27 | 5.31 | 5.34 | 5.38 | 5.41 | 5.45 | 5.49 | 5.52 | 5.56 | 5.60 | 5.63 | 5.67 | 5.71 |
| — | 0.75 | 0.74 | 0.74 | 0.74 | 0.75 | 0.76 | 0.77 | 0.80 | 0.83 | 0.87 | 0.92 | 0.97 | 1.05 |
| #13 | 5.74 | 5.78 | 5.82 | 5.85 | 5.89 | 5.93 | 5.96 | 6.00 | 6.04 | 6.08 | 6.11 | 6.15 | 6.19 |
| — | 1.13 | 1.23 | 1.34 | 1.48 | 1.64 | 1.82 | 2.03 | 2.27 | 2.54 | 2.84 | 3.18 | 3.55 | 3.94 |
| #14 | 6.23 | 6.27 | 6.31 | 6.35 | 6.39 | 6.43 | 6.48 | 6.52 | 6.56 | 6.60 | 6.65 | 6.69 | 6.73 |
| — | 4.36 | 4.81 | 5.26 | 5.73 | 6.20 | 6.66 | 7.11 | 7.52 | 7.90 | 8.23 | 8.50 | 8.70 | 8.83 |
| #15 | 6.78 | 6.82 | 6.86 | 6.91 | 6.95 | 6.99 | 7.03 | 7.08 | 7.12 | 7.16 | 7.20 | 7.24 | 7.28 |
| — | 8.88 | 8.84 | 8.72 | 8.52 | 8.23 | 7.88 | 7.45 | 6.98 | 6.46 | 5.92 | 5.35 | 4.78 | 4.22 |
| #16 | 7.32 | 7.35 | 7.39 | 7.43 | 7.47 | 7.50 | 7.54 | 7.58 | 7.61 | 7.65 | 7.68 | 7.72 | 7.76 |
| — | 3.68 | 3.17 | 2.70 | 2.28 | 1.90 | 1.58 | 1.30 | 1.06 | 0.87 | 0.71 | 0.58 | 4.48 | 0.39 |
| #17 | 7.79 | 7.83 | 7.86 | 7.90 | 7.94 | 7.97 | 8.01 | 8.04 | 8.08 | 8.12 | 8.15 | 8.19 | 8.22 |
| — | 0.32 | 0.27 | 0.22 | 0.19 | 0.16 | 0.14 | 0.12 | 0.11 | 0.10 | 0.09 | 0.09 | 0.09 | 0.09 |
| #18 | 8.26 | 8.30 | 8.33 | 8.37 | 8.40 | 8.44 | 8.48 | 8.51 | 8.55 | 8.58 | 8.62 | 8.66 | 8.69 |
| — | 0.09 | 0.10 | 0.10 | 0.11 | 0.13 | 0.14 | 0.17 | 0.20 | 0.23 | 0.28 | 0.33 | 0.41 | 0.49 |
| #19 | 8.73 | 8.77 | 8.80 | 8.84 | 8.87 | 8.91 | 8.95 | 8.99 | 9.02 | 9.06 | 9.10 | 9.14 | 9.18 |
| — | 0.60 | 0.74 | 0.90 | 1.10 | 1.33 | 1.61 | 1.94 | 2.31 | 2.73 | 3.20 | 3.69 | 4.22 | 4.76 |
| #20 | 9.22 | 9.26 | 9.30 | 9.34 | 9.38 | 9.43 | 9.47 | 9.51 | 9.56 | 9.60 | 9.64 | 9.69 | 9.73 |
| — | 5.30 | 5.84 | 6.35 | 6.84 | 7.28 | 7.67 | 7.99 | 8.25 | 8.42 | 8.52 | 8.53 | 8.47 | 8.32 |
| #21 | 9.77 | 9.81 | 9.86 | 9.90 | 9.94 | 9.98 | 10.02 | 10.06 | 10.10 | 10.14 | 10.18 | 10.22 | 10.26 |
| — | 8.11 | 7.84 | 7.51 | 7.14 | 6.73 | 6.29 | 5.85 | 5.39 | 4.94 | 4.50 | 4.08 | 3.68 | 3.30 |
| #22 | 10.29 | 10.33 | 10.37 | 10.41 | 10.44 | 10.48 | 10.52 | 10.55 | 10.59 | 10.63 | 10.66 | 10.70 | 10.74 |
| — | 2.96 | 2.64 | 2.36 | 2.11 | 1.88 | 1.69 | 1.52 | 1.37 | 1.24 | 1.14 | 1.04 | 0.97 | 0.90 |
| #23 | 10.77 | 10.81 | 10.85 | 10.88 | 10.92 | 10.95 | 10.99 | 11.03 | 11.06 | 11.10 | 11.14 | 11.17 | 11.21 |
| — | 0.85 | 0.80 | 0.77 | 0.74 | 0.72 | 0.70 | 0.69 | 0.69 | 0.69 | 0.69 | 0.70 | 0.72 | 0.73 |
| #24 | 11.24 | 11.28 | 11.32 | 11.35 | 11.39 | 11.43 | 11.46 | 11.50 | 11.54 | 11.57 | 11.61 | 11.65 | 11.68 |
| — | 0.75 | 0.78 | 0.80 | 0.83 | 0.86 | 0.89 | 0.93 | 0.97 | 1.00 | 1.04 | 1.08 | 1.11 | 1.15 |
| #25 | 11.72 | 11.75 | 11.79 | 11.83 | 11.86 | 11.90 | 11.94 | 11.97 | 12.01 | 12.05 | 12.08 | 12.12 | 12.16 |
| — | 1.18 | 1.21 | 1.24 | 1.27 | 1.29 | 1.31 | 1.33 | 1.34 | 1.35 | 1.36 | 1.37 | 1.37 | 1.37 |
| #26 | 12.20 | 12.23 | 12.27 | 12.31 | 12.34 | 12.38 | 12.42 | 12.45 | 12.49 | 12.53 | 12.56 | 12.60 | 12.64 |
| — | 1.37 | 1.37 | 1.37 | 1.37 | 1.37 | 1.37 | 1.37 | 1.37 | 1.37 | 1.38 | 1.38 | 1.39 | 1.40 |
| #27 | 12.67 | 12.71 | 12.75 | 12.78 | 12.82 | 12.86 | 12.89 | 12.93 | 12.97 | 13.00 | 13.04 | 13.08 | 13.12 |
| — | 1.41 | 1.43 | 1.45 | 1.47 | 1.50 | 1.53 | 1.56 | 1.59 | 1.63 | 1.67 | 1.71 | 1.76 | 1.81 |
| #28 | 13.15 | 13.19 | 13.23 | 13.26 | 13.30 | 13.34 | 13.38 | 13.41 | 13.45 | 13.49 | 13.52 | 13.56 | 13.60 |
| — | 1.85 | 1.90 | 1.95 | 2.01 | 2.06 | 2.10 | 2.15 | 2.20 | 2.24 | 2.28 | 2.31 | 2.34 | 2.36 |
| #29 | 13.64 | 13.67 | 13.71 | 13.75 | 13.79 | 13.82 | 13.86 | 13.90 | 13.94 | 13.97 | 14.01 | 14.05 | 14.09 |
| — | 2.38 | 2.39 | 2.40 | 2.40 | 2.39 | 2.38 | 2.36 | 2.33 | 2.30 | 2.27 | 2.23 | 2.18 | 2.14 |
| #30 | 14.12 | 14.16 | 14.20 | 14.23 | 14.27 | 14.31 | 14.35 | 14.38 | 14.42 | 14.46 | 14.49 | 14.53 | 14.57 |
| — | 2.09 | 2.03 | 1.98 | 1.93 | 1.87 | 1.82 | 1.76 | 1.71 | 1.66 | 1.61 | 1.57 | 1.52 | 1.48 |
| #31 | 14.60 | 14.64 | 14.68 | 14.71 | 14.75 | 14.79 | 14.82 | 14.86 | 14.90 | 14.93 | 14.97 | | |
| — | 1.44 | 1.41 | 1.37 | 1.35 | 1.32 | 1.30 | 1.28 | 1.26 | 1.25 | 1.24 | 1.23 | | |

Figure 36:
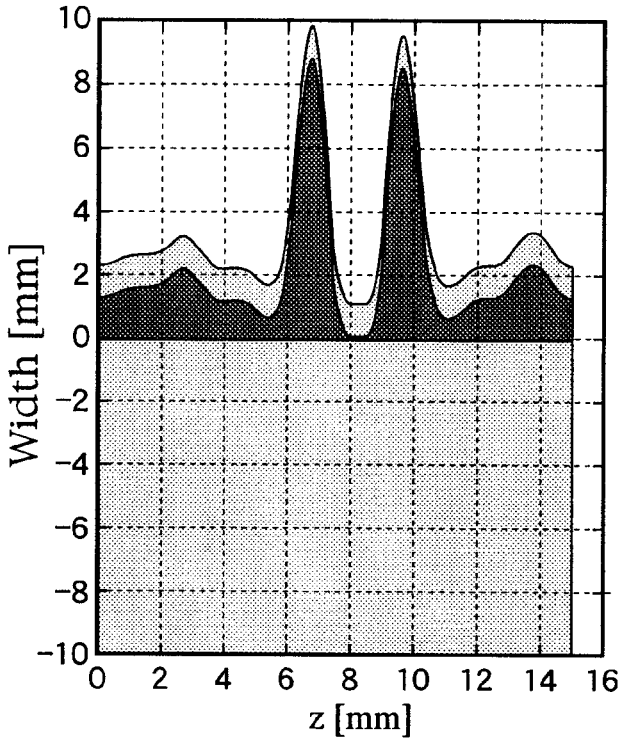
FIG. 36 is a graph showing the first shape of the coplanar strip in the reflection-type bandpass filter fabricated in Embodiment 6.
Figure 37:
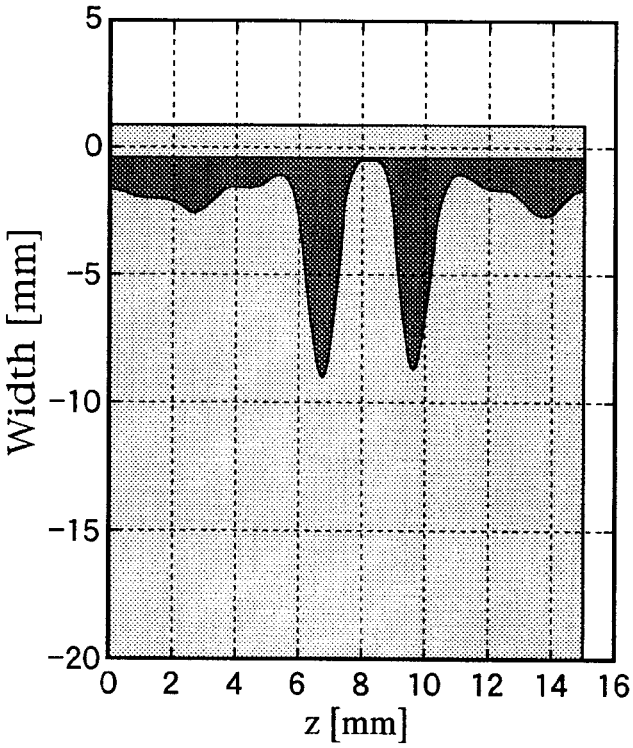
FIG. 37 is a graph showing the second shape of the coplanar strip in the reflection-type bandpass filter fabricated in Embodiment 6.
Figure 38:
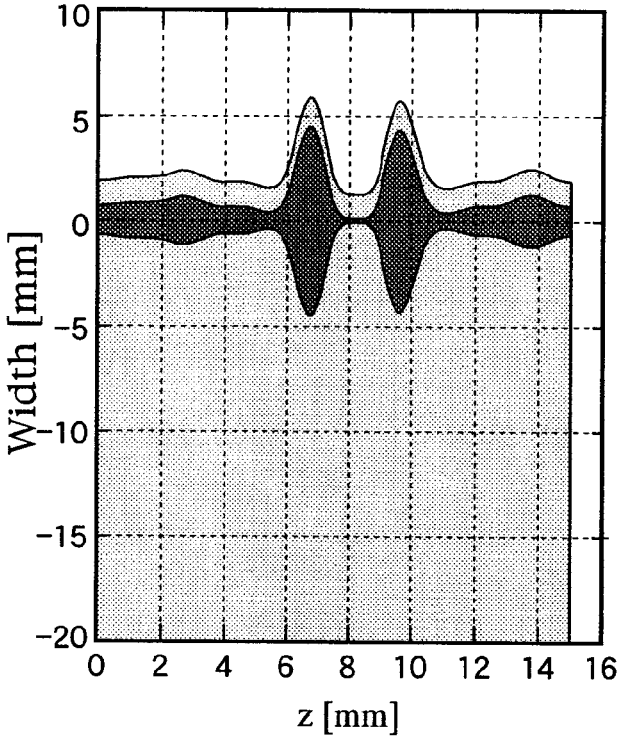
FIG. 38 is a graph showing the third shape of the coplanar strip in the reflection-type bandpass filter fabricated in Embodiment 6.

FIGS. 36 to 38 show the shapes of the coplanar strip in the reflection-type bandpass filter 11 of Embodiment 6. In the figures, the lightly shaded portion represents the band-shaped conductor 13 and the side conductor 15, and the heavily shaded portion represents the non-conducting portion 14. In FIG. 36, a coplanar strip is formed with the side edge 15*a* of the side conductor 15 made a straight line, and with both side edges 13*a*, 13*b* of the band-shaped conductor 13 changed such that the distance between conductors s takes on calculated values and the band-shaped conductor width w=1 mm. In FIG. 37, a coplanar strip is formed with both side edges 13*a* and 13*b* of the band-shaped conductor 13 made a straight line, and with the side edge 15*a* of the side conductor 15 changed such that the distance between conductors s takes on calculated values. In FIG. 38, a coplanar strip is formed with the side edge 13*a* of the band-shaped conductor 13 and the side edge 15*a* of the side conductor 15 varied such that the distance between conductors s takes on calculated values, and so as to be symmetrical with respect to the center line of the non-conducting portion 14. A non-reflecting terminator, or an R=50Ω resistance, is provided on the terminating side (the face at z=14.97 mm) of this reflection-type bandpass filter 11. The thicknesses of the metal films of the band-shaped conductor 13 and of the side conductor 15 are to be thick compared with the skin depth at f=1 GHz. For example, when using copper, the thickness of the band-shaped conductor 13 and of the side conductor 15 should be 2.1 μm or greater. This bandpass filter 11 is used in a system with a characteristic impedance of 50Ω.

Figure 39:
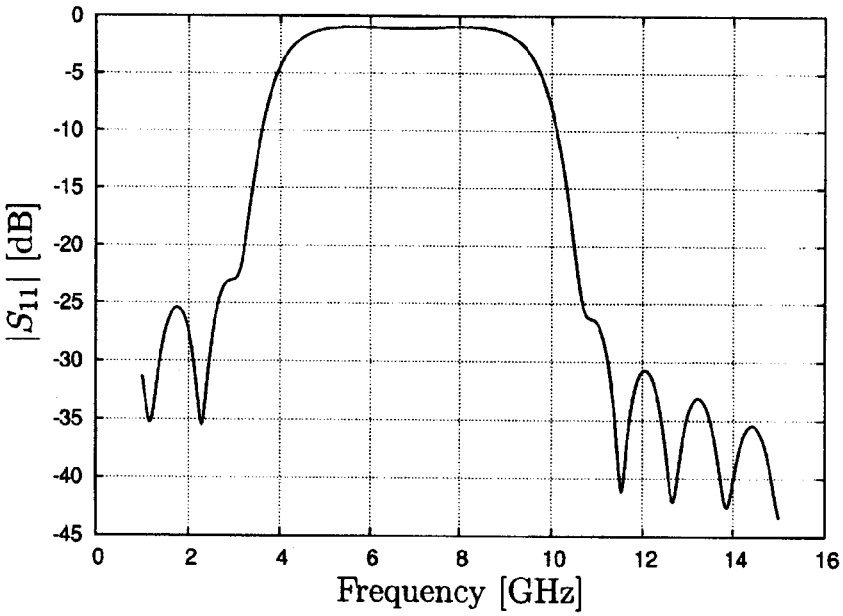
FIG. 39 is a graph showing the reflected wave amplitude characteristic in the reflection-type bandpass filter fabricated in Embodiment 6.
Figure 40:
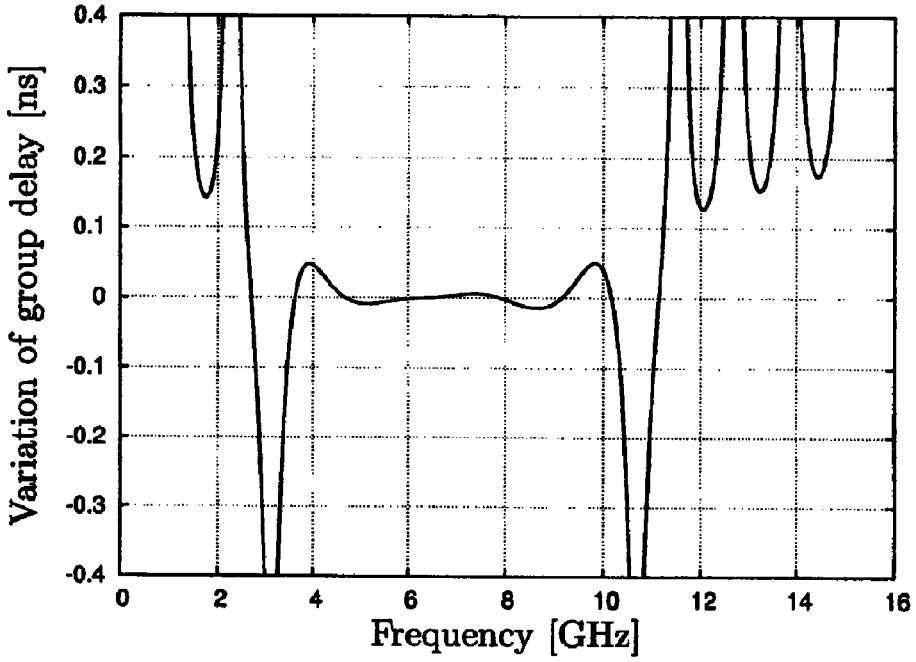
FIG. 40 is a graph showing the reflected wave group delay characteristic in the reflection-type bandpass filter fabricated in Embodiment 6.

FIG. 39 and FIG. 40 show the amplitude characteristic and group delay characteristic respectively of reflected waves ($S_{11}$) in the bandpass filter 1 of Embodiment 6. As shown in the figures, in the range of frequencies f for which 4.5 GHz≦f≦9.1 GHz, the reflectance is −2 dB or greater, and the group delay variation is within ±0.05 ns. In the region f<3.1 GHz or f>10.6 GHz, the reflectance is −20 dB or lower.

Embodiment 7

Figure 41:
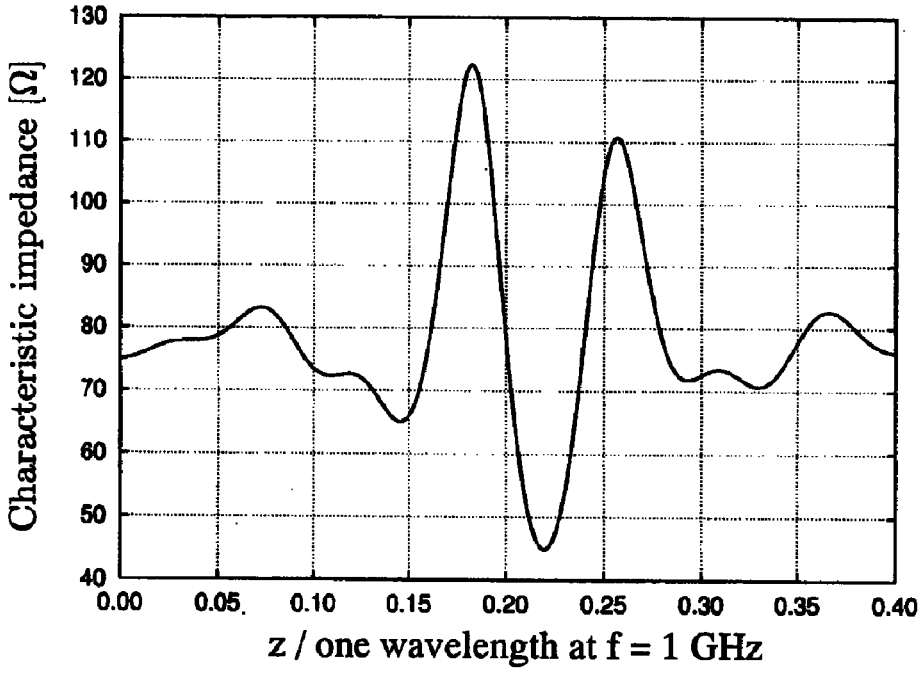
FIG. 41 is a graph showing the characteristic impedance distribution of the reflection-type bandpass filter fabricated in Embodiment 7.

A Kaiser window was used for which the reflectance is 0.8 at frequencies f in the range 3.8 GHz≦f≦9.9 GHz, and is 0 elsewhere, and for which A=30. Design was performed using 0.4 wavelength of signals at frequency f=1 GHz propagating in the coplanar strip as the waveguide length, and setting the system characteristic impedance to 75Ω. FIG. 41 shows the distribution in the z-axis direction of the local characteristic impedance obtained in the inverse problem.

Figure 42:
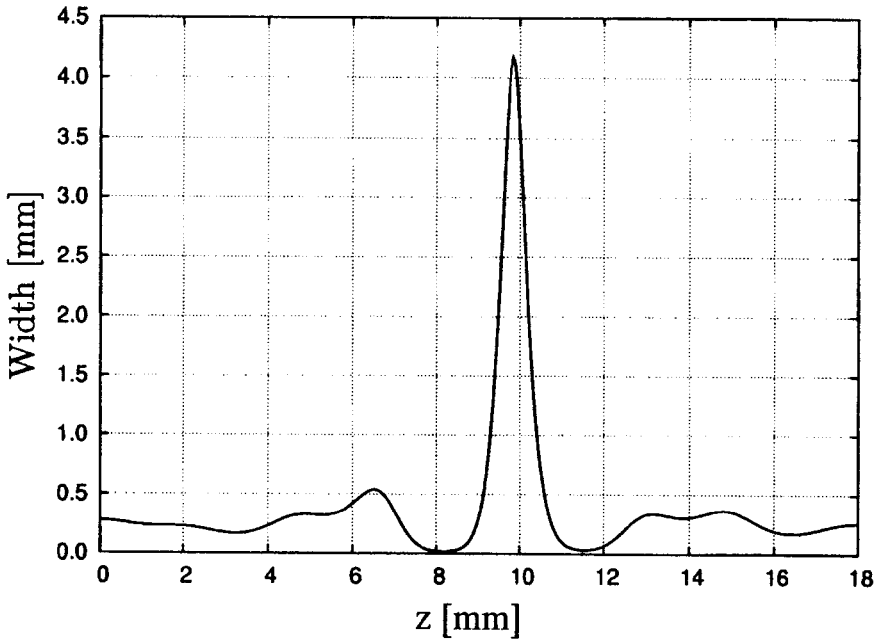
FIG. 42 is a graph showing the distribution of the band-shaped conductor width of the coplanar strip in the reflection-type bandpass filter fabricated in Embodiment 7.

FIG. 42 shows the distribution in the z-axis direction of the band-shaped conductor width w, when using a dielectric substrate 12 with a thickness h=2 mm and relative permittivity $\in_r$=90, and when the distance between conductors s=1 mm. That is, with the distance between conductors s fixed, the characteristic impedance is varied by varying the band-shaped conductor width w. Table 13 lists the band-shaped conductor widths s.

TABLE 13

Band-shaped conductor widths

| | | | | | | | | | | | | | |
|---|---|---|---|---|---|---|---|---|---|---|---|---|---|
| z(mm) | 0.00 | 0.04 | 0.09 | 0.13 | 0.18 | 0.22 | 0.27 | 0.31 | 0.36 | 0.40 | 0.45 | 0.49 | 0.54 |
| w(mm) | 0.28 | 0.27 | 0.27 | 0.27 | 0.27 | 0.27 | 0.27 | 0.27 | 0.27 | 0.26 | 0.26 | 0.26 | 0.26 |
| #2 | 0.58 | 0.63 | 0.67 | 0.72 | 0.76 | 0.81 | 0.85 | 0.90 | 0.94 | 0.98 | 1.03 | 1.07 | 1.12 |
| — | 0.26 | 0.25 | 0.25 | 0.25 | 0.25 | 0.25 | 0.24 | 0.24 | 0.24 | 0.24 | 0.24 | 0.23 | 0.23 |
| #3 | 1.16 | 1.21 | 1.25 | 1.30 | 1.34 | 1.39 | 1.43 | 1.48 | 1.52 | 1.57 | 1.61 | 1.66 | 1.70 |
| — | 0.23 | 0.23 | 0.23 | 0.23 | 0.23 | 0.23 | 0.23 | 0.23 | 0.23 | 0.23 | 0.23 | 0.23 | 0.23 |
| #4 | 1.75 | 1.79 | 1.83 | 1.88 | 1.92 | 1.97 | 2.01 | 2.06 | 2.10 | 2.15 | 2.19 | 2.24 | 2.28 |
| — | 0.23 | 0.23 | 0.23 | 0.23 | 0.23 | 0.23 | 0.23 | 0.22 | 0.22 | 0.22 | 0.22 | 0.22 | 0.22 |
| #5 | 2.33 | 2.37 | 2.42 | 2.46 | 2.51 | 2.55 | 2.60 | 2.64 | 2.68 | 2.73 | 2.77 | 2.82 | 2.86 |
| — | 0.21 | 0.21 | 0.21 | 0.20 | 0.20 | 0.20 | 0.19 | 0.19 | 0.19 | 0.19 | 0.18 | 0.18 | 0.18 |
| #6 | 2.91 | 2.95 | 3.00 | 3.04 | 3.09 | 3.13 | 3.18 | 3.22 | 3.27 | 3.31 | 3.36 | 3.40 | 3.44 |
| — | 0.17 | 0.17 | 0.17 | 0.17 | 0.17 | 0.17 | 0.17 | 0.17 | 0.17 | 0.17 | 0.17 | 0.17 | 0.17 |
| #7 | 3.49 | 3.53 | 3.58 | 3.62 | 3.67 | 3.71 | 3.76 | 3.80 | 3.85 | 3.89 | 3.94 | 3.98 | 4.03 |
| — | 0.17 | 0.18 | 0.18 | 0.18 | 0.19 | 0.19 | 0.20 | 0.20 | 0.21 | 0.21 | 0.22 | 0.23 | 0.24 |
| #8 | 4.07 | 4.12 | 4.16 | 4.21 | 4.25 | 4.29 | 4.34 | 4.38 | 4.43 | 4.47 | 4.52 | 4.56 | 4.61 |
| — | 0.24 | 0.25 | 0.26 | 0.27 | 0.27 | 0.28 | 0.29 | 0.29 | 0.30 | 0.31 | 0.31 | 0.32 | 0.32 |
| #9 | 4.65 | 4.70 | 4.74 | 4.79 | 4.83 | 4.88 | 4.92 | 4.97 | 5.01 | 5.06 | 5.10 | 5.15 | 5.19 |
| — | 0.32 | 0.32 | 0.33 | 0.33 | 0.33 | 0.33 | 0.33 | 0.33 | 0.33 | 0.33 | 0.32 | 0.32 | 0.32 |
| #10 | 5.24 | 5.28 | 5.33 | 5.37 | 5.41 | 5.46 | 5.50 | 5.55 | 5.59 | 5.64 | 5.68 | 5.73 | 5.77 |
| — | 0.32 | 0.32 | 0.32 | 0.32 | 0.32 | 0.33 | 0.33 | 0.33 | 0.34 | 0.34 | 0.35 | 0.36 | 0.36 |
| #11 | 5.82 | 5.86 | 5.91 | 5.95 | 6.00 | 6.04 | 6.09 | 6.13 | 6.18 | 6.22 | 6.27 | 6.31 | 6.36 |
| — | 0.37 | 0.38 | 0.40 | 0.41 | 0.42 | 0.43 | 0.45 | 0.46 | 0.48 | 0.49 | 0.50 | 0.51 | 0.52 |
| #12 | 6.40 | 6.45 | 6.49 | 6.54 | 6.58 | 6.63 | 6.67 | 6.72 | 6.76 | 6.81 | 6.85 | 6.90 | 6.94 |
| — | 0.53 | 0.54 | 0.54 | 0.54 | 0.53 | 0.53 | 0.51 | 0.50 | 0.48 | 0.46 | 0.43 | 0.41 | 0.38 |
| #13 | 6.99 | 7.03 | 7.08 | 7.12 | 7.17 | 7.21 | 7.25 | 7.30 | 7.34 | 7.39 | 7.43 | 7.48 | 7.52 |
| — | 0.35 | 0.32 | 0.29 | 0.26 | 0.23 | 0.21 | 0.18 | 0.16 | 0.14 | 0.12 | 0.10 | 0.09 | 0.08 |
| #14 | 7.57 | 7.61 | 7.66 | 7.70 | 7.75 | 7.79 | 7.84 | 7.88 | 7.92 | 7.97 | 8.01 | 8.06 | 8.10 |
| — | 0.07 | 0.06 | 0.05 | 0.04 | 0.04 | 0.03 | 0.03 | 0.02 | 0.02 | 0.02 | 0.02 | 0.02 | 0.02 |
| #15 | 8.15 | 8.19 | 8.24 | 8.28 | 8.33 | 8.37 | 8.41 | 8.46 | 8.50 | 8.55 | 8.59 | 8.64 | 8.68 |
| — | 0.02 | 0.02 | 0.02 | 0.02 | 0.02 | 0.02 | 0.03 | 0.03 | 0.03 | 0.04 | 0.05 | 0.06 | 0.07 |
| #16 | 8.73 | 8.77 | 8.82 | 8.86 | 8.91 | 8.95 | 9.00 | 9.04 | 9.09 | 9.13 | 9.18 | 9.22 | 9.27 |
| — | 0.09 | 0.11 | 0.13 | 0.16 | 0.20 | 0.24 | 0.30 | 0.37 | 0.45 | 0.54 | 0.66 | 0.79 | 0.95 |
| #17 | 9.31 | 9.36 | 9.40 | 9.45 | 9.50 | 9.54 | 9.59 | 9.64 | 9.69 | 9.74 | 9.78 | 9.83 | 9.88 |
| — | 1.14 | 1.35 | 1.59 | 1.87 | 2.18 | 2.52 | 2.88 | 3.25 | 3.60 | 3.89 | 4.09 | 4.18 | 4.13 |
| #18 | 9.93 | 9.98 | 10.03 | 10.08 | 10.12 | 10.17 | 10.22 | 10.26 | 10.31 | 10.35 | 10.40 | 10.44 | 10.49 |
| — | 3.95 | 3.68 | 3.35 | 2.99 | 2.63 | 2.29 | 1.97 | 1.69 | 1.44 | 1.23 | 1.04 | 0.88 | 0.74 |
| #19 | 10.53 | 10.58 | 10.62 | 10.67 | 10.71 | 10.76 | 10.80 | 10.85 | 10.89 | 10.94 | 10.98 | 11.03 | 11.07 |
| — | 0.62 | 0.52 | 0.43 | 0.36 | 0.30 | 0.25 | 0.21 | 0.17 | 0.14 | 0.12 | 0.10 | 0.09 | 0.07 |
| #20 | 11.12 | 11.16 | 11.21 | 11.25 | 11.29 | 11.34 | 11.38 | 11.43 | 11.47 | 11.52 | 11.56 | 11.61 | 11.65 |
| — | 0.06 | 0.06 | 0.05 | 0.04 | 0.04 | 0.04 | 0.04 | 0.03 | 0.03 | 0.03 | 0.03 | 0.03 | 0.03 |
| #21 | 11.70 | 11.74 | 11.79 | 11.83 | 11.87 | 11.92 | 11.96 | 12.01 | 12.05 | 12.10 | 12.14 | 12.19 | 12.23 |
| — | 0.04 | 0.04 | 0.04 | 0.05 | 0.05 | 0.06 | 0.06 | 0.07 | 0.08 | 0.08 | 0.09 | 0.10 | 0.12 |
| #22 | 12.28 | 12.32 | 12.37 | 12.41 | 12.46 | 12.50 | 12.54 | 12.59 | 12.63 | 12.68 | 12.72 | 12.77 | 12.81 |
| — | 0.13 | 0.14 | 0.16 | 0.17 | 0.19 | 0.20 | 0.22 | 0.23 | 0.25 | 0.26 | 0.28 | 0.29 | 0.30 |
| #23 | 12.86 | 12.90 | 12.95 | 12.99 | 13.04 | 13.08 | 13.13 | 13.17 | 13.22 | 13.26 | 13.31 | 13.35 | 13.40 |
| — | 0.31 | 0.32 | 0.33 | 0.33 | 0.34 | 0.34 | 0.34 | 0.34 | 0.34 | 0.34 | 0.33 | 0.33 | 0.33 |
| #24 | 13.44 | 13.49 | 13.53 | 13.57 | 13.62 | 13.66 | 13.71 | 13.75 | 13.80 | 13.84 | 13.89 | 13.93 | 13.98 |
| — | 0.32 | 0.32 | 0.32 | 0.31 | 0.31 | 0.31 | 0.31 | 0.31 | 0.30 | 0.30 | 0.30 | 0.30 | 0.31 |
| #25 | 14.02 | 14.07 | 14.11 | 14.16 | 14.20 | 14.25 | 14.29 | 14.34 | 14.38 | 14.43 | 14.47 | 14.52 | 14.56 |
| — | 0.31 | 0.31 | 0.31 | 0.32 | 0.32 | 0.32 | 0.33 | 0.33 | 0.34 | 0.34 | 0.35 | 0.35 | 0.35 |

TABLE 13-continued

| Band-shaped conductor widths | | | | | | | | | | | | | |
|---|---|---|---|---|---|---|---|---|---|---|---|---|---|
| #26 | 14.61 | 14.65 | 14.70 | 14.74 | 14.78 | 14.83 | 14.87 | 14.92 | 14.96 | 15.01 | 15.05 | 15.10 | 15.14 |
| — | 0.36 | 0.36 | 0.36 | 0.36 | 0.36 | 0.36 | 0.36 | 0.36 | 0.36 | 0.35 | 0.35 | 0.34 | 0.34 |
| #27 | 15.19 | 15.23 | 15.28 | 15.32 | 15.37 | 15.41 | 15.46 | 15.50 | 15.55 | 15.59 | 15.64 | 15.68 | 15.73 |
| — | 0.33 | 0.32 | 0.32 | 0.31 | 0.30 | 0.29 | 0.28 | 0.27 | 0.26 | 0.25 | 0.25 | 0.24 | 0.23 |
| #28 | 15.77 | 15.82 | 15.86 | 15.90 | 15.95 | 15.99 | 16.04 | 16.08 | 16.13 | 16.17 | 16.22 | 16.26 | 16.31 |
| — | 0.22 | 0.21 | 0.21 | 0.20 | 0.20 | 0.19 | 0.19 | 0.18 | 0.18 | 0.18 | 0.17 | 0.17 | 0.17 |
| #29 | 16.35 | 16.40 | 16.44 | 16.49 | 16.53 | 16.58 | 16.62 | 16.66 | 16.71 | 16.75 | 16.80 | 16.84 | 16.89 |
| — | 0.17 | 0.17 | 0.17 | 0.17 | 0.17 | 0.17 | 0.17 | 0.18 | 0.18 | 0.18 | 0.18 | 0.19 | 0.19 |
| #30 | 16.93 | 16.98 | 17.02 | 17.07 | 17.11 | 17.16 | 17.20 | 17.25 | 17.29 | 17.34 | 17.38 | 17.43 | 17.47 |
| — | 0.19 | 0.20 | 0.20 | 0.20 | 0.21 | 0.21 | 0.22 | 0.22 | 0.22 | 0.23 | 0.23 | 0.23 | 0.24 |
| #31 | 17.51 | 17.56 | 17.6 | 17.65 | 17.69 | 17.74 | 17.78 | 17.83 | 17.87 | 17.92 | 17.96 | | |
| — | 0.24 | 0.24 | 0.25 | 0.25 | 0.25 | 0.25 | 0.25 | 0.25 | 0.25 | 0.26 | 0.26 | | |

Figure 43:
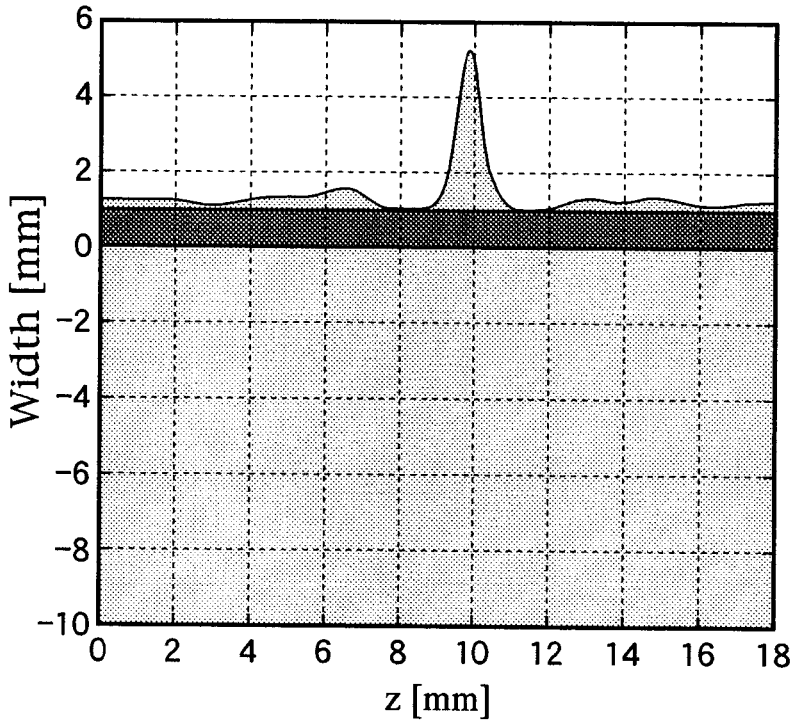
FIG. 43 is a graph showing the first shape of the coplanar strip in the reflection-type bandpass filter fabricated in Embodiment 7.
Figure 44:
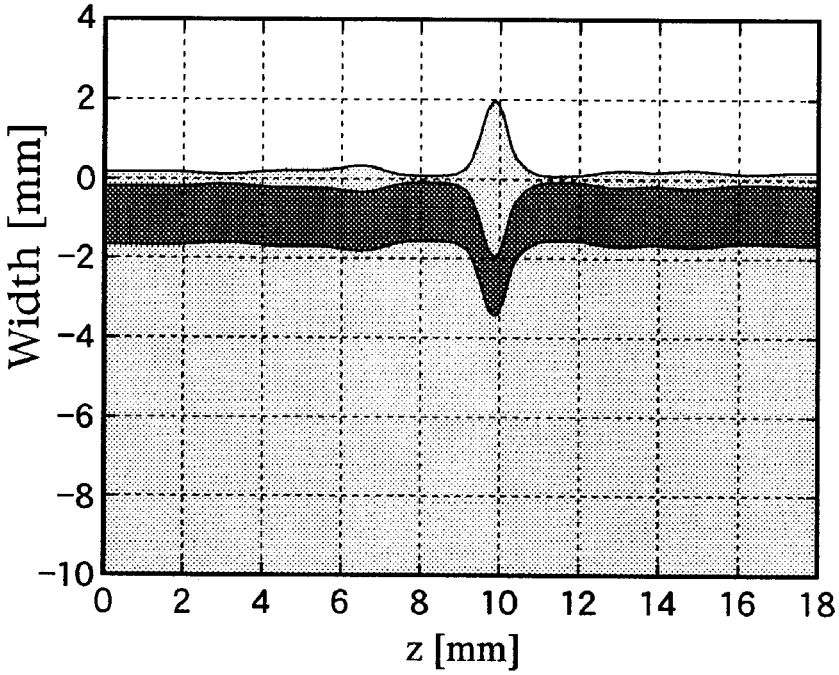
FIG. 44 is a graph showing the second shape of the coplanar strip in the reflection-type bandpass filter fabricated in Embodiment 7.

FIG. 43 and FIG. 44 show the shapes of the coplanar strip in the reflection-type bandpass filter 11 of Embodiment 7. In the figures, the lightly shaded portion represents the band-shaped conductor 3 and the side conductor 15, and the heavily shaded portion represents the non-conducting portion 14. In FIG. 43, a coplanar strip is formed with the side edge 13*a* of the band-shaped conductor 13 and the side edge 15*a* of the side conductor 15 made a straight line, and with the side edge 13*b* of the band-shaped conductor 13 changed such that the band-shaped conductor width w takes on calculated values. In FIG. 44, a coplanar strip is formed with both side edges 13*a* and 13*b* of the band-shaped conductor 13 varied such that the band-shaped conductor width w takes on calculated values, and so as to be symmetrical with respect to the center line of the band-shaped conductor 13. A non-reflecting terminator, or an R=75Ω resistance, is provided on the terminating side (the face at z=17.96 mm) of this reflection-type bandpass filter 11. The thicknesses of the metal films of the band-shaped conductor 13 and of the side conductor 15 are to be thick compared with the skin depth at f=1 GHz. For example, when using copper, the thickness of the band-shaped conductor 13 and of the side conductor 15 should be 2.1 μm or greater. This bandpass filter 11 is used in a system with a characteristic impedance of 75Ω.

Figure 45:
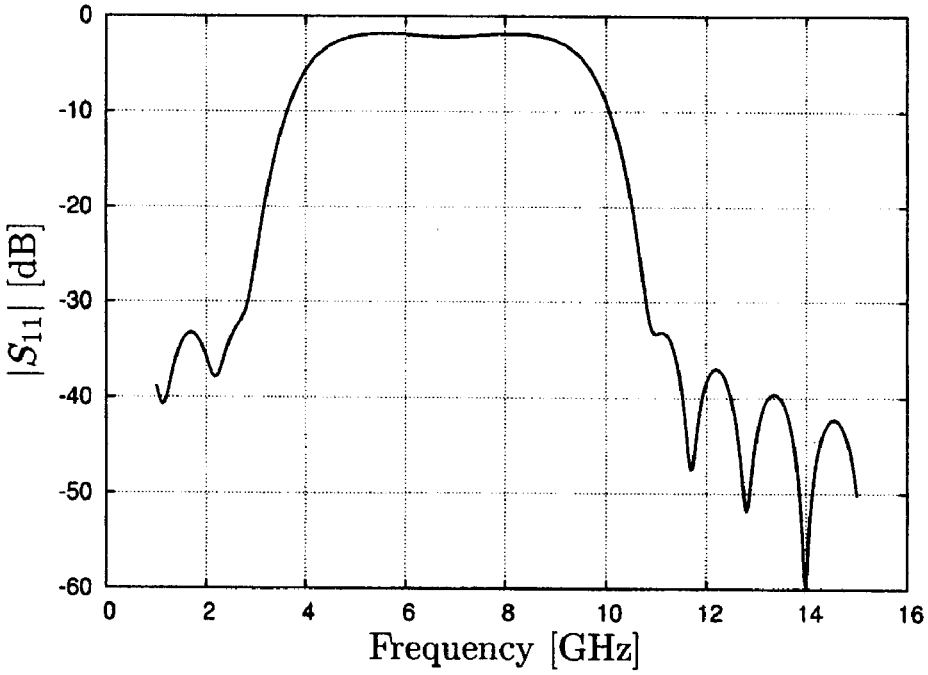
FIG. 45 is a graph showing the reflected wave amplitude characteristic in the reflection-type bandpass filter fabricated in Embodiment 7.
Figure 46:
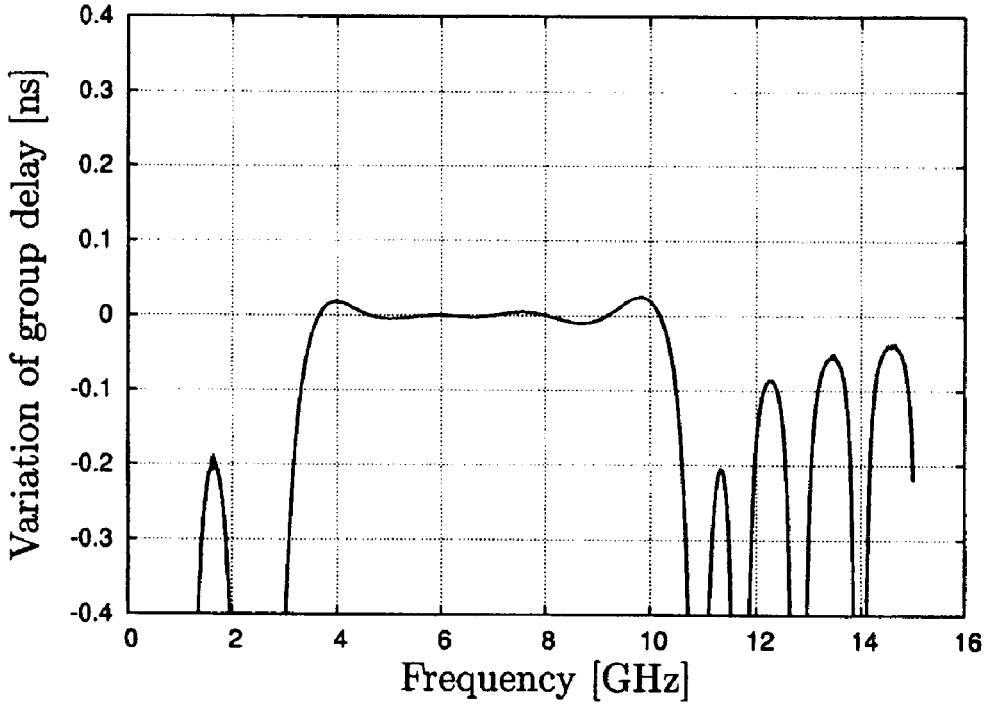
FIG. 46 is a graph showing the reflected wave group delay characteristic in the reflection-type bandpass filter fabricated in Embodiment 7; and, FIG. 47 is an equivalent circuit of a non-uniform transmission line.

FIG. 45 and FIG. 46 show the amplitude characteristic and group delay characteristic respectively of reflected waves ($S_{11}$) in the bandpass filter 11 of Embodiment 7. As shown in the figures, in the range of frequencies f for which 4.5 GHz≦f≦9.3 GHz, the reflectance is −5 dB or greater, and the group delay variation is within ±0.05 ns. In the region f<3.1 GHz or f>10.6 GHz, the reflectance is −20 dB or lower.

In the above, preferred embodiments of the invention have been explained; but the invention is not limited to these embodiments. Various additions, omissions, substitutions, and other modifications to the configuration can be made, without deviating from the gist of the invention. The invention is not limited by the above explanation, but is limited only by the scope of the attached claims.

What is claimed is:

1. A reflection-type bandpass filter for ultra-wideband wireless data communication comprising:

two conductors extending in a first direction on the surface of a dielectric substrate at a first distance from each other, the surface of the dielectric substrate between the conductors defining a non-conducting portion, wherein a width of the two conductors or the first distance between the two conductors, or both, vary in a length direction of the two conductors;

wherein length-direction distributions of the width of the two conductors and the first distance are determined using a design method based on an inverse problem of deriving a potential from spectral data in a Zakharov-Shabat equation.

2. The reflection-type bandpass filter according to claim 1, wherein the conductor width of at least one of the two conductors is constant along the first direction, and the first distance is distributed non-uniformly along the length direction.

3. The reflection-type bandpass filter according to claim 1, wherein the first distance is constant along the length direction, and the conductor width of at least one of the two conductors is distributed non-uniformly along the length direction.

4. The reflection-type bandpass filter according to claim 1, wherein the difference between the reflectance in a range of frequencies f for which f<3.1 GHz and f>10.6 GHz, and a reflectance in a range of frequencies for which 3.7 GHz≦f≦10.0 GHz, is 10 dB or greater, and wherein, in the range 3.7 GHz≦f≦10.0 GHz, a group delay variation is within ±0.05 ns.

5. The reflection-type bandpass filter according to claim 1, wherein the difference between the reflectance in a range of frequencies f for which f<3.1 GHz and f>10.6 GHz, and a reflectance in a range of frequencies for which 3.8 GHz≦f≦9.9 GHz, is 10 dB or greater, and wherein, in the range 3.8 GHz≦f≦9.9 GHz, the group delay variation is within ±0.1 ns.

6. The reflection-type bandpass filter according to claim 1, wherein the difference between a reflectance in a range of frequencies f for which f<3.1 GHz and f>10.6 GHz, and a reflectance in a range of frequencies for which 4.2 GHz≦f≦9.6 GHz, is 10 dB or greater, and wherein, in the range 4.2 GHz≦f≦9.6 GHz, a group delay variation is within ±0.15 ns.

7. The reflection-type bandpass filter according to claim 1, wherein the difference between a reflectance in a range of frequencies f for which f<3.1 GHz and f>10.6 GHz, and a reflectance in a range of frequencies for which 4.5 GHz≦f≦9.2 GHz, is 10 dB or greater, and wherein, in the range 4.5 GHz≦f≦9.2 GHz, a group delay variation is within ±0.05 ns.

8. The reflection-type bandpass filter according to claim 1, wherein a characteristic impedance Zc of an input terminal of the bandpass filter is such that 10Ω≦Zc≦300Ω.

9. The reflection-type bandpass filter according to claim 8, wherein a resistance having the same impedance as said characteristic impedance Zc, or a non-reflecting terminator, is provided on a terminating side of the bandpass filter.

10. The reflection-type bandpass filter according to claim 1, wherein the two conductors comprise metal plates of thickness equal to or greater than a skin depth of the metal plates at f=1 GHz.

11. The reflection-type bandpass filter according to claim 1, wherein a thickness h of the dielectric substrate is in a range 0.1 mm≦h≦10 mm, a relative permittivity $\in_r$ of the dielectric substrate is in a range $1 \leqq \in_r \leqq 500$, the width W of at least one of the two conductors is in a range 2 mm≦W≦100 mm, and a length L of at least one of the two conductors is in a range 2 mm≦L≦500 mm.

12. The reflection-type bandpass filter according to claim 1, wherein the variation along the length direction is non-uniform.

13. The reflection-type bandpass filter according to claim 1, wherein the length-direction distributions of the width of the two conductors and the first distance are determined using a window function method.

14. The reflection-type bandpass filter according to claim 1, wherein the length-direction distributions of the width of the two conductors and the first distance are determined using a Kaiser window function method.

15. A reflection-type bandpass filter for ultra-wideband wireless data communication, comprising:

a dielectric substrate;

a first conductor provided on a surface of the dielectric substrate; and a side conductor provided next to the first conductor at a first distance from the first conductor, with a non-conducting portion intervening between the first and side conductors, wherein a first conductor width or a distance between the first and side conductors, or both, vary along a length direction of the first conductor; and wherein distributions of the first conductor width and the first distance, along the length direction, are determined using a design method based on an inverse problem of deriving a potential from spectral data in a Zakharov-Shabat equation.

16. The reflection-type bandpass filter according to claim 15, wherein the first conductor width is constant along the length direction, and the distance between the first and side conductors is distributed non-uniformly along the length direction.

17. The reflection-type bandpass filter according to claim 16, wherein at least one of the opposing side edges of the first and side conductors is a straight line.

18. The reflection-type bandpass filter according to claim 16, wherein at least one of the opposing side edges of the first and side conductors are distributed non-uniformly in a band-shaped conductor length direction.

19. The reflection-type bandpass filter according to claim 15, wherein the first distance is constant along the length direction, and the first conductor width is distributed non-uniformly along the length direction.

20. The reflection-type bandpass filter according to claim 15, wherein the variation along the length of the first conductor is non-uniform.

21. The reflection-type bandpass filter according to claim 15, wherein the distributions of the first conductor width and the first distance, along the length direction, are determined using a window function method.

22. The reflection-type bandpass filter according to claim 15, wherein the distributions of the first conductor width, and the first distance between the first and side conductors, along the length direction, are determined using a Kaiser window function method.

* * * * *